US005626385A

United States Patent [19]

Shinn

[11] Patent Number: 5,626,385

[45] Date of Patent: May 6, 1997

[54] VERSATILE SUPPORT FOR DYNAMICALLY FRACTIONAL GROSS LOADS

[76] Inventor: Dean A. Shinn, P.O. Box 1031, Oakridge, Oreg. 97463

[21] Appl. No.: 179,509

[22] Filed: Dec. 30, 1993

Related U.S. Application Data

[63] Continuation-in-part of Ser. No. 816,298, Dec. 27, 1991, abandoned, which is a continuation-in-part of Ser. No. 24,178, Mar. 10, 1987, abandoned.

[51] Int. Cl.[6] ..... A47C 4/14

[52] U.S. Cl. ..... 297/18; 297/30; 297/56; 297/158.4

[58] Field of Search ..... 297/18, 30, 35, 297/41, 55, 56, 248, 259, 345, 159.4; 248/156; 108/1, 118

[56] References Cited

U.S. PATENT DOCUMENTS

| | | | |
|---|---|---|---|
| 1,539,225 | 5/1925 | West et al. | 297/18 |
| 1,770,321 | 7/1930 | Mougeotte | 297/248 X |
| 1,928,991 | 10/1933 | Bishop | 297/56 |
| 2,295,122 | 9/1942 | Moeller | 297/18 X |
| 2,741,298 | 4/1956 | Roberts III | 297/18 |
| 3,025,101 | 3/1962 | McKinnie | 297/56 |
| 3,224,530 | 12/1965 | King et al. | 297/56 X |
| 4,241,950 | 12/1980 | Simpson | 297/18 |

FOREIGN PATENT DOCUMENTS

| | | | |
|---|---|---|---|
| 76 | 1/1926 | Australia | 297/18 |

*Primary Examiner*—Peter R. Brown

[57] ABSTRACT

A pivotally articulated, foldable load-support device, comprising two oppositely inclined, intersecting leg frames, being joined by aligned pivotal connections at two pairs of upper pivot-points above the intersection of the leg frames to an upper load-bearing structure, and being joined by aligned pivotal connections at two pairs of lower pivot-points below the intersection of the leg frames to a lower load-bearing structure. Each load-bearing structure is divided, by relative placement of the paired pivot-points joining such load-bearing structures to the leg frames, into mutually co-responsive, load-distributing, balancing, load-reapportioning, and counterbalancing front, intermediate, and rear load-sharing portions thereof. Dimensions of leg frames and of load-bearing structures, and relative positions of the four paired pivot-points are proportioned so that, when not in operation, the device can be folded substantially flat, the rear leg frame nesting within the upper and lower load-bearing structures, the upper and lower load-bearing structures nesting within the front leg frame, and all leg-frame side-elements, all load-bearing structure side-elements, and all pivot-points thereby substantially occupying a single plane.

In table form, the upper load-bearing table-top structure cooperates and counterbalances in load-sharing relationships and in reciprocating pivotal actions with the lower load-bearing footrest structure. Similarly, in chair form, the upper load-bearing seat structure cooperates and counterbalances in reciprocating, load-sharing, counterbalancing relationships with the lower load-bearing footrest structure and cooperates in direct load-support relationships with the backrest. Variant configurations of chair and table embodiments are also disclosed.

12 Claims, 26 Drawing Sheets

VERSATILE SUPPORT FOR DYNAMICALLY FRACTIONAL GROSS LOADS

This application is a continuation-in-part of the applicant's previous application, Ser. No. 07/816,298, filed on Dec. 27, 1991, now abandoned which is a continuation-in-part of the application's original patent application, Ser. No. 07/024,178, filed on Mar. 9, 1987 now abandoned.

BACKGROUND OF THE INVENTION

Load support constructions, such as chairs and tables, have been devised to employ one or more components capable of moving in various ways to accommodate changes in the distribution of loads borne by such constructions and in the weight and pressure portions constituting such loads, such as changes in the posture of the occupant of a lounge chair, and to allow folding of the constructions, thereby reducing their dimensions to permit storage and transport when not in use. Means for providing such adaptability in relatively uncomplicated constructions, however, have generally consisted of very simple relationships of one movable component to an otherwise static support structure, such as a backrest hinged to a rigid seat-and-leg frame. Some rather rough outdoor furniture has consisted of pivotally articulated frames and linkage bars having a simple sling-type load-bearing surface draped between two intersecting frames.

In some representatives of the prior art (Meeker U.S. Pat. No. 1,969,313; Stanley U.S. Pat. No. 2,048,147; Gilbert U.S. Pat. No. 4,251,106; and Singer U.S. Pat. No. 4,597, 604,) flexible tension materials, such as chain, cable, or fabric, are used in place of one or of both pairs of the rigid horizontal pivot bars disclosed by other representatives of the prior art referenced above. However, use of flexible or elastic tension materials alone to afford pivotal connection of the constituent parts of such constructions, without the aid of a positive, structural pivoting articulation, results in a very loose jointing of constituent parts, causing the folding, or rather the "collapsing," action of the entire construction to be difficult, disjointed, and imprecise.

The present invention, however, provides a relatively uncomplicated load-support device comprised of several separate but functionally integrated gross-load-bearing, fractional-load-sharing structures, means, and arrangements of such interrelated structural components and features. These load-sharing components and features are structurally integrated in mutually co-responsive, load-distributing, and counterbalancing relationships. In this way, an integrally adaptable and implicitly load-apportioning, balancing, load-adjusting, and spontaneously load-reapportioning support device is formed. The differentiating fractional loads of a complex and dynamic gross load—such as an uncomfortable committee member, or an active, restless child—are apportioned, balanced, redistributed, adjusted, reapportioned, and counterbalanced among the unique load-sharing components and features of the applicant's invention. Differential load flux is immediately and implicitly accommodated and controlled through the invention's cooperative, co-responsive, load-sharing, load-distributing, and counterbalancing linkages of such components and features, which integral linkages convey subtle shifts in weights and pressures among the several cooperating fractional-load-sharing components and features of the invention. In furniture, this novel load-support device is implicitly adaptable to gross loads and to subtle changes in the use's posture, its unique conformation moving, flexing, and changing internal interrelationships between its cooperating, co-responsive fractional-load-sharing components and features to conform structurally to the changing posture and purposes of the user and to the changing disposition of the dynamic gross load constituted of varying weights and pressures within the fractional loads, and portions thereof, exerted by the user. This novel capability affords a remarkable—even therapeutic—quality and level of comfort and an unrivaled scope of utility through the applicant's invention when embodied as furniture.

Those constructions within the prior art that most closely resemble the applicant's invention have followed and refined the basic structure disclosed by Paice U.S. Pat. No. 564,312. Such constructions have come to be known generally as "rockerless rocking chairs" due to the pivotal articulation of their parts and due to the forward-and-backward "rocking motion" associated with such constructions when in operation.

Miles U.S. Pat. No. 1,875,478; Stockil U.S. Pat. No. 1,986,381; Bascom U.S. Pat. No. 2,203,610; and Martin U.S. Pat. No. 2,567,341 and U.S. Pat. No. 2,675,059 teach the use of footrests being connected in a simple, unilinear pivotal relationship with the lower portion of the front leg frame, such footrests being independent of the pivotal articulation of the other principal components of such constructions and independent of the functional interrelationships of those components. Such footrests are simply additive elements, functionally separate from the pivotal relationships of the central construction to which they are affixed. In addition, such additive elements are either coincident with already-existing components or are directly and fixedly supplementary to already-existing components, simply duplicating the pivotal or supportive relationships of other components principally involved in the basic flexing constitution of such constructions.

Some constructions included in this art field disclose the use of various "stops" or other means for regulating the forward-and-backward "rocking motion" of such constructions (Bergmann U.S. Pat. No. 1,673,387; Miles U.S. Pat. No. 1,875,478; Stanley U.S. Pat. No. 2,048,147; Bascom U.S. Pat. No. 2,203,610; Roberts III U.S. Pat. No. 2,741, 298; Stableford U.S. Pat. No. 3,154,344; Gilbert U.S. Pat. No. 4,251,106; and Singer U.S. Pat. No. 4,597,604.) While Moeller U.S. Pat. No. 2,295,122; Fielding Brit. Pat. No. 12,981; and Bernasconi Brit. Pat. No. 215,559 disclose the use of tension members, the employment of such tension members is incorporated in each of the referenced structures in very specific arrangements through very specific means for very specific ends, such arrangement, means, and ends being very particularly devised in union with the larger structure in which these members are incorporated. Likewise, flexible and elastic tension means, physical limiting means, and combinations thereof are incorporated in the applicant's invention in very particular arrangements through very particular means for very particular ends, all such arrangements, means, and ends relating in very specific ways to the special and novel components and features and arrangements of such components and features disclosed by the applicant's invention. The flexible and elastic means and their associated physical limiting means disclosed by the applicant's invention are formed, arranged, and disposed in very particular dynamic and functional relationships with the unique fractional-load-sharing structures and leg frames of this invention in order to achieve specific load-transfer and motion-governing effects. The prior art does not teach, anticipate, disclose, or embody the particular flexible and elastic tension means, the particular physical limiting means, or the particular arrangement and disposition of such means, as disclosed in the applicant's invention, in order to afford specific load-transfer and motion-governing effects, as achieved by the applicant's invention. Nor does the prior art teach, anticipate, disclose, or embody the novel and integrally superior interacting and cooperative relationships of these load-transferring and motion-governing means with the uniquely beneficial arrangement of load-distributing, counterbalancing, fractional-load-sharing structures, and portions thereof, nor the unique advantages of the functional union of these structures and means through cooperative co-respondence with the leg frames, as disclosed by the applicant's invention.

In most chairs of this general type, the seat and backrest are composed of a single piece of flexible planar material, such as canvas or other fabric, being fixed to and draped between the upper ends of the chairs' intersecting main frames. Though Miles U.S. Pat. No. 1,875,478 and Bascom U.S. Pat. No. 2,203,610 disclose this common sling-type seat/backrest component—not distinguishing separate seat and backrest structures—they disclose the attachment of the lower forward end of the fabric sling to a transverse cross-bar joining forward extensions of the upper lateral pivot bars, thus forming a front seat edge, of a sort, as part of a generally U-shaped upper lateral pivot frame. Still, the sling-type seating surface is ill-suited both to the natural jointing and seated conformation of the human body and is ill-suited to the comfort and poise of the body in precisely controlling the configuration of the chairs' pivotally articulated structure in relation to varying distributions of weights and pressures on the seating surface. In the first instance, the sling seat/backrest conforms the posture of the user to the curving contour of draped fabric, and in the second instance, that draped surface can only imprecisely convey to the chairs' structure necessarily very general forces associated with alternations in the center of gravity of the user, rather than responding directly and precisely to subtle and specific changes in the distribution of fractional loads of varying weights and pressures, as such loads are apportioned and spontaneously reapportioned among discrete yet integrally interacting, co-responsive, and counterbalancing fractional-load-sharing components, as is uniquely achieved by the applicant's invention.

Moeller U.S. Pat. No. 2,295,122; Simpson U.S. Pat. No. 4,241,950; Gilbert U.S. Pat. No. 4,251,106; and Singer U.S. Pat. No. 4,597,604 teach that the seat and the backrest can be structurally distinguished to form functionally separate components of such constructions. Moeller U.S. Pat. No. 2,295,122 discloses the use of distinct but pivotally connected frames, the backrest frame also being distinguished from the intersecting leg frames and each seating surface being of a flexible matrix composition. Simpson U.S. Pat. No. 4,241,950 also discloses separate seat and backrest frames, each comprising flexible matrix material, such as canvas fabric, to provide load supporting surfaces. Gilbert U.S. Pat. No. 4,251,106 teaches the use of the seat surface material itself to provide upper lateral tension for supporting the chair's intersecting main frames in the erect, operative position, with a fabric backrest being stretched from the upper ends of the longer (backrest) main frame to the sides of the fabric seat. Singer U.S. Pat. No. 4,597,604 discloses the use of a seat cushion resting above the upper flexible tension components, with a separate backrest component pivotally suspended between the upper ends of the longer (backrest) main frame.

However, although Simpson U.S. Pat. No. 4,241,950 discloses separate seat and backrest frames, the Simpson construction could not embody and could not accommodate the special and novel features disclosed by the applicant's invention. That is, because in the Simpson construction the width of the rear leg frame is greater than that of the front leg frame, that construction can not be provided with a stiff, planar, load-apportioning, and counterbalancing seat structure extending rearward of the pivotal connections of the seat structure with the front leg frame, as is embodied in the applicant's invention. Nor could the Simpson construction accomodate a rigid, co-responsive, load-apportioning, counterbalancing footrest structure, because in folding a modified Simpson construction provided with such a component, the footrest structure would interfere with the front leg frame, unless the footrest structure were so inordinately long and the front leg frame so inordinately short as to cause the construction to be inoperative and unusable.

In addition, these latter disclosures, in which seat and backrest components are distinguished, do not adequately solve problems of precise, torsionally counterbalancing gross-load-apportionment and implicitly co-responsive fractional-load-adjustment and -reapportionment, because only one load-bearing component (the seat) is pivotally connected to a low-torsionally-interactive and marginal-load-supporting component (the backrest) in simple, direct, and largely non-counterbalancing relationship. Nor do these latter disclosures address the advantages of implicitly, co-responsively controlling the conformation of a pivotally integrated construction under dynamic fractional loads of varying weight and pressure elements and of changing torsion forces by spontaneous variation in the apportionment of such weight and pressure elements of those fractional loads and torsion forces, because in these representatives of the prior art, the load-bearing surfaces are composed of loose, flexible materials and therefore yield locally and imprecisely to generalized weight and pressure variations, thereby causing the seat and backrest components to respond in simple, non-torsional, marginally co-responsive and non-counterbalancing relationships only to broad changes in the distribution of the gross load, rather than responding subtly and precisely to specific changes in the distribution of dynamic fractional loads, of variable torsion forces, and of weight and pressure elements thereof.

The prior art does not provide several integrally related co-responsive, torsionally interacting, and implicitly counterbalancing fractional-load-sharing components, such as structurally distinct yet pivotally articulated load-distributing and -reapportioning seat and footrest structures, co-responsive front and rear leg frames, and cooperating load-transfer and motion-governing means. Therefore, the prior art does not provide means for implicitly distributing, apportioning, counterbalancing, and spontaneously adjusting, reapportioning, and controlling particular fractional loads nor for implicitly distributing and spontaneously reapportioning, conveying, controlling, and limiting interactive torsion forces among directly cooperating, counterbalancing fractional-load-sharing components, features, and governing means as inherent facilities and capacities of the unique array of constituent parts and of their uniquely co-responsive integration, as provided by the applicant's invention.

Further, the standing structural components of the applicant's invention can be composed of standard linear materials. Because the upper load-bearing structure has width lesser than that of the front leg frame and because the upper load-bearing structure is thus enabled to extend rearward of its pivotal connections with the front leg frame, the upper front leg frame cross-bar, or backrest, of the presently preferred embodiment is enabled to occupy a position that affords a comfortable and comfortably variable upright—that is, sitting rather than lounging—orientation without the need to incorporate more complex, curved elements or more complex hinging of elements into the structure of the invention. The prior art does not afford this notable advantage.

Also, because the standing structural components of the applicant's invention can be composed of standard linear materials, the relative spacing of the pivotal connections of the various articulating components can be arranged so that, when not in use, the construction can be simply and easily folded absolutely flat, having all such pivotal connections and all such linear and planar components occupying a common plane. The prior art does not achieve this significant advantage, and in fact, most representatives of the prior art teach away from the achievement of this advantage.

In addition, taken together, the prior art constitutes a widely varied class of lounging furniture suited for use on lawns, patios, beaches, and for other casual, and generally rough, outdoor usage. But especially notable in view of the applicant's invention, the prior art is substantially restricted to these kinds of uses and to the rustic, unrefined styles and rough qualities of fabrication consistent with them. Each example of the prior art is itself also substantially restricted in its range of functional and stylistic variations to rather rough, casual applications. By contrast however, the applicant's invention introduces the option of establishing a significant improvement in the stylistic variety, aesthetic quality, and refinement of construction in such articles of furniture, by virtue of this intention's incorporation of functionally distinct, yet co-responsive and torsionally counterbalancing fraction-load-sharing structures, these structures being potentially composed of finely-crafted, high-quality materials and augmented by the inclusion of finely upholstered supplementary components.

In addition, due to the structural limitations of folding chairs using fabric sling-type seating surfaces, many representatives of the prior art are inherently cumbersome, unstable, and uncertain in the execution and control of their "rocking motion" when in use and of their folding actions when not in use. Many also are difficult to unfold in preparation for use. None folds completely flat—that is, with all pivot points and structural components lying substantially in a single plane—when not in use, and so are difficult to store and to transport efficiently. The applicant's invention does not share these deficiencies and difficulties but rather discloses practical and effective solutions for them.

Where shaping and fabrication processes have been needed to create curved structural components or complex hinging arrangements in order to alleviate the problems and deficiencies in the prior art referenced above, the costs of production and distribution are increased, and the resulting construction is made more complicated. New, more sophisticated disadvantages are exchanged for older, simpler ones, and still the unique and significant benefits of the applicant's invention are not achieved. By contrast, the applicant's invention achieves all of the advantages referenced above while avoiding all of the deficiencies, complications, disadvantages, and inelegance characteristic of the prior art.

SUMMARY OF THE INVENTION

The principal benefit common to most representatives of the prior art is the "rocking motion" afforded by the basic pivotally articulated construction disclosed by Paice U.S. Pat. No. 564,312 and refined by subsequent inventors. Though similar forward-and-backward flexing action is an aspect of the unique benefits embodied in the applicant's invention, such "rocking motion" is not the principal attribute nor the central advantage of this invention. Instead, the object of the applicant's invention is to provide an integrated assemblage of pivotally interacting, co-responsive, and torsionally counterbalancing, fractional-load-sharing components that are integrated in a way that implicitly distributes dynamic gross loads and spontaneously balances, apportions, and implicitly redistributes variable portions of such gross loads among fractional-load-sharing structures and counterbalancing weight and pressure portions thereof. In this way, a highly versatile, uncomplicated, stable, and foldable generalized load-support devise is created. Thereby, the applicant's invention provides means for precisely causing and controlling alterations in the distribution of such variable elements of the dynamic gross load among discrete interactive, co-responding, and counterbalancing fractional-load-sharing components. The "flexing" torsional action resulting from the integrally pivotal articulation of the applicant's invention causes the entire construction actually to change its shape and to change its load-bearing proportions in direct, implicit, and immediate response to differential distribution and reapportionment of variable weights and pressures and of variable dynamic torsion forces applied to the fractional-load-sharing components and portions thereof, so that the construction as a whole adapts itself to the shape, disposition, and action of its complex, dynamic load, assuming an instantly and inherently adaptable conformation best suited to the form and disposition of the load it supports and to the purposes involved in supporting such a load.

Among the general objects of the applicant's invention are the following: 1) to provide a generalized load-support device that is widely versatile both in its potential functions and in its possible stylistic variations; 2) to provide such a device whose flexing action facilitates precisely, spontaneously, and implicitly controllable alteration of the structure's conformation while in operation in order to accomodate the varied disposition of highly complex, dynamic loads by virtue of the pivotally integrated articulation of the invention's co-responsive, torsionally counterbalancing, fraction-load-sharing and load-conveying constituent parts; 3) to provide such a device that is stable and secure in operation and that embodies simple, direct, and inherent constraints on extreme torsion forces and on unwanted flexing actions, also by virtue of the integral, co-responsive union of its constituent parts; 4) to provide such a device that, when used in furniture, affords firm, flexible, secure, functional, and well-balanced support for the user and for other objects and articles used with the invention, thereby being uniquely functional and comfortable for a wide variety of users and uses; 5) to provide such a device that is aesthetically appealing, stylish, durable, and inexpensive to produce and to distribute while being highly refined in quality and finish; 6) to provide such a device that may be fabricated from standard linear materials, such as dimensional wood, metal, or synthetic stocks; and 7) to provide such a device that will easily fold to assume a completely flat disposition through a simple, direct, and positive pivotal action—that is, by using a single folding motion—thereby facilitating easy and efficient stacking, storage, and transport in bulk numbers.

By virtue of the several specific, novel, and superior features, components, arrangements, and relationships disclosed and embodied by the applicant's invention, this invention creates, addresses, and uniquely embodies several novel qualities and unique advantages in the creation of load support devices. Those advantages are incorporated in an assemblage of integrally interactive, pivotally co-responsive, torsionally counterbalancing, and fractional-load-sharing structures and of implicitly co-responsive, functionally cooperating biasing, motion-governing, and torsion-limiting means. The special qualities and unique advantages embodied in the applicant's invention are demonstrably unrecognized and unappreciated in the prior art. Nor were the special qualities and unique advantages embodied in the applicant's invention expected or anticipated by the prior art. The novel qualities and special benefits of this invention cumulatively constitute very substantial advantages over the prior art, and they far exceed any advantages or advancements that could be gleaned from any combination or modification of the several and particular articles and features contained in the prior art. In this light, the applicant respectfully submits that such combinations and modifications could not be properly used in opposition to this patent application. Moreover, even if such combinations and modifications were found to be proper, the applicant respectfully submits that the applicant's claims would still not be met. That is, the superior features and novel arrangement of features embodied in the applicant's invention are demonstrably lacking in the prior art, and further the particular combinations of novel features and arrangements, and the particular variant forms of such features and arrangements, are demonstrably not disclosed, embodied, suggested, or anticipated in the prior art. Indeed in some cases, combinations and modifications that could be gleaned from the prior art and could be proposed as rendering the applicant's invention obvious, are found to be impossible or inoperative combinations and modifications in view of the novel features and specific arrangements of such features embodied in the applicant's invention. Further, it is respectfully submitted that even if certain features of the prior art or even any number of such features could be combined, the resultant combination or modification of the prior art would not disclose or anticipate the unique and superior attributes of the applicant's invention. That is, the applicant respectfully submits that there is no teaching, showing, disclosure, reference, or suggestion whatever in the prior art of the novel features, arrangements, and relationships of novel components, features, and means disclosed by the applicant's invention. Furthermore, although the relevant prior art is expansive in time and is very crowded, still much of the prior art is very old, is vague and notably indefinite in its disclosures, may be regarded as weak, and should be construed narrowly. Conversely, many of the more recent representatives actually teach away from the novel features, beneficial relationships, unique arrangements of such features and relationships, and special advantages and advancements disclosed by the applicant's invention. Indeed, the applicant's invention achieves significant structural and operational advantages through ingenious simplifications relative to the prior art.

For example, the applicant's invention comprises a planar upper load-bearing structure having width greater than that of the rear leg frame and lesser than the front leg frame, thereby enabling the upper load-bearing structure to extend rearward of its pivotal connection with the front leg frame. In this way, because the upper load-bearing structure is integrated in co-responsive, torsionally counterbalancing relationship with all other structural components of the applicant's invention, the variable fractional load borne by the upper load-bearing structure (being a variable portion of the dynamic gross load borne by the integrated invention) is apportioned further into forward and rearward elements thereof and these fractional load elements are mutually counterbalanced on either side of pivotal connection of the upper load-bearing structure with the front leg frame, thereby to respond precisely and implicitly in interactive, fractional-load-sharing relationships even to minor changes in weights and pressures applied through the integrally articulated construction of the invention. In addition, the applicant's invention creates and embodies a functionally distinguished yet structurally and dynamically integrated lower load-bearing structure that operationally supplements and complements the (comparably distinguished) upper load-bearing structure in co-responsive, torsionally counterbalancing distribution and spontaneous reapportionment of variable fractional elements of the dynamic gross load borne by the invention, being structures, features, relationships, facilities, and options that are demonstrably not envisioned, disclosed, embodied, or anticipated by the prior art. Furthermore, the creation both of upper load-bearing and lower load-bearing fractional-load-sharing structures and of their co-responsive, counterbalancing union through their pivotal articulation with the front and rear leg frames forms a uniquely versatile, adaptable, and functional construction that is thoroughly novel, is substantially superior to the prior art, and is uniquely advancing in the art.

The applicant respectfully submits that each and all of these considerations can be viewed justly as ample evidence of the failure of the prior art to recognize, disclose, embody, anticipate, or suggest the novel features and beneficial arrangement of such features embodied in the applicant's invention, or to recognize or anticipate the unique qualities and special benefits of such features and arrangements.

Further, in light of each and all of the matters discussed above, the failure of all previous practitioners in the art to achieve any of the novel features, beneficial arrangements, unique qualities, or special advantages embodied in the applicant's invention serves to verify the apparent novelty and unobviousness of these features, arrangements, qualities, and advantages, as claimed by the applicant.

These and other qualities, advantages, and novelties of the applicant's invention will be made apparent through perusal of the following description and claims, when considered in view of the accompanying drawings.

DESCRIPTION OF THE PRESENTLY PREFERRED EMBODIMENT

Structure

Figure 1:
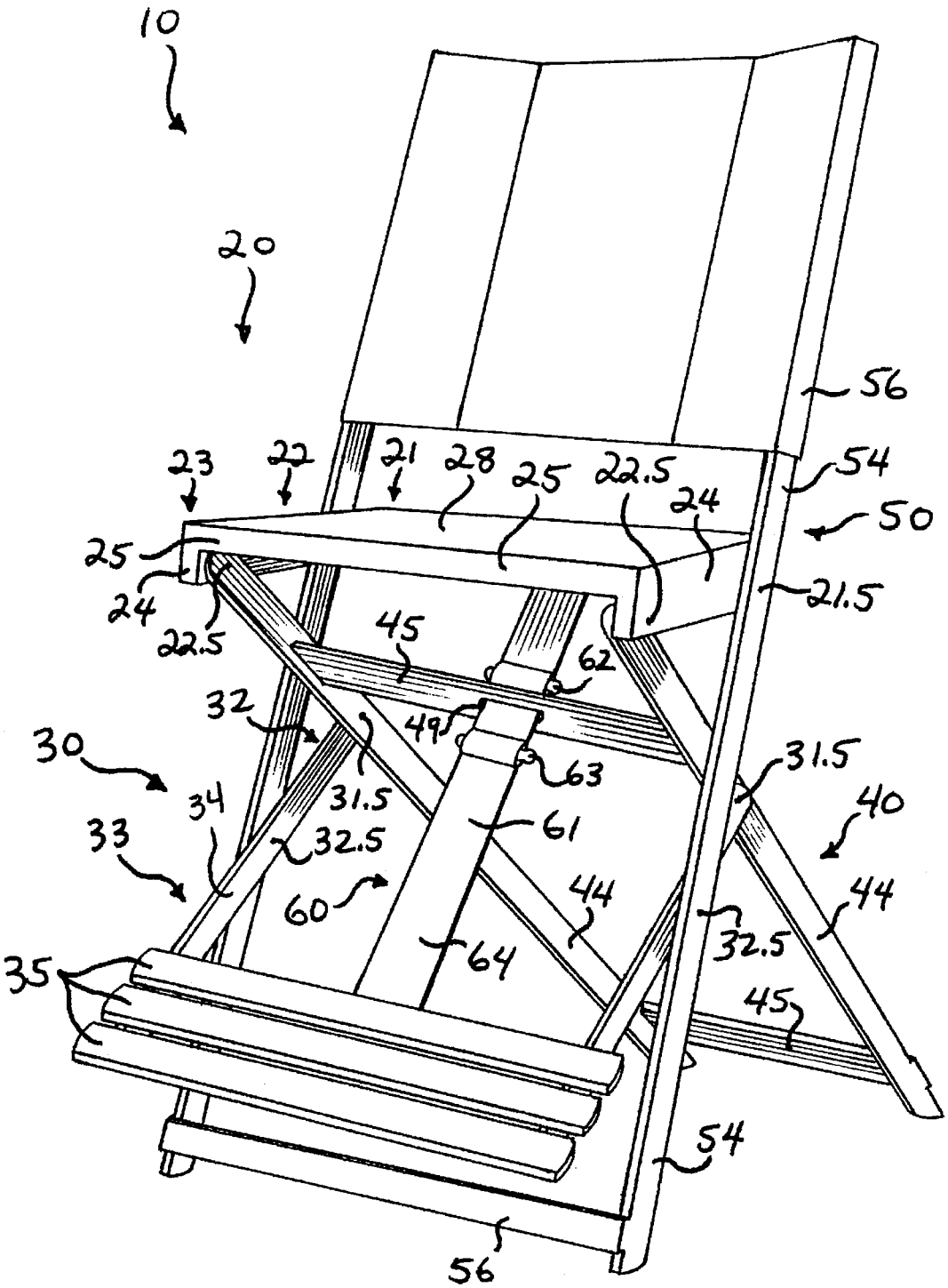
FIG. 1 is a perspective drawing of the free-standing chair embodiment of the invention, having a single-footrest structure, shown here in an intermediate operative position.
Figure 12:
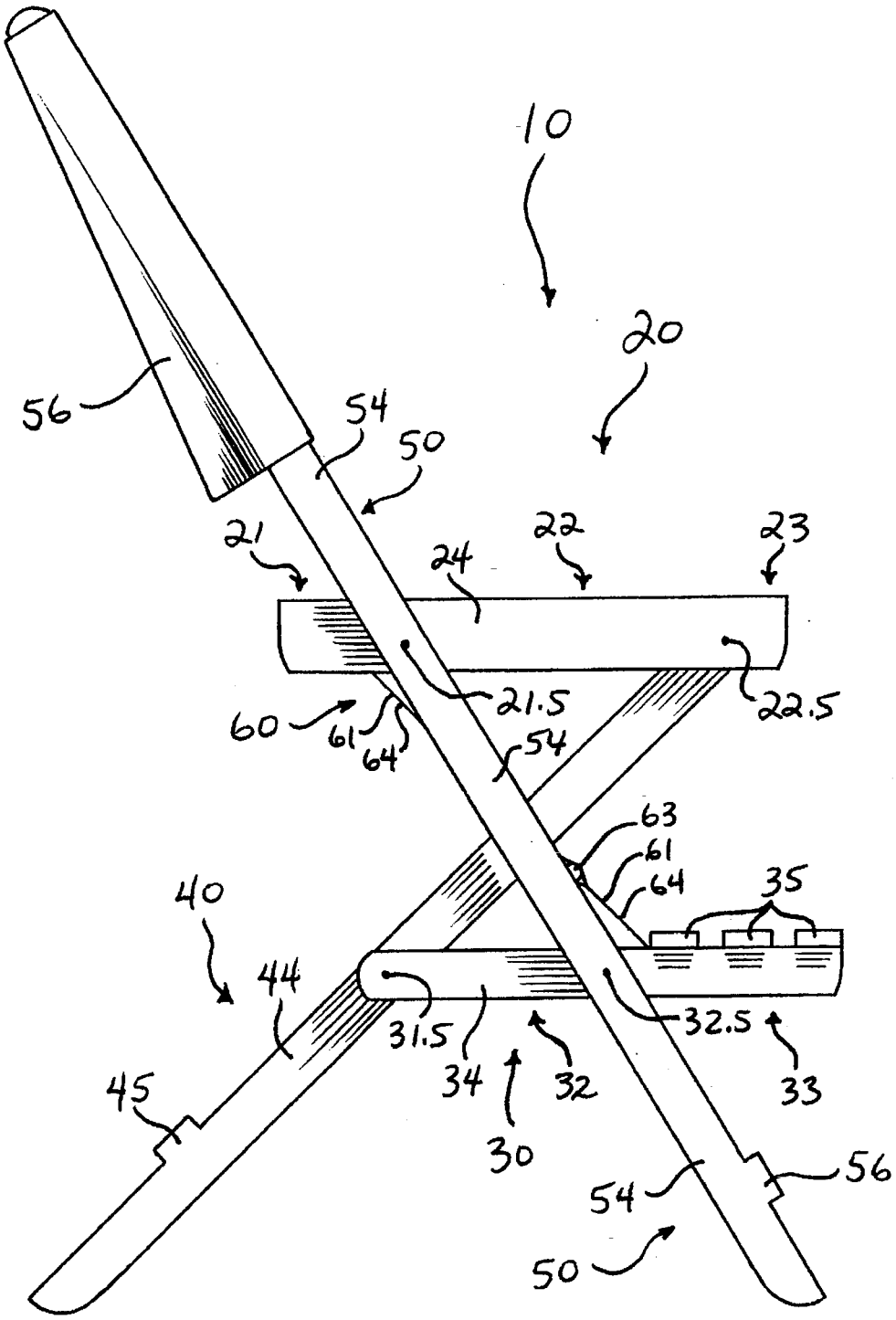
FIG. 12 is a side elevation drawing of the free-standing chair embodiment of the invention, having a single-footrest structure, shown here in an intermediate operative position.
Figure 13:
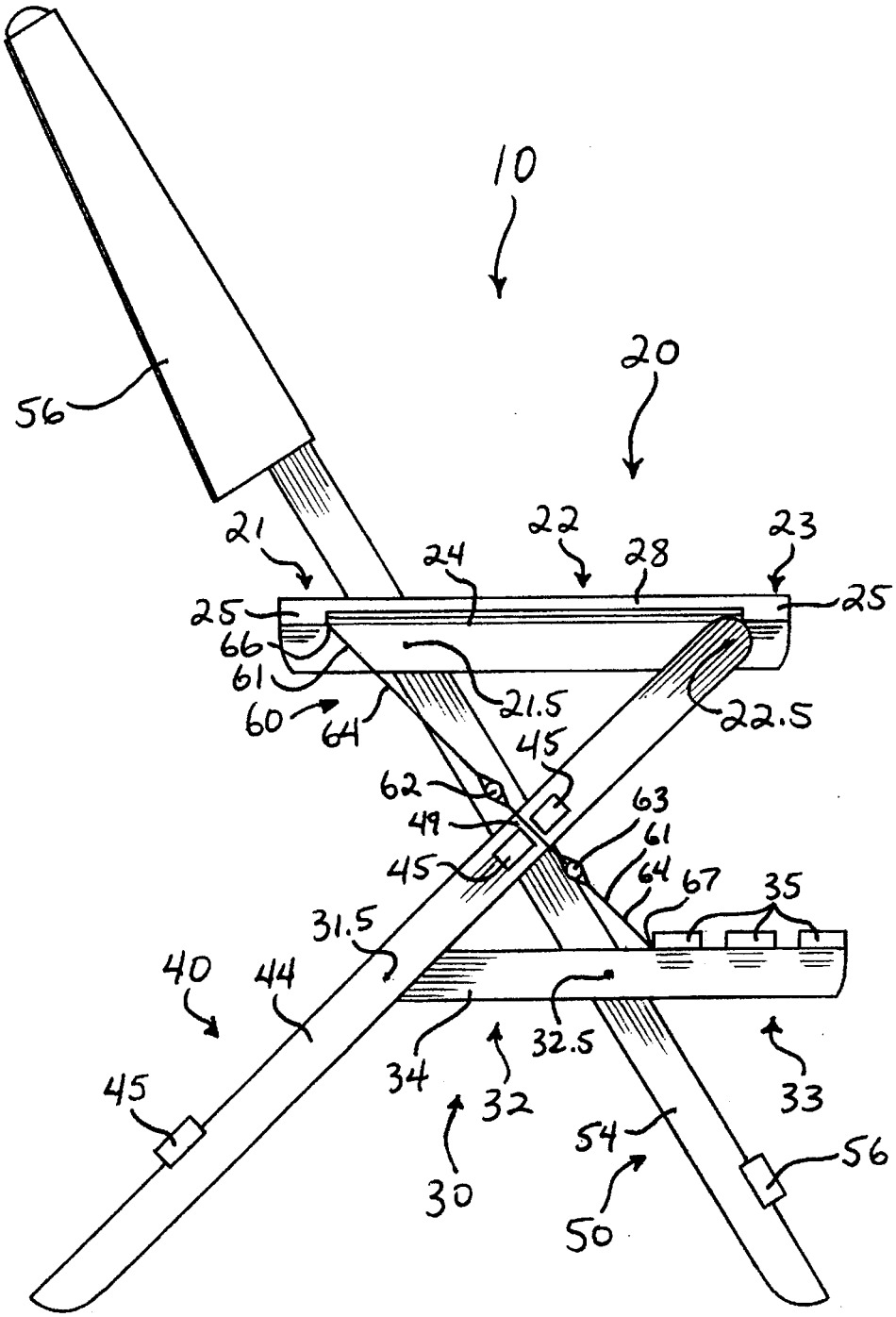
FIG. 13 is a cross-sectional side elevation drawing of the free-standing chair embodiment of the invention, having a single-footrest structure, shown here in an intermediate operative position.

FIGS. 1, 12, and 13

The pivotally articulated foldable free-standing chair 10, comprises an upper load-bearing seat structure 20, a lower load-bearing footrest structure 30, a rear leg frame 40, a front leg frame 50, whose upper cross-member 56 forms a backrest element 56 being disposed above and generally rearward of the upper load-bearing seat structure 20 when the chair 10 is in use, and motion-governing, or tethering, means 60 adapted to govern the relative pivotal motions of and the angular, spatial, and load-bearing relationships between the structures 20, 30 and frames 40, 50 listed above when the chair 10 is in use. The chair embodiment 10 of the invention is shown here in an intermediate operative position in which the upper load-bearing seat structure 20 is disposed in a generally horizontal disposition. However, the pivotal articulation of the chair 10 and the co-responsive load-distributing, balancing, load-reapportioning, and counterbalancing relationships between the upper and lower load-bearing structures 20, 30 and between the load-sharing portions 21, 22, 23, 32, 33 thereof allow the upper load-bearing seat structure 20 and the lower load-bearing footrest structure 30 to move through a variety of reciprocal forwardly and rearwardly inclining positions, through a variety of angular, spatial, and pivotal relationships therebetween, and through a variety of angular, spatial, and pivotal interrelationships with the backrest element 56 of the front leg frame 50, as will be described in greater detail subsequently.

The front leg frame 50 comprises spaced side elements 54 and at least one cross-member 56. This frame 50 extends upwardly and rearwardly from its lower end. One or more cross-members 56 extend between and join the side elements 54 in the upper portion of the front leg frame 50 to form a backrest element 56 above and generally rearward of the upper load-bearing seat structure 20 when the chair 10 is in use.

The rear leg frame 40 comprises spaced side elements 44 and at least one cross-member 45. The rear leg frame side elements 44 are spaced more closely together than are the front leg frame side elements 54, thereby causing the rear leg frame 60 to be narrower than the front leg frame 50. The lower end of the rear leg frame 40 is disposed rearward of the lower end of the front leg frame 50 and extends upwardly and forwardly from its lower end to intersect the plane defined by the front leg frame 50 below the upper load-bearing seat structure 20, the rear leg frame side elements 44 being disposed between the front leg frame side elements 54.

One or more rear leg frame cross-members 45 extend between and join the rear leg frame side elements 44 to form an integral frame 40. At least one such cross-members 45 is adapted to cooperate with the tethering member 61 via the tethering stops 62, 63.

The upper load-bearing seat structure 20 comprises spaced side elements 24, at least one cross-member 25, and one or more upper load-bearing seat surface elements 28. The upper load-bearing seat structure side elements 24 are spaced more closely together than are the front leg frame side elements 54 and are spaced farther apart than are the rear leg frame side elements 44. One or more upper load-bearing seat structure cross-members 25 extend between and join the upper load-bearing seat structure side elements 24, and the upper load-bearing seat structure surface elements 28 unite with the upper load-bearing seat structure side elements 24 and cross-members 25 to form an integral structure 20. The upper load-bearing seat structure surface elements 28 are proportioned to have width and length generally equal to or lesser than the width and length of the object formed by the union of the upper load-bearing seat structure side elements 24 and cross-members 25. The upper load-bearing seat structure 20 is disposed in generally horizontal orientation when this chair embodiment 10 of the invention is in use. This structure 20 is joined by aligned pivotal connecting means to the rear leg frame 40 above the intersection of the front and rear leg frames 50, 40 at a first pair of pivot points 22.5 located rearward of the forward of the upper load-bearing seat structure 20. This structure 20 is joined by aligned pivotal connecting means to the front leg frame 50 above the intersection of the front and rear leg frames 50, 40 at a second pair of pivot points 21.5 rearward of the first pair of pivot points 22.5 described above. The space between the upper load-bearing seat structure side elements 24 is proportioned such that the outer lateral surfaces of these side elements 24 are generally adjacent the inner lateral surfaces of the front leg frame side elements 54 at the second pair of pivot points 21.5 and such that the inner later surfaces of these side elements 24 are generally adjacent the outer lateral surfaces of the rear leg frame side elements 44 at the first pair of pivot points 22.5.

The first and second pairs of pivot points 21.5, 22.5 divide the upper load-bearing seat structure 20 into three load-sharing portions 21, 22, 23 thereof, these being the rear upper load-sharing portion 21 located rearward of the second pair of pivot points 21.5, the front pivot points 22.5, and the intermediate load-sharing portion 22 located between the first and second pairs of pivot points 21.5, 22.5.

Relative placement of the first and second pairs of pivot points 21.5, 22.5 determines the load-distributing, balancing, load-reapportioning, and counterbalancing relationships between the front, intermediate, and rear load-sharing portions 23, 22, 21 of the upper load-bearing seat structure 20, and also determines the spatial, angular, pivotal, load-distributing, balancing, load-reapportioning, and counterbalancing relationships between the load-sharing portions 21, 22, 23 of this structure 20 and the load-sharing portions 32, 33 of the lower load-bearing footrest structure 30 and between the upper and lower load-bearing footrest structure 30 and the front and rear leg frames 40, 50. Placement of the second pair of pivot points 21.5 determines the spatial, angular, pivotal, and load-sharing relationships between the upper load-bearing seat structure 20 and the backrest element 56 of the front leg frame 50.

The lower load-bearing footrest structure 30 comprises spaced side elements 34 and at least one cross-member 35. The lower load-bearing footrest structure side elements 34 are spaced more closely together than are the front leg frame side elements 54 and are spaced farther apart than are the rear leg frame side elements 44. The lower load-bearing footrest structure 30 is disposed in generally horizontal orientation when this chair embodiment 10 of the invention is in use. This structure 30 is joined by aligned pivotal connecting means to the front leg frame 50 below the intersection of the front and rear leg frames 50, 40 at a third pair of pivot points 32.5 located rearward of the forward end of the lower load-bearing footrest structure 30. This structure 30 is joined by aligned pivotal connecting means to the rear leg frame 40 below the intersection of the front and rear leg frames 50, 40 at a fourth pair of pivot points 31.5 located rearward of the third pair of pivot points 32.5 described above. The space between the lower load-bearing footrest structure side elements 34 is proportioned such that the inner lateral surfaces of these side elements 34 are generally adjacent the outer surfaces of the rear leg frame side elements 44 at the fourth pair of pivot points 31.5 and such that the outer lateral surfaces of these side elements 34 are generally adjacent the inner lateral surfaces of the front leg frame side elements 54 at the third pair of pivot points 32.5.

The third and fourth pairs of pivot points 31.5, 32.5 divide the lower load-bearing footrest structure 30 into three load-sharing portions 31, 32, 33 thereof, these being the front lower load-sharing portion 33 located forward of the third pair of pivot points 32.5, the intermediate lower load-sharing portion 32 located between the third and fourth pairs of pivot points 31.5, 32.5, and the rear lower load-sharing portion 31 located rearward of the fourth pair of pivot points 31.5.

Relative placement of these third and fourth pairs of pivot points 31.5, 32.5 determines the load-distributing, balancing, load-reapportioning, and counterbalancing relationships between the front, intermediate, and rear load-sharing portions 31, 32, 33 of the lower load-bearing footrest structure 30, and also determines the apatial, angular, pivotal, load-distributing, balancing, load-reapportioning, and counterbalancing relationships between the load-sharing portions 31, 32, 33 of this structure 30 and the load-sharing portions 21, 22, 23 of the upper load-bearing seat structure 20 and between the upper and lower load-bearing structures 20, 30 and the front and rear leg frames 40, 50.

Relative placement of the four pairs of pivot points 21.5, 22.5, 31.5, 32.5 described above, the dimensions of the front, intermediate, and rear load-sharing portions 21, 22, 23 of the upper load-bearing seat structure 20, the dimensions of the front, intermediate, and rear load-sharing portions 31, 32, 33 of the lower load-bearing footrest structure 30, and the relationships between these dimensions and the relative placement of the four pairs of pivot points 21.5, 22.5, 31.5, 32.5 are proportioned such that the structures 20, 30, the frames 40, 50, and the four pair of pivot points 21.5, 22.5, 31.5, 32.5 of the chair 10 lie together substantially in a common plane when the chair 10 is folded out of use.

The motion-governing, or tethering, means 60 comprise a tethering member 61, a detachable upper tethering stop 62, and a detachable lower tethering stop 63. The tethering member 61 extends between and joins the upper load-bearing seat structure 20, at connection point 66, with the lower load-bearing footrest structure 30, at connection point 67. The tethering member 61 is adapted to cooperate with tethering stops 62, 63 when the chair 10 is in use. Connection points 66, 67 may be located so as to minimize variation in the distance between these connection points 66, 67, measured via the rear leg frame cross-member 45, as the constituent structures 20, 30 and frames 40, 50 move when the chair 10 is in use or is folded out of use. Connection points 66, 67 may be located otherwise, as well, so as to regulate the effects of the tethering member 61 and of the upper and lower tethering stops 62, 63, cooperating with the rear leg frame cross-member 45, on the motion of the chair 10 as the constituent structures 20, 30 and frames 40, 50 move when the chair 10 is in use or is folded out of use. The tethering member 61 cooperates with the rear leg frame cross-member 45 intermediate the two connection points 66, 67 just referenced. At appropriate degrees of forward and rearward variation in the conformation of the chair 10, the tethering member 61 cooperates with the rear leg frame cross-member 45 via the upper tethering stop 62 to limit rearward variation and cooperates with the reat leg frame cross-member 45 via the lower tethering stop 63 to limit forward variation when the chair 10 is in use. The tethering member 61 may also comprise elastic means 64 adapted to accommodate variations in the distance between connection points 66 and 67, measured via the rear leg frame cross-member 45, as the constituent structures 20, 30 and frames 40, 50 move when the chair 10 is in use or is folded out of use and adapted to afford elastic effects providing means by which the chair 10 can return automatically to an intermediate operative position, or to another desired position, in the absences of weight and pressure forces acting to deflect the conformation of the chair 10 away from such intermediate or other desired position as the constituent structures 20, 30 and frames 40, 50 move when the chair 10 is in use or is folded out of use.

DESCRIPTION OF VARIANT EMBODIMENTS

Structure

Figure 2:
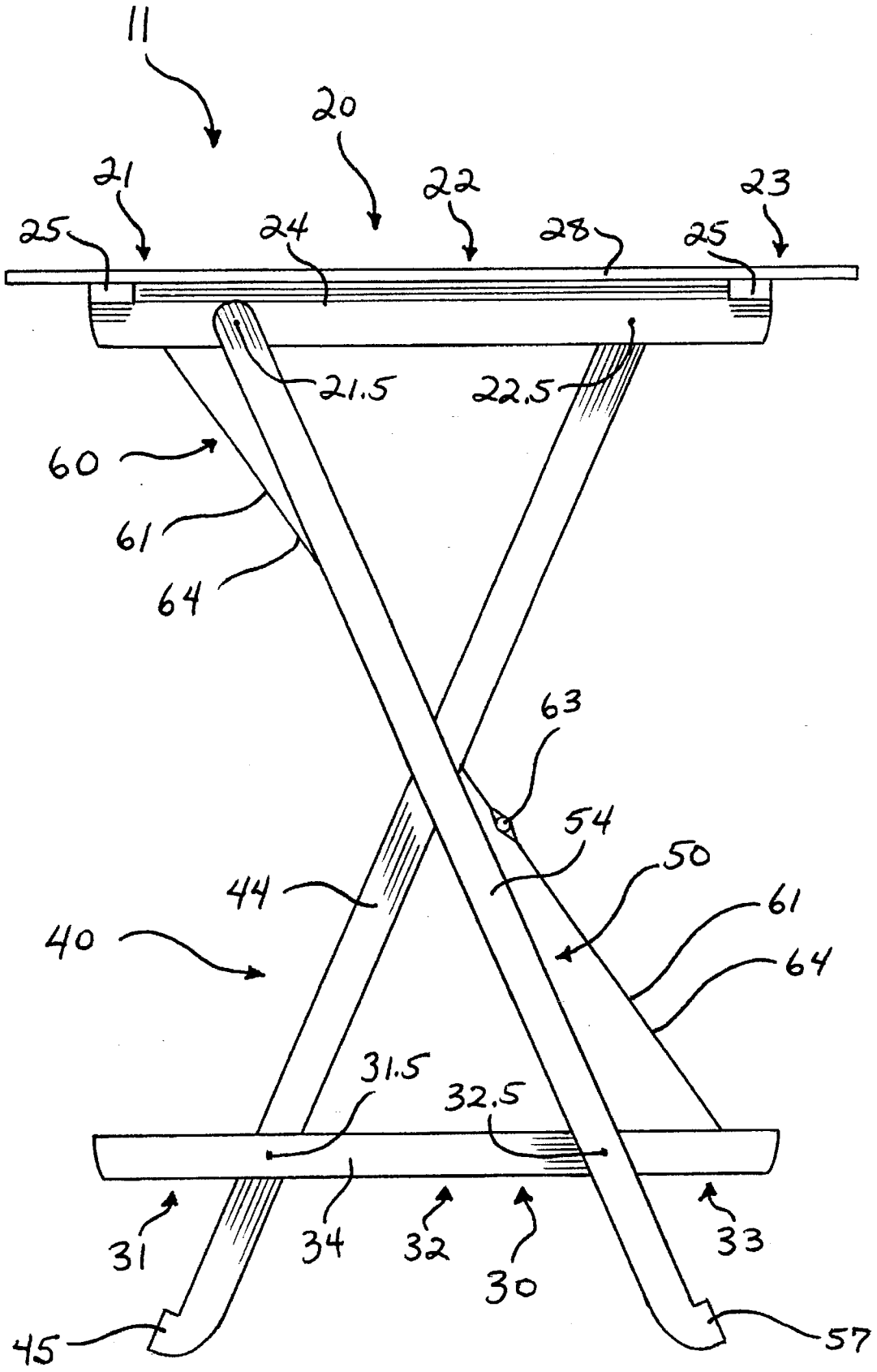
FIG. 2 is a side elevation drawing of the table embodiment of the invention, having generally horizontal table-top and dual-footrest structures, shown here in an intermediate operative position.
Figure 3:
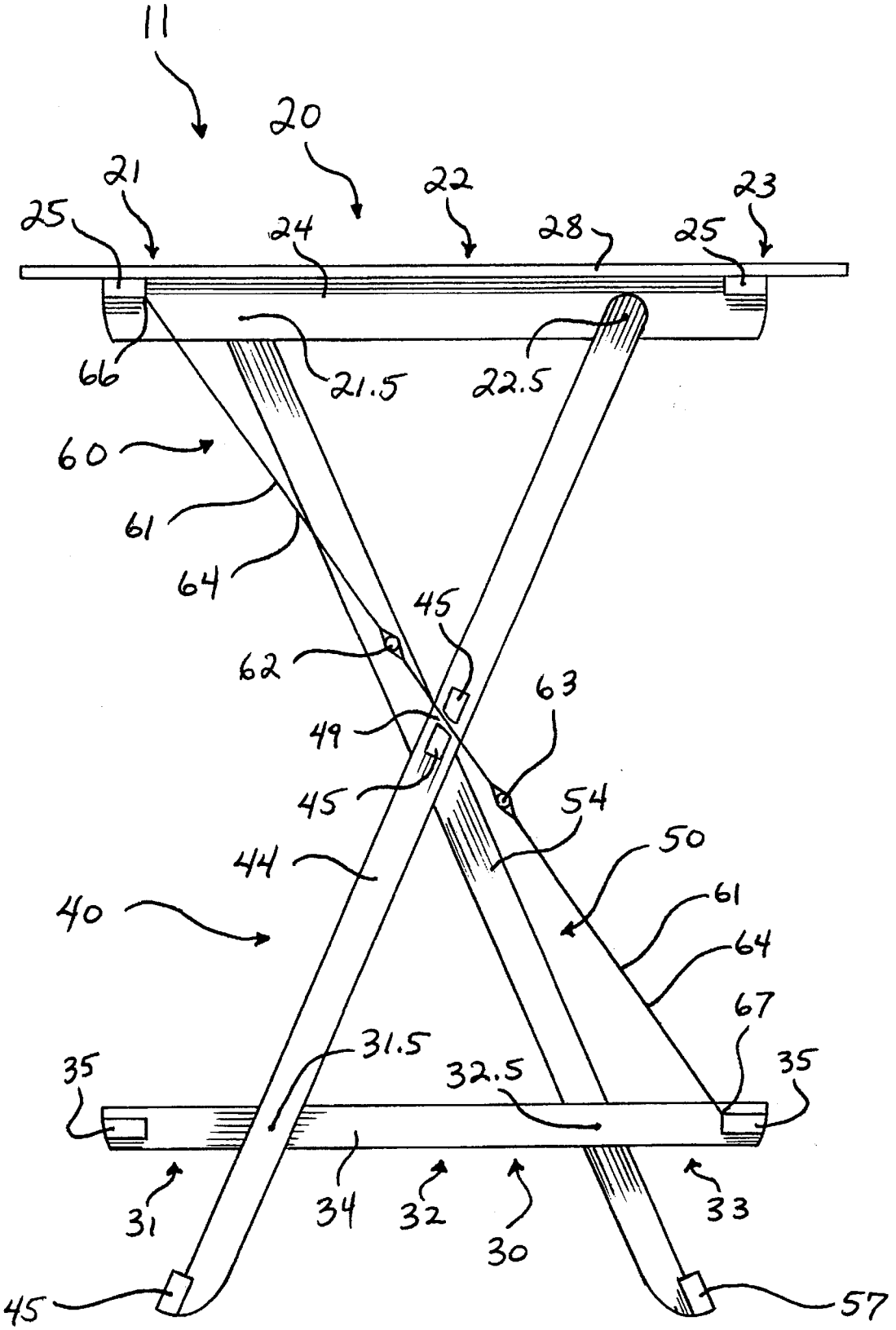
FIG. 3 is a cross-sectional side elevation drawing of the table embodiment of the invention, having generally horizontal table-top and a dual-footrest structure, shown here in an intermediate operative position.

FIGS. 2 and 3

The pivotally articulated foldable table 11 comprises an upper load-bearing table-top structure 20, a lower load-bearing footrest structure 30, a rear leg frame 40, a front leg frame 50, and motion-governing, or tethering, means 60 adapted to govern the relative pivotal motions of and the angular, spatial, and load-bearing relationships between the structures 20, 30 and frames 40, 50 listed above when the table 11 is in use. The table embodiment 11 of the invention is shown here in an intermediate operative position in which the upper load-bearing table-top structure 20 is disposed in a generally horizontal disposition. However, the pivotal articulation of the table 11 and the co-responsive load-distributing, balancing, load-reapportioning, and counterbalancing relationships between the upper and lower load-bearing structures 20, 30 and between the load-sharing portions 21, 22, 23, 31, 32, 33 thereof allow the upper load-bearing table-top structure 20 and the lower load-bearing footrest structure 30 to move through a variety of reciprocal forwardly and rearwardly inclining positions and through a variety of angular, spatial, and pivotal relationships therebetween.

The front leg frame 50 comprises spaced side elements 54 and at least one cross-member 57. This frame 50 extends upwardly and rearwardly from its lower end.

The rear leg frame 40 comprises spaced side elements 44 and at least one cross-member 45. The rear leg frame side elements 44 are spaced more closely together than are the front leg frame side elements 54, thereby causing the rear leg frame 40 to be narrower than the front leg frame 50. The lower end of the rear leg frame 40 is disposed rearward of the lower end of the front leg frame 50 and extends upwardly and forwardly from its lower end to intersect the plane defined by the front leg frame 50 below the upper load-bearing table-top structure 20, the rear leg frame side elements 44 being disposed between the front leg frame side elements 54. One or more rear leg frame cross-members 45 extend between and join the rear leg frame side elements 44 to form an integral frame 40. At least one such cross-member 45 is adapted to cooperate with the tethering member 61 via the tethering stops 62, 63.

The upper load-bearing table-top structure 20 comprises spaced side elements 24, at least one cross-member 25, and one or more upper load-bearing table-top surface elements 28. The upper load-bearing table-top structure side elements 24 are spaced more closely together than are the front leg frame side elements 54 and are spaced farther apart than are the rear leg frame side elements 44. One or more upper load-bearing table-top structure cross-members 25 extend between and join the upper load-bearing table-top structure side elements 24, and the upper load-bearing table-top structure surface elements 28 unite with the upper load-bearing table-top structure side elements 24 and cross-members 25 to form an integral structure 20. The upper load-bearing table-top structure surface elements 28 are proportioned to have width and length generally equal to or greater than the width and length of the object formed by the union of the upper load-bearing table-top structure side elements 24 and cross-members 25. The upper load-bearing table-top structure 20 is disposed in generally horizontal orientation when this table embodiment 11 of the invention is in use. This structure 20 is joined by aligned pivotal connecting means to the rear leg frame 40 above the intersection of the front and rear leg frames 50, 40 at a first pair of pivot points 22.5 located rearward of the forward end of the upper load-bearing table-top structure 20. This structure 20 is joined by aligned pivotal connecting means to the front leg frame 50 above the intersection of front and rear leg frames 50, 40 at a second pair of pivot points 21.5 rearward of the first pair of pivot points 22.5 described above. The space between the upper load-bearing table-top structure side elements 24 is proportioned such that the outer lateral surfaces of these side elements 24 are generally adjacent the inner lateral surfaces of the front leg frame side elements 54 at the second pair of pivot points 21.5 and such that the inner lateral surfaces of these side elements 24 are generally adjacent the outer lateral surfaces of the rear leg frame side elements 44 at the first pair of pivot points 22.5.

The first and second pairs of pivot points 21.5, 22.5 divide the upper load-bearing table-top structure 20 into three load-sharing portions 21, 22, 23 thereof, these being the rear upper load-sharing portion 21 located rearward of the second pair of pivot points 21.5, the front upper load-sharing portion 23 located forward of the first pair of pivot points 22.5, and the intermediate load-sharing portion 22 located between the first and second pairs of pivot points 21.5, 22.5.

Relative placement of the first and second pairs of pivot points 21.5, 22.5 determines the load-distributing, balancing, load-reapportioning, and counterbalancing relationships between the front, intermediate, and rear load-sharing portions 23, 22, 21 of the upper load-bearing table-top structure 20, and also determines the spatial, angular, pivotal, load-distributing, balancing, load-reapprotioning, and counterbalancing relationships between the load-sharing portions 21, 22, 23 of this structure 20 and the load-sharing portions 31, 32, 33 of the lower load-bearing footrest structure 30 and between the upper and lower load-bearing structures 20, 30 and the front and rear leg frames 40, 50.

The lower load-bearing footrest structure 30 comprises spaced side elements 34 and at least one cross-member 35. The lower load-bearing footrest structure side elements 34 are spaced more closely together than are the front leg frame side elements 54 and are spaced farther apart than are the rear leg frame side elements 44. The lower load-bearing footrest structure 30 is disposed in generally horizontal orientation when this table embodiment 11 of the invention is in use. This structure 30 is joined by aligned pivotal connecting means to the front leg frame 50 below the intersection of the front and rear leg frames 50, 40 at a third pair of pivot points 32.5 located rearward of the forward end of the lower load-bearing footrest structure 30. This structure 30 is joined by aligned pivotal connecting means to the rear leg frame 40 below the intersection of the front and rear leg frames 50, 40 at a fourth pair of pivot points 31.5 located rearward of the third pair of pivot points 32.5 described above. The space between the lower load-bearing footrest structure side elements 34 is proportioned such that the inner lateral surfaces of these side elements 34 are generally adjacent the outer lateral surfaces of the rear leg frame side elements 44 at the fourth pair of pivot points 31.5 and such that the outer lateral surfaces of these side elements 34 are generally adjacent the inner lateral surfaces of the front leg frame side elements 54 at the third pair of pivot points 32.5.

The third and fourth pairs of pivot points 31.5, 32.5 divide the lower load-bearing footrest structure 30 into three load-sharing portions 33, 32, 31 thereof, these being the front lower load-sharing portion 33 located forward of the third pair of pivot points 32.5, the intermediate lower load-sharing portion 32 located between the third and fourth pairs of pivot points 31.5, 32.5, and the rear lower load-sharing portion 31 located rearward of the fourth pair of pivot points 31.5.

Relative placement of these third and fourth pairs of pivot points 31.5, 32.5 determines the load-distributing, balancing, load-reapportioning, and counterbalancing relationships between the front, intermediate, and rear load-sharing poritons 31, 32, 33 of the lower load-bearing footrest structure 30, and also determines the spatial, angular, pivotal, load-distributing, balancing, load-reapportioning, and counterbalancing relationships between the load-sharing portions 31, 32, 33 of this structure 30 and the load-sharing portions 21, 22, 23 of the upper load-bearing table-top structure 20 and between the upper and lower load-bearing structures 20, 30 and the front and rear leg frames 40, 50.

Relative placement of the four pairs of pivot points 21.5, 22.5, 31.5, 32.5 described above, the dimensions of the front, intermediate, and rear load-sharing portions 21, 22, 23 of the upper load-bearing table-top structure 20, the dimensions of the front, intermediate, and rear load-sharing portions 31, 32, 33 of the lower load-bearing footrest structure 30, and the relationships between these dimensions and the relative placement of the four pairs of pivot points 21.5, 22.5, 31.5, 32.5 are proportioned such that the structures 20, 30, the frames 40, 50, and the four pairs of pivot points 21.5, 22.5, 31.5, 32.5 of the table 11 lie together substantially in a common plane when the table is folded out of use.

The motion-governing, or tethering, means 60 comprise a tethering member 61, a detachable upper tethering stop 62, and a detachable lower tethering stop 63. The tethering member 61 extends between and joins the upper load-bearing table-top structure 20, at connection point 66, with the lower load-bearing footrest structure 30, at connection point 67. The tethering member 61 is adapted to cooperate with tethering stops 62, 63 when the table 11 is in use. Connection points 66, 67 may be located so as to minimize variation in the distance between these connection points 66, 67, measured via the rear leg frame cross-member 45, as the constituent structures 20, 30 and frames 40, 50 move when the table 11 is in use or is folded out of use. Connection points 66, 67 may be located otherwise, as well, so as to regulate the effects of the tethering member 61 and of the upper and lower tethering stops 62, 63, cooperating with the rear leg frame cross-member 45, on the motion of the table 11 as the constituent structures 20, 30 and frames 40, 50 move when the table 11 is in use or is folded out of use. The tethering member 61 cooperates with the rear leg frame cross-member 45 intermediate the two connection points 66, 67 just referenced. At appropriate degrees of forward and rearward variation in the conformation of the table 11, the tethering member 61 cooperates with the rear leg frame cross-member 45 via the upper tethering stop 62 to limit rearward variation and cooperates with the rear leg frame cross member 45 via the lower tethering stop 63 to limit forward variation when the table 11 is in use. The tethering member 61 may also comprise elastic means 64 adapted to accommodate variations in the distance between connection points 66 and 67, measured via the rear leg frame cross-member 45, as the constituent structures 20, 30 and frames 40, 50 move when the table 11 is in use or is folded out of use and adapted to afford elastic effects providing means by which the table 11 can return automatically to an intermediate operative position, or to another desired position, in the absence of weight and pressure forces acting to deflect the conformation of the table 11 away from such intermediate or other desired position as the constituent structures 20, 30 and frames 40, 50 move when the table 11 is in use or is folded out of use.

Figure 4:
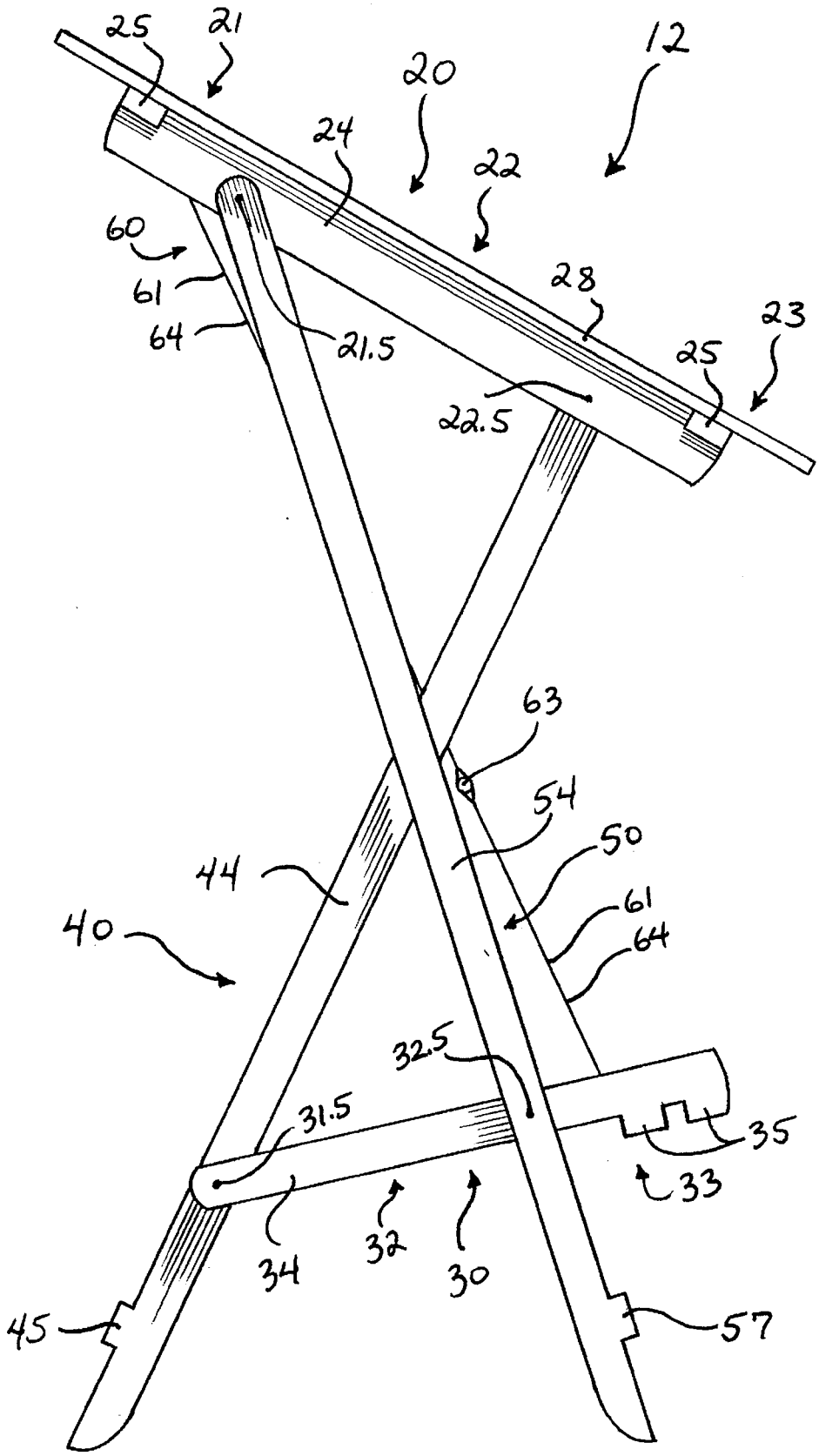
FIG. 4 is a side elevation drawing of the drafting-table embodiment of the invention, having substantially inclined table-top and a single-footrest structure, shown here in an intermediate operative position.
Figure 5:
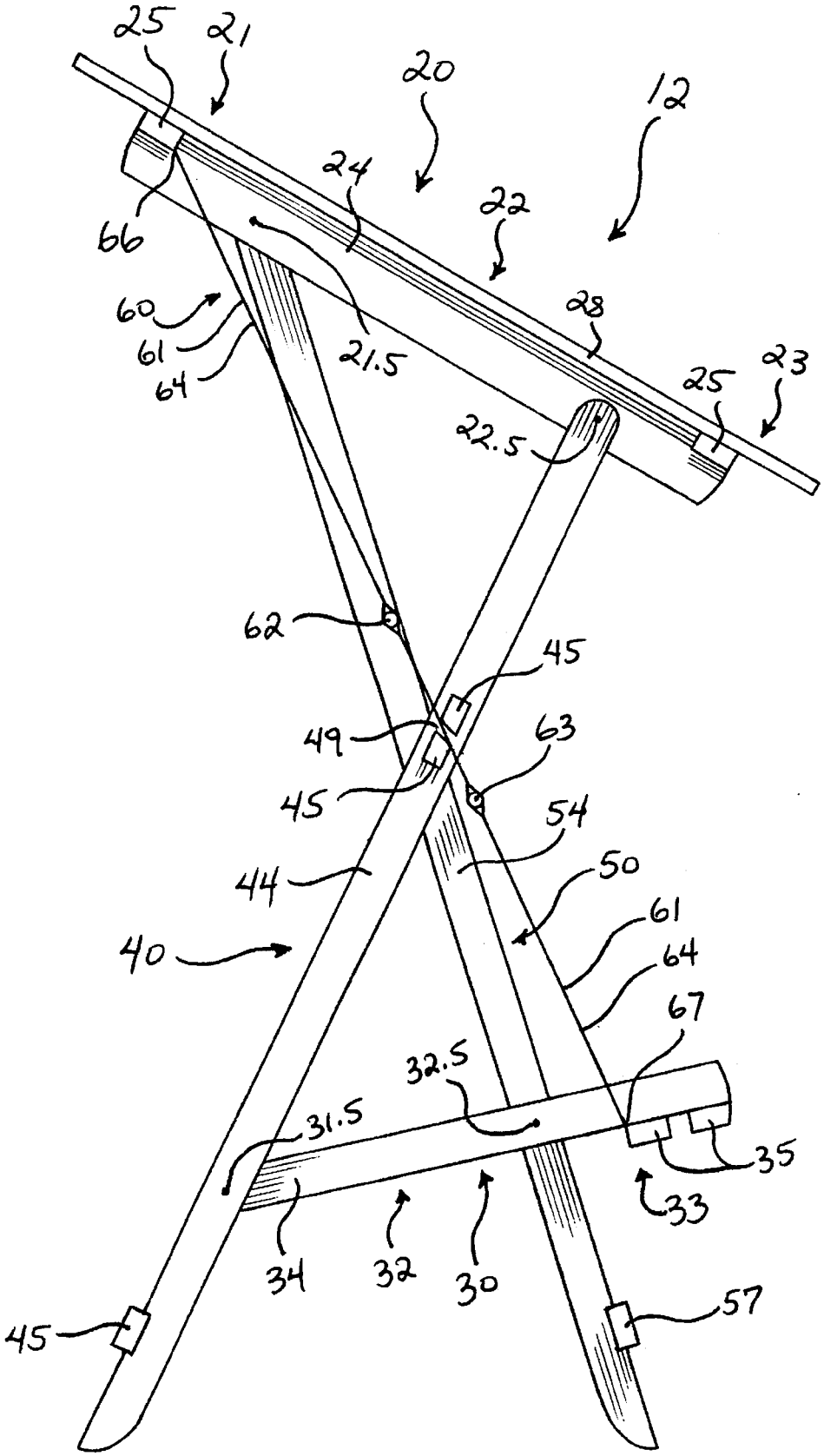
FIG. 5 is a cross-sectional side elevation drawing of the drafting-table embodiment of the invention, having substantially inclined table-top and a single-footrest structure, shown here in an intermediate operative position.

FIGS. 4 and 5

The pivotally articulated foldable drafting table 12 comprises an upper load-bearing table-top structure 20, a lower load-bearing footrest structure 30, a rear leg frame 40, a front leg frame 50, and motion-governing, or tethering, means 60 adapted to govern the relative pivotal motions of and the angular, spatial, and load-bearing relationships between the structures 20, 30 and frames 40, 50 listed above when the drafting table 12 is in use. The drafting table embodiment 12 of the invention is shown here in an intermediate operative position in which the upper load-bearing table-top structure 20 is forwardly inclined with respect to the horizontal. However, the pivotal articulation of the drafting table 12 and the co-responsive load-distributing, balancing, load-reapportioning, and counterbalancing relationships between the upper and lower load-bearing structures 20, 30 and between the load-sharing portions 21, 22, 23, 32, 33 thereof allow the upper load-bearing table-top structure 20 and the lower load-bearing footrest structure 30 to move through a variety of inclined dispositions and through a variety of angular, spatial, and pivotal interrelationships therebetween, as will be described in greater detail subsequently.

The front leg frame 50 comprises spaced side elements 54 and at least one cross-member 57. This frame 50 extends upwardly and rearwardly from its lower end, which engages the supportive grounding surface. The front leg frame side elements 54 are substantially longer than the rear leg frame side elements 44, the substantial portion of that greater length being disposed between the first and fourth pairs of pivot points 21.5, 32.5.

The rear leg frame 40 comprises spaced side elements 44 and at least one cross-member 45. The rear leg frame side elements 44 are spaced more closely together than are the front leg frame side elements 54, thereby causing the rear leg frame 40 to be narrower than the front leg frame 50. The lower end of the rear leg frame 40 is disposed rearward of the lower end of the front leg frame 50 and extends upwardly and forwardly from its lower end to intersect the plane defined by the front leg frame 50, the rear leg frame side elements 44 being disposed between the front leg frame side elements 54. One or more rear leg frame cross-members 45 extend between and join the rear leg frame cross-members 45 extend between and join the rear leg frame side elements 44 to form an integral frame 40. At least one such cross-member 45 is adapted to cooperate with the tethering member 61 via the tethering stops 62, 63.

The upper load-bearing table-top structure 20 comprises spaced side elements 24, at least one cross-member 25, and one or more upper load-bearing table-top surface elements 28. The upper load-bearing table-top structure side elements 24 are spaced more closely together than are the front leg frame side elements 54 and are spaced farther apart than are the rear leg frame side elements 44. One or more upper load-bearing table-top structure cross-members 25 extend between and join the upper load-bearing table-top structure side elements 24, and the upper load-bearing table-top structure surface elements 28 units with the upper load-bearing table-top structure side elements 24 and cross-members 25 to form an integral structure 20. The upper load-bearing table-top structure surface elements 28 are proportioned to have width and length generally equal to or greater than the width and length of the object formed by the union of the upper load-bearing table-top structure side elements 24 and cross-members 25. The upper load-bearing table-top structure 20 is forwardly inclined when the drafting table embodiment 12 of the invention is in use due to the greater length of the front leg frame side elements 54. This structure 20 is joined by aligned pivotal connecting means to the rear leg frame 40 above the intersection of the front and rear leg frames 50, 40 at a first pair of pivot points 22.5 located rearward of the forward end of the upper-bearing table-top structure 20. This structure 20 is joined by aligned pivotal connecting means to the front leg frame 50 above the intersection of the front and rear leg frames 50, 40 at a second pair of pivot points 21.5 rearward of the first pair of pivot points 22.5 described above. The space between the upper load-bearing table-top structure side elements 24 is proportioned such that the outer lateral surfaces of these side elements 24 are generally adjacent the inner lateral surfaces of the front leg frame side elements 54 at the second pair of pivot points 21.5 and such that the inner lateral surfaces of these side elements 24 are generally adjacent the outer lateral surfaces of the rear leg frame side elements 44 at the first pair of pivot points 22.5.

The first and second pairs of pivot points 21.5, 22.5 divide the upper load-bearing table-top structure 20 into three load-sharing portions 21, 22, 23 thereof, these being the rear upper load-sharing portion 21 located rearward of the second pair of pivot points 21.5, the front upper load-sharing portion 23 located forward of the first pair of pivot points 22.5, and the intermediate load-sharing portion 22 located between the first and second pairs of pivot points 21.5, 22.5.

Relative placement of the first and second pairs of pivot points 21.5, 22.5 determines the load-distributing, balancing, load-reapportioning, and counterbalancing relationships between the front, intermediate, and rear load-sharing portions 23, 22, 21 of the upper load-bearing table-top structure 20, and also determines the spatial, angular, pivotal, load-distributing, balancing, load-reapportioning, and counterbalancing relationship between the load-sharing portions 21, 22, 23 of the upper load-bearing table-top structure 20 and the load-sharing portions 32, 33 of the lower load-bearing footrest structure 30 and between the upper and lower load-bearing structures 20, 30 and the front and rear leg frames 40, 50.

The lower load-bearing footrest structure 30 comprises spaced side elements 34 and at least one cross-member 35. The lower load-bearing footrest structure side elements 34 are spaced more closely together than are the front leg frame side elements 54 and are spaced farther apart than are the rear leg frame side elements 44. This structure 30 is joined by aligned pivotal connecting means to the front leg frame 50 below the intersection of the front and rear leg frames 50, 40 at a third pair of pivot points 32.5 located rearward of the forward end of the lower load-bearing footrest structure 30. This structure 30 is joined by aligned pivotal connecting means to the rear leg frame 40 below the intersection of the front and rear leg frames 50, 40 at a fourth pair of pivot points 31.5 located rearward of the third pair of pivot points 32.5 described above. The space between the lower load-bearing footrest structure side elements 34 is proportioned such that the inner lateral surfaces of these side elements 34 are generally adjacent the outer lateral surface of the rear leg frame side elements 44 at the fourth pair of pivot points 31.5 and such that the outer lateral surfaces of these side elements 34 are generally adjacent the inner lateral surfaces of the front leg frame side elements 54 at the third pair of pivot points 32.5.

The third and fourth pairs of pivot points 31.5, 32.5 divide the lower load-bearing footrest structure 30 into three load-sharing portions 31, 32, 33 thereof, these being the front lower load-sharing portion 33 located forward of the third pair of pivot points 32.5, the intermediate lower load-sharing portion 32 located between the third and fourth pairs of pivot points 31.5, 32.5, and the rear lower load-sharing portion 31 located rearward of the fourth pair of pivot points 31.5.

Relative placement of these third and fourth pairs of pivot points 31.5, 32.5 determines the load-distributing, balancing, load-reapportioning, and counterbalancing relationships between the front, intermediate, and rear load-sharing portions 31, 32, 33 of the lower load-bearing footrest structure 30, and also determines the spatial, angular, pivotal, load-distributing, balancing, load-reapportioning, and counterbalancing relationships between the load-sharing portions 31, 32, 33 of this structure 40 and the load-sharing portions 21, 22, 23 of the upper load-bearing table-top structure 20 and between the upper and lower load-bearing structures 20, 30 and the front and rear leg frames 40, 50.

Relative placement of the four pairs of pivot points 21.5, 22.5, 31.5, 32.5 described above, the dimensions of the front, intermediate, and rear load-sharing portions 21, 22, 23 of the upper load-bearing table-top structure 20, the dimensions of the front, intermediate, and rear load-sharing portions 31, 32, 33 of the lower load-bearing footrest structure 30, and the relationships between these dimensions and the relative placement of the four pairs of pivot points 21.5, 22.5, 31.5, 32.5 are proportioned such that the structures 20, 30, the frames 40, 50, and the four pairs of pivot points 21.5, 22.5, 31.5, 32.5 of the drafting table 12 lie together substantially in a common plane when the drafting table 12 is folded out of use.

The motion-governing, or tethering, means 60 comprise a tethering member 61, a detachable upper tethering stop 62, and a detachable lower tethering stop 63. The tethering member extends between and joins the upper load-bearing structure 20, at connection point 66, with the lower load-bearing footrest structure 30, at connection point 67. The tethering member is adapted to cooperate with tethering stops 62, 63 when the drafting table is in use. Connection points 66, 67 may be located so as to minimize variation in the distance between these connection points 66, 67, measured via the rear leg frame cross-member 45, as the constituent structures 20, 30 and frames 40, 50 move when the drafting table 12 is in use or is folded out of use. Connection points 66, 67 may be located otherwise, as well, so as to regulate the effects of the tethering member 61 and of the upper and lower tethering stops 62, 63, cooperating with the rear leg frame cross-member 45, on the motion of the drafting table 12 as the constituent structures 20, 30 and frames 40, 50 move when the drafting table 12 is in use or is folded out of use. The tethering member 61 cooperates with the rear leg frame cross-member 45 intermediate the two connection points 66, 67 just referenced. At appropriate degrees of forward and rearward variation in the conformation of the drafting table 12, the tethering member 61 cooperates with the rear leg frame cross-member 45 via the upper tethering stop 62 to limit rearward variation and cooperates with the rear leg frame cross-member 45 via the lower tethering stop 63 to limit forward variation when the drafting table 12 is in use. The tethering member 61 may also comprise elastic means 64 adapted to accommodate variations in the distance between connection points 66 and 67, measured via the rear leg frame cross-member 45, as the constituent structures 20, 30 and frames 40, 50 move when the drafting table 12 is in use or is folded out of use and adapted to afford elastic effects providing means by which the drafting table 12 can return automatically to an intermediate operative position, or to another desired position, in the absence of weight and pressure forces acting to deflect the conformation of the drafting table 12 away from such intermediate or desired positions as the constituent structures 20, 30 and frames 40, 50 move when the drafting table 12 is in use or is folded out of use.

Figure 8:
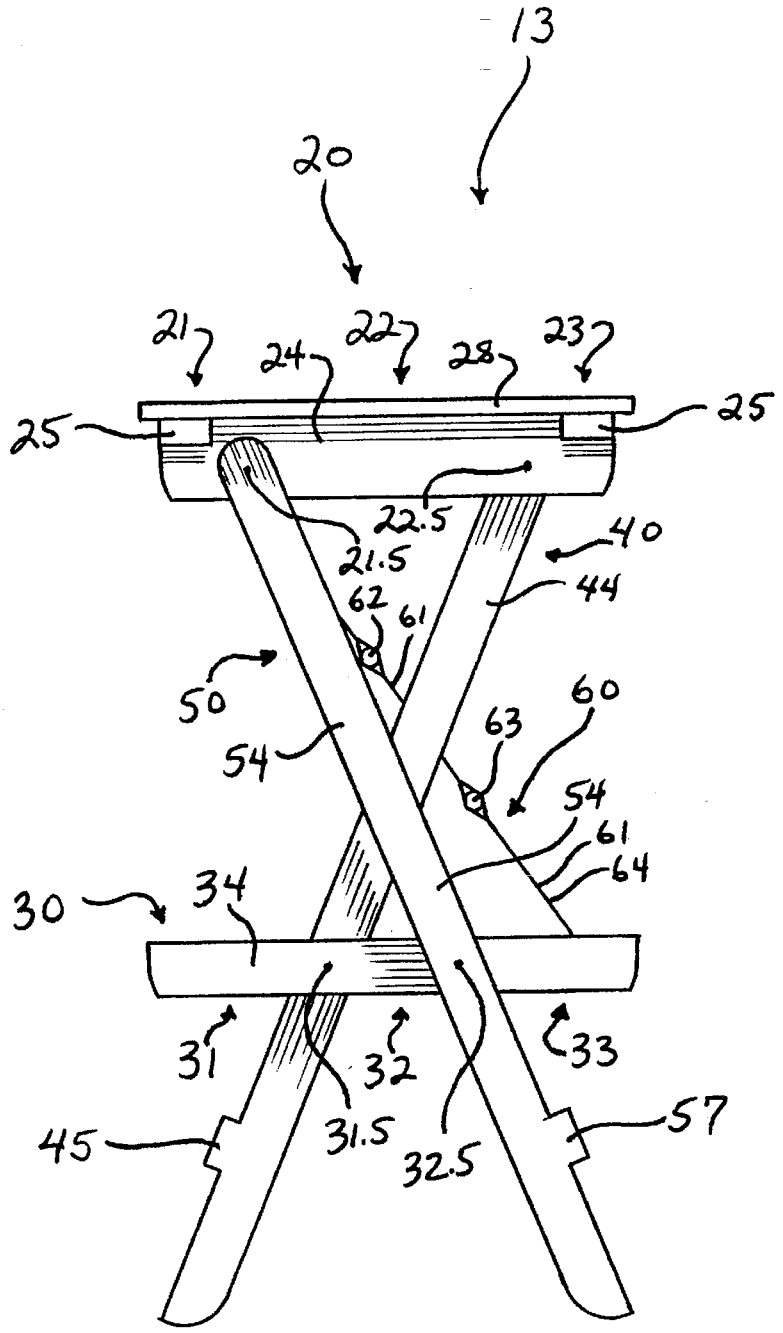
FIG. 8 is a side elevation drawing of the stool embodiment of the invention, having a dual-footrest structure, shown here in an intermediate operative position.
Figure 9:
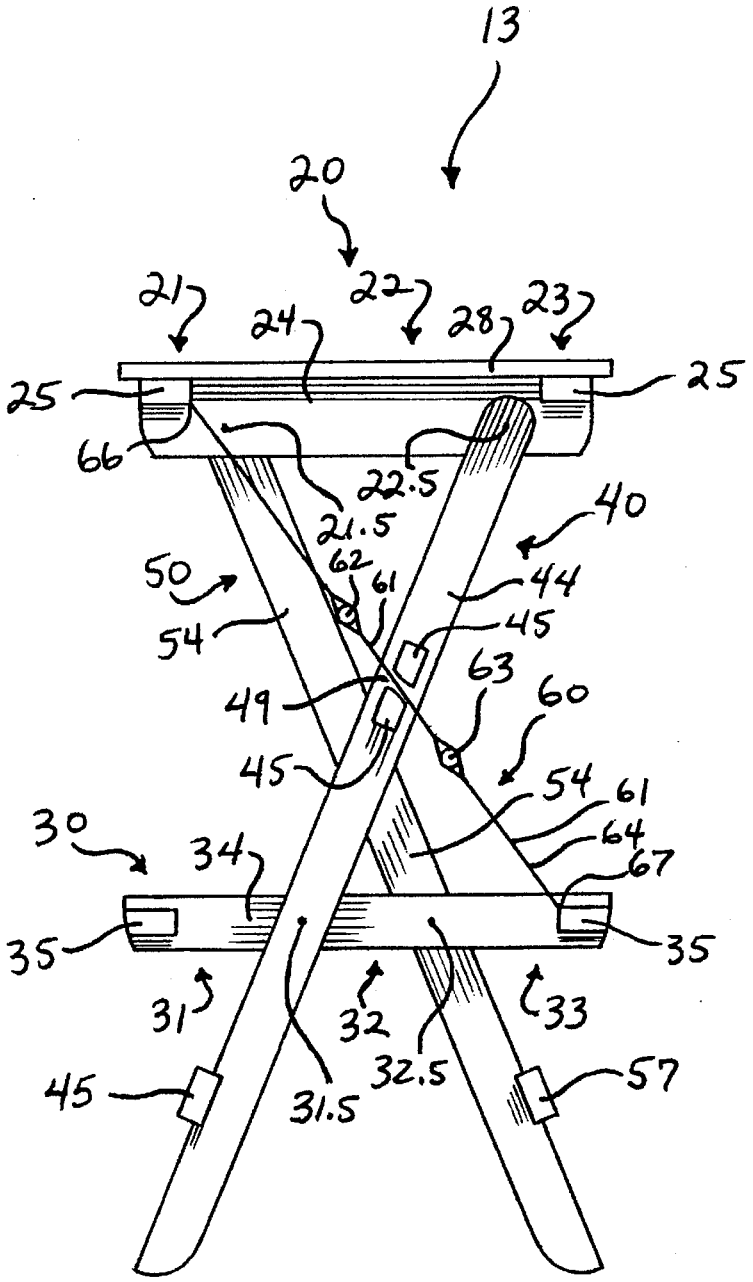
FIG. 9 is a cross-sectional side elevation drawing of the stool embodiment of the invention, having a dual-footrest structure, shown here in an intermediate operative position.

FIGS. 8 and 9

The pivotally articulated foldable stool 13 comprises an upper load-bearing seat structure 20, a lower load-bearing footrest structure 30, a rear leg frame 40, a front leg frame 50, and motion-governing, or tethering, means 60 adapted to govern the relative pivotal motions of and the angular, spatial, and load-bearing relationships between the structures 20, 30 and frames 40, 50 listed above when the stool 13 is in use. The stool embodiment 13 of the invention is shown here in an intermediate operative position in which the upper load-bearing seat structure 20 is disposed in a generally horizontal disposition. However, the pivotal articulation of the stool 13 and the co-responsive, load-distributing, balancing, load-reapportioning, and counterbalancing relationships between the upper and lower load-bearing structures 20, 30 and between the load-sharing portions 21, 22, 23, 31, 32, 33 thereof allow the upper load-bearing seat structure 20 and the lower load-bearing footrest structure 30 to move through a variety of reciprocal forwardly and rearwardly inclining positions and through a variety of angular, spatial, and pivotal relationships therebetween.

The front leg frame 50 comprises spaced side elements 54 and at least one cross-member 57. This frame 50 extends upwardly and rearwardly from its lower end.

The rear leg frame 40 comprises spaced side elements 44 and at least one cross-member 45. The rear leg frame side elements 44 are spaced more closely together than are the front leg frame side elements 54, thereby causing the rear leg frame 40 to be narrower than the front leg frame 50. The lower end of the rear leg frame 40 is disposed rearward of the lower end of the front leg frame 50 and extends upwardly and forwardly from its lower end to intersect the plane defined by the front leg frame 50 below the upper load-bearing seat structure 20, the rear leg frame side elements 44 being disposed between the front leg frame side elements 54. One or more rear leg frame cross-members 45 extend between and join the rear leg frame side elements 44 to form an integral frame 40. At least one such cross-member 45 is adapted to cooperate with the tethering member 61 via the tethering stops 62, 63.

The upper load-bearing seat structure 20 comprises spaced side elements 24, at least one cross-member 25, and one or more upper load-bearing seat surface elements 28. The upper load-bearing seat structure side elements 24 are spaced more closely together than are the front leg frame side elements 54 and are spaced farther apart than are the rear leg frame side elements 44. One or more upper load-bearing seat structure cross-members 25 extend between and join the upper load-bearing seat structure side elements 24, and the upper load-bearing seat structure surface elements 28 unite with the upper load-bearing seat structure side elements 24 and cross-members 25 to form an integral structure 20. The upper load-bearing seat structure surface elements 28 are proportioned to have width and length near the width and length of the object formed by the union of the upper load-bearing seat structure side elements 24 and cross-members 25. The upper load-bearing seat structure 20 is disposed in generally horizontal orientation when this stool embodiment 13 of the invention is in use. This structure 20 is joined by aligned pivotal connect means to the rear leg frame 40 above the intersection of the front and rear leg frames 50, 40 at a first pair of pivot points 22.5 located rearward of the forward end of the upper load-bearing seat structure 20. This structure 20 is joined by aligned pivotal connecting means to the front leg frame 50 above the intersection of the front and rear leg frames 50, 40 at a second pair of pivot points 21.5 rearward of the first pair of pivot points 22.5 described above. The space between the upper load-bearing seat structure side elements 24 is proportioned such that the outer lateral surfaces of these side elements 24 are generally adjacent the inner lateral surfaces of the front leg frame side elements 54 at the second pair of pivot points 21.5 and such that the inner lateral surfaces of these side elements 24 are generally adjacent the outer lateral surfaces of the rear leg frame side elements 44 at the first pair of pivot points 22.5.

The first and second pairs of pivot points 21.5, 22.5 divide the upper load-bearing seat structure 20 into three load-sharing portions 21, 22, 23 thereof, these being the rear upper load-sharing portion 21 located rearward of the second pair of pivot points 21.5, the front upper load-sharing portion 23 located forward of the first pair of pivot points 22.5, and the intermediate load-sharing portion 23 located between the first and second pairs of pivot points 21.5, 22.5.

Relative placement of these first and second pairs of pivot points 21.5, 22.5 determines the load-distributing, balancing, load-reapportioning, and counterbalancing relationships between the front, intermediate, and rear load-sharing portions 23, 22, 21 of the upper load-bearing seat structure 20, and also determines the spatial, angular, pivotal, load-distributing, balancing, load-reapportioning, and counterbalancing relationships between the load-sharing portions 21, 22, 23 of this structure 20 and the load-sharing portions 31, 32, 33 of the lower load-bearing footrest structure 30 and between the upper and lower load-bearing structures 20, 30 and the front and rear leg frames 40, 50.

The lower load-bearing footrest structure 30 comprises spaced side elements 34 and at least one cross-member 35. The lower load-bearing footrest structure side elements 34 are spaced more closely together than are the front leg frame side elements 54 and are spaced further apart than are the rear leg frame side elements 44. The lower load-bearing footrest structure 30 is disposed in generally horizontal orientation when this stool embodiment 13 of the invention is in use. This structure 30 is joined by aligned pivotal connecting means to the front leg frame 50 below the intersection of the front and rear leg frames 50, 40 at a third pair of aligned pivot points 32.5 located rearward of the forward end of the lower load-bearing footrest structure 30. This structure 30 is joined by aligned pivotal connecting means to the rear leg frame 40 below the intersection of the front and rear leg frames 50, 40 at a fourth pair of pivot points 31.5 located rearward of the third pair of pivot points 32.5 described above. The space between the lower load-bearing footrest structure side elements 34 is proportioned such that the inner lateral surfaces of these side elements 34 are generally adjacent the outer lateral surfaces of the rear leg frame side elements 44 at the fourth pair of pivot points 31.5 and such that the outer lateral surfaces of these side elements 34 are generally adjacent the inner lateral surfaces of the front leg frame side elements 54 at the third pair of pivot points 32.5.

The third and fourth pairs of pivot points 31.5, 32.5 divide the lower load-bearing footrest structure 30 into three load-sharing portions 31, 32, 33 thereof, these being the front lower load-sharing portion 33 located forward of the third pair of pivot points 32.5, the intermediate load-sharing portion 32 located between the third and fourth pairs of pivot points 31.5, 32.5, and the rear lower load-sharing portion 31 located rearward of the fourth pair of pivot points 31.5.

Relative placement of these third and fourth pairs of pivot points 31.5, 32.5 determines the load-distributing, balancing, load-reapportioning, and counterbalancing relationships between the front, intermediate, and rear load-sharing portions 31, 32, 33 of the lower load-bearing footrest structure 30, and also determines the spatial, angular, pivotal, load-distributing, balancing, load-reapportioning, and counterbalancing relationships between the load-sharing portions 31, 32, 33 of this structure 30 and the load-sharing portions 21, 22, 23 of the upper load-bearing seat structure 20 and between the upper and lower load-bearing structures 20, 30 and the front and rear leg frames 40, 50.

Relative placement of the four pairs of aligned pivot points 21.5, 22.5, 31.5, 32.5 described above, the dimensions of the front, intermediate, and rear load-sharing portions 21, 22, 23 of the upper load load-bearing seat structure 20, the dimensions of the front, intermediate, and rear load-sharing portions 31, 32, 33 of the lower load-bearing footrest structure 30, and the relationships between these dimensions and the relative placement of the four pairs of pivot points 21.5, 22.5, 31.5, 32.5 are proportioned such that the structures 20, 30 and frames 40, 50 and the four pairs of pivot points 21.5, 22.5, 31.5, 32.5 of the stool 13 lie together substantially in a common plane when the stool 13 is folded out of use.

The motion-governing, or tethering, means 60 comprise a tethering member 61, a detachable upper tethering stop 62, and a detachable lower tethering stop 63. The tethering member 61 extends between and joins the upper load-bearing seat structure 20, at connection point 66, with the lower load-bearing footrest structure 30, at connection point 67. The tethering member 61 is adapted to cooperate with tethering stops 62, 63 when the stool 13 is in use. Connection points 66, 67 may be located so as to minimize variation in the distance between these connection points 66, 67, measured via the rear leg frame cross-member 45, as the constituent structures 20, 30 and frames 40, 50 move when the stool 13 is in use or is folded out of use. Connection points 66, 67 may be located otherwise, as well, so as to regulate the effects of the tethering member 61 and of the upper and lower tethering stops 62, 63, cooperating with the rear leg frame cross-member 45, on the motion of the stool 13 as the constituent structures 20, 30 and frames 40, 50 move when the stool 13 is in use or is folded out of use. The tethering member 61 cooperates with rear leg frame cross-member 45 intermediate the two connection points 66, 67 just referenced. At appropriate degrees of forward and rearward variation in the conformation of the stool 13, the tethering member 61 cooperates with the rear leg frame cross-member 45 via the upper tethering stop 62 to limit rearward variation and cooperates with the rear leg frame cross-member 45 via the lower tethering stop 63 to limit forward variation when the stool 13 is in use. The tethering member 61 may also comprise elastic means 64 adapted to accommodate variations in the distance between connection points 66 and 67, measured via the rear leg frame cross-member 45, as the constituent structures 20, 30 and frames 40, 50 move when the stool 13 is in use or is folded out of use and adapted to afford elastic effects providing means by which the stool 13 can return automatically to an intermediate operative position, or to another desired position, in the absence of weight and pressure forces acting to deflect the conformation of the stool 13 away from such intermediate or other desired position as the constituent structures 20, 30 and frames 40, 50 move when the stool 13 is in use or is folded out of use.

Figure 10:
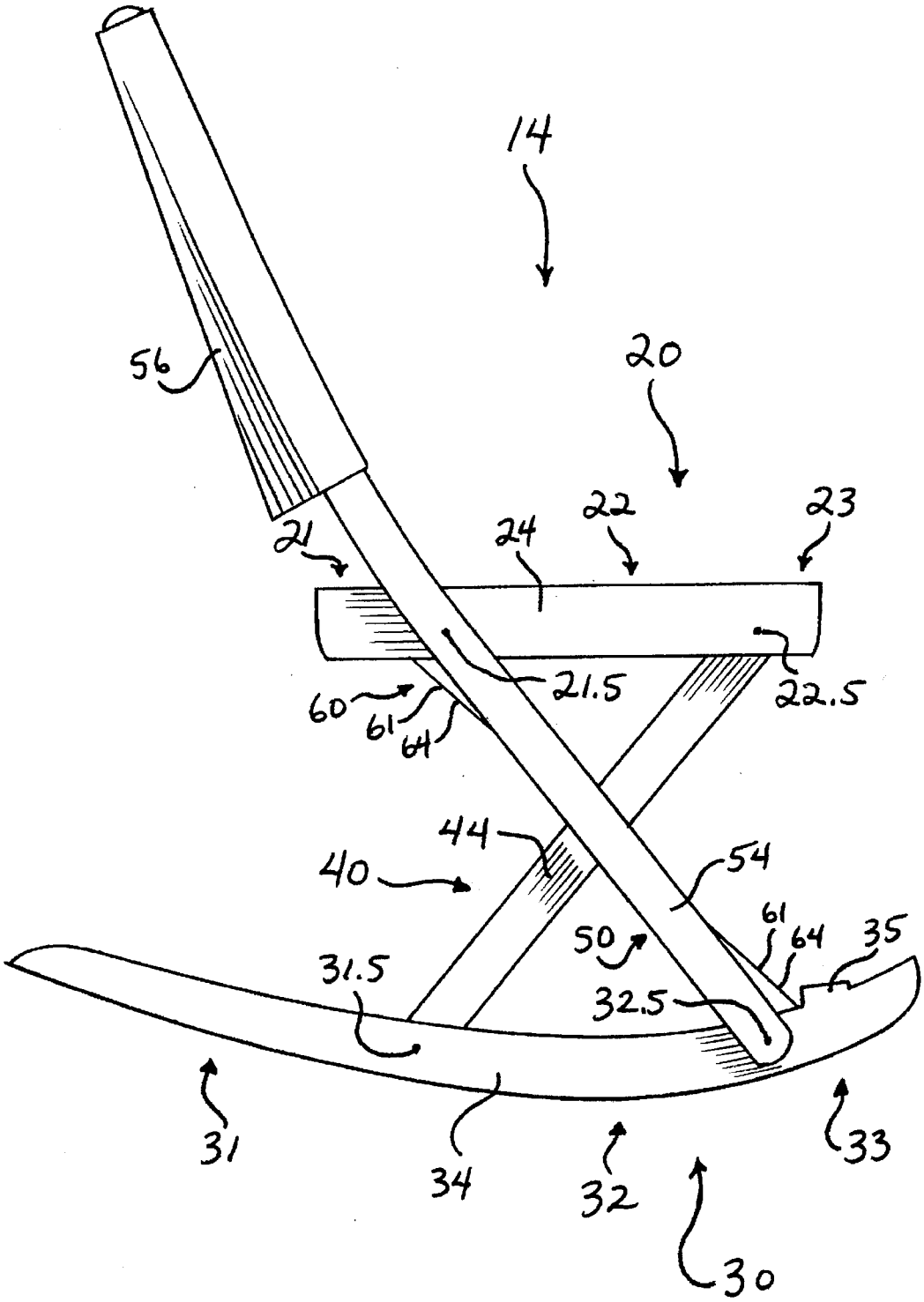
FIG. 10 is a side elevation drawing of the rocking chair embodiment of the invention, having a rockered footrest base structure, shown here in an intermediate operative position.
Figure 11:
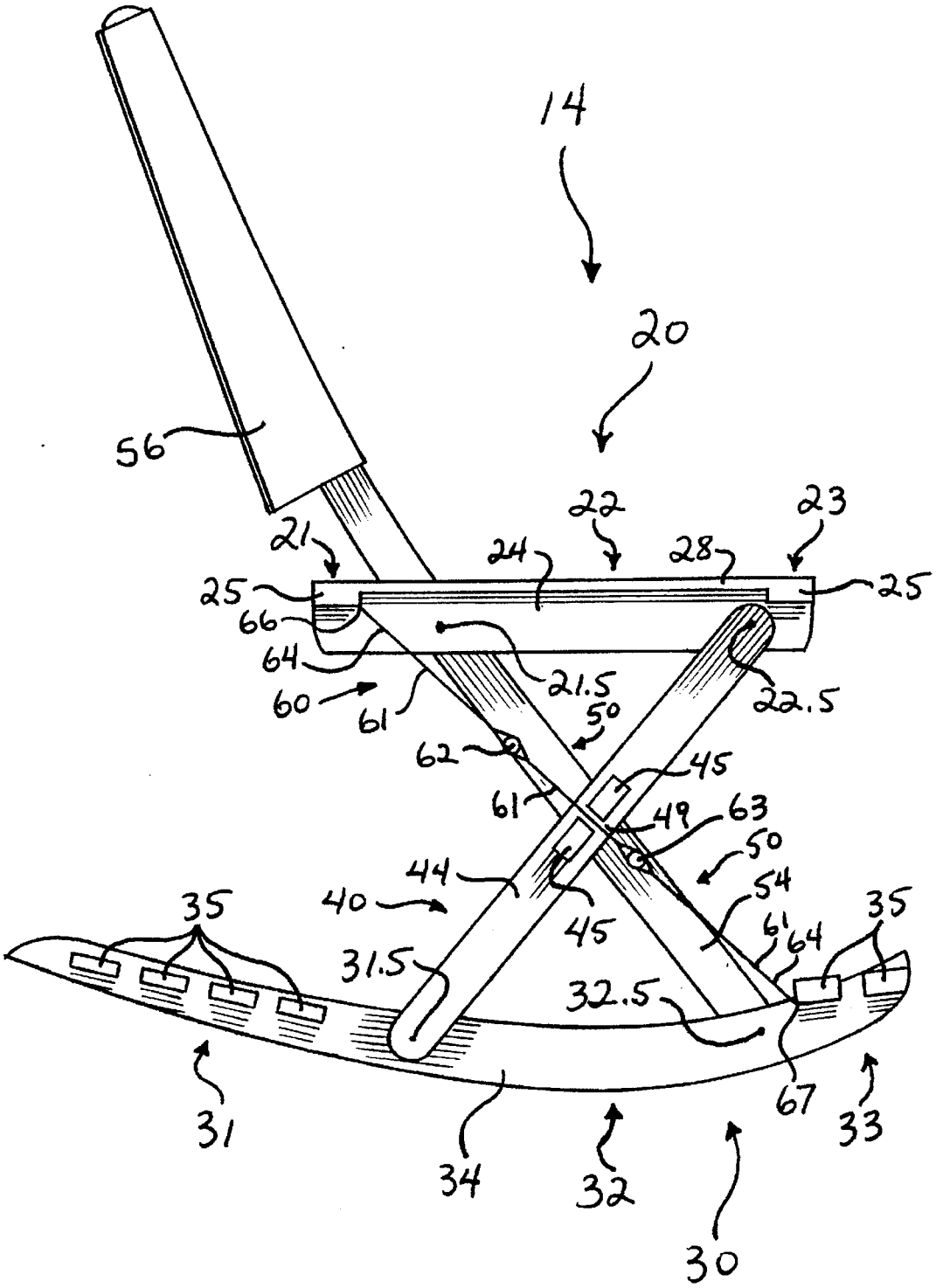
FIG. 11 is a cross-sectional side elevation drawing of the rocking chair embodiment of the invention, having a rockered footrest base structure, shown here in an intermediate operative position.

FIGS. 10 and 11

The pivotally articulated foldable rocking chair 14 comprises an upper load-bearing seat structure 20, a lower load-bearing footrest-and-rocker base structure 30, a rear leg frame 40, a front leg frame 50, whose upper cross-member 56 form a backrest element 56 being disposed above and generally rearward of the upper load-bearing seat structure 20 when the rocking chair 14 is in use, and motion-governing, or tethering, means 60 adapted to govern the relative pivotal motions of and the angular, spatial, and load-bearing relationships between the structures 20, 30 and frames 40, 50 listed above when the rocking chair 14 is in use. The rocking chair embodiment 14 of the invention is shown here in an intermediate operative position in which the upper load-bearing seat structure 20 is disposed in a generally horizontal disposition. However, the pivotal articulation of the rocking chair 14 and the co-responsive load-distributing, balancing, load-reapportioning, and counterbalancing relationships between the upper and lower load-bearing structures 20, 30 and between the load-sharing portions 21, 22, 23, 31, 32, 33 thereof allow the upper load-bearing seat structure 20 and the lower load-bearing footrest-and-rocker base structure 30 to move through a variety of reciprocal forwardly and rearwardly inclining positions, through a variety of angular, spatial, and pivotal interrelationships therebetween, and through a variety of angular, spatial, and pivotal interrelationships with the backrest element 56 of the front leg frame 50.

The front leg frame 50 comprises spaced side elements 54 and at least one cross-member 56. This frame 50 extends upwardly and rearwardly from its lower end, which is located in a relatively forward position. One or more cross-members 56 extend between and join the side elements 54 in the upper portion of the frame 50 to form a backrest element 56 above and generally rearward of the upper load-bearing seat structure 20 when the rocking chair 14 is in use.

The rear leg frame 40 comprises spaced side elements 44 and at least one cross-member 45. The rear leg frame side elements 44 are spaced more closely together than are the front leg frame side elements 54, thereby causing the rear leg frame 40 to be narrower than the front leg frame 50. The rear leg frame 40 extends upwardly and forwardly from its lower end, which is located generally rearward of the relatively forward position of the lower end of the front leg frame 50. The rear leg frame 40 intersects the plane occupied by the front leg frame 50 below the upper load-bearing seat structure 20, the rear leg frame side elements 44 being disposed between the front leg frame side elements 54. One or more rear leg frame cross-members 45 extend between and join the rear leg frame side elements 44 to form an integral frame 40. At least one such cross-member 45 is adapted to cooperate with the tethering member 61 via the tethering stops 62, 63.

The upper load-bearing seat structure 20 comprises spaced side elements 24, at least one cross-member 25, and one or more upper load-bearing seat surface elements 28. The upper load-bearing seat structure side elements 24 are spaced more closely together than are the front leg frame side elements 54 and are spaced further apart than are the rear leg frame side elements 44. One or more upper load-bearing seat structure cross-members 25 extend between and join the upper load-bearing seat structure side elements 24, and the upper load-bearing seat surface elements 28 join with the upper load-bearing seat structure side elements 24 and cross-members 25 to form an integral structure 20. The upper load-bearing seat surface elements 28 are proportioned to have width and length generally equal to or lesser than to width and length of the object formed by the union of the upper load-bearing seat structure side elements 24 and cross-members 25. The upper load-bearing seat structure 20 is disposed in substantially horizontal orientation when this rocking chair embodiment 14 of the invention is in use. This structure 20 is joined by aligned pivotal connecting means to the rear leg frame 40 above the intersection of the front and rear leg frames 50, 40 at a first pair of pivot points 22.5 located rearward of the forward end of the upper load-bearing seat structure 20. This structure 20 is joined by aligned pivotal connecting means to the front leg frame 50 above the intersection of the front and rear leg frames 50, 40 at a second pair of pivot points 21.5 rearward of the first pair of pivot points 22.5 described above. The space between the upper load-bearing seat structure side elements 24 is proportioned such that the outer lateral surfaces of these side elements 24 are generally adjacent the inner lateral surfaces of the front leg frame side elements 54 at the second pair of pivot points 21.5 and such that the inner lateral surfaces of these side elements 24 are generally adjacent the outer lateral surfaces of the rear leg frame side elements 44 at the first pair of pivot points 22.5.

The first and second pairs of pivot points 21.5, 22.5 divide the upper load-bearing seat structure 20 into three load-sharing portions 21, 22, 23 thereof, these being the rear upper load-sharing portion 21 located rearward of the second pair of pivot points 21.5, the front upper load-sharing portion 23 located forward of the first pair of pivot points 22.5, and the intermediate load-sharing portion 22 located between the first and second pairs of pivot points 21.5, 22.5.

Relative placement of the first and second pairs of pivot points 21.5, 22.5 determines the load-distributing, balancing, load-reapportioning, and counterbalancing relationships between the front, intermediate, and rear load-sharing portions 23, 22, 21 of the upper load-bearing seat structure 20, and also determines the spatial, angular, pivotal, load-distributing, balancing, load-reapportioning, and counterbalancing relationships between the load-sharing portions 21, 22, 23 of this structure 20 and the load-sharing portions 31, 32, 33 of the lower load-bearing footrest-and-rocker base structure 30 and between the upper and lower load-bearing structures 20, 30 and the front and rear leg frames 40, 50. Placement of the second pair of pivot points 21.5 determines the spatial, angular, pivotal, and load-sharing relationships between this structure 20 and the backrest element 56 of the front leg frame 50.

The lower load-bearing footrest-and-rocker base structure 30 comprises spaced side elements 34 and at least one cross-member 35. The lower load-bearing footrest-and-rocker base structure side elements 34 are spaced more closely together than are the front leg frame side elements 54 and are spaced further apart than are the rear leg frame side elements. 44. The lower load-bearing footrest-and-rocker base structure side elements 34 are curved such that their upper surfaces form a concave arc 38. The lower surfaces of these side elements 34 are curved to form a convex arc 39 that engages the supportive grounding surface, whereby these side elements 34 serve as rockers for this rocking chair embodiment 14 of the invention. This base structure 30 is disposed in generally horizontal orientation when the rocking chair embodiment 14 of the invention is in use. This structure 30 is joined by aligned pivotal connecting means to the front leg frame 50 near the lower end of the front leg frame 50 below the intersection of the front and rear leg frames 50, 40 at a third pair of pivot points 32.5 located rearward of the forward end of the lower load-bearing footrest-and-rocker base structure 30. This structure 30 is joined by aligned pivotal connecting means to the rear leg frame 40 near the lower end of the rear leg frame side 40 below the intersection of the front and rear leg frames 50, 40 at a fourth pair of pivot points 31.5 located rearward of the third pair of pivot points 32.5 described above. The space between the lower load-bearing footrest-and-rocker base structure side elements 34 is porportioned such that the inner lateral surfaces of these side elements 34 are generally adjacent the outer lateral surfaces of the rear leg frame side elements 44 at the fourth pair of pivot points 31.5 and such that the outer lateral surfaces of these side elements 34 are generally adjacent the inner lateral surfaces of the front leg frame side elements 54 at the third pair of pivot points 32.5.

The third and fourth pairs of pivot points 31.5, 32.5 divide the lower load-bearing footrest-and-rocker base structure 30 into three load-sharing portions 31, 32, 33 thereof, these being the front lower load-sharing portion 33 located forward of the third pair of pivot points 32.5, the intermediate load-sharing portion 32 located between the third and fourth pairs of pivot points 31.5, 32.5, and the rear lower load-sharing portion 31 located rearward of the fourth pair of pivot points 31.5.

Relative placement of these third and fourth pairs of pivot points 31.5, 32.5 determines the load-distributing, balancing, load-reapportioning, and counterbalancing relationships between the front, rear, and intermediate load-sharing portions 31, 32, 33 of this structure 30, and also determines the spatial, angular, pivotal, load-distributing, balancing, load-reapportioning, and counterbalancing relationships between the load-sharing portions 31, 32, 33 of this structure 30 and the load-sharing portions 21, 22, 23 of the upper load-bearing seat structure 20 and between the upper and lower load-bearing structures 20, 30 and the front and rear leg frames 40, 50.

Relative placement of the four pairs of pivot points 21.5, 22.5, 31.5, 32.5 described above, the dimensions of the front intermediate, and rear load-sharing portions 21, 22, 23, of the upper load-bearing seat structure 20, the dimensions of the front, intermediate, and rear load-sharing portions 31, 32, 33 of the lower load-bearing footrest-and-rocker base structure 30, and the relationships between these dimensions and the placement of the four pairs of pivot points 21.5, 22.5, 31.5, 32.5 are proportioned such that the concave upper surface of the lower load-bearing footrest-and-rocker base structure side elements 34 nests with and adjacent to the lower, rearward surfaces of the front leg frame side elements 54 when this rocking chair embodiment 14 of the invention is folded out of use.

The motion-governing, or tethering, means 60 comprise a tethering member 61, a detachable upper tethering stop 62, and a detachable lower tethering stop 63. The tethering member 81 extends between and joins the upper load-bearing seat structure 20, at connection point 66, with the lower load-bearing footrest-and-rocker structure 30, at connection point 67. The tethering member 61 is adapted to cooperate with tethering stops 62, 63 when the rocking chair 14 is in use. Connection points 66, 67 may be located so as to minimize variation in the distance between these connection points 66, 67, measured via the rear leg frame cross member 45, as the constituent structures 20, 30 and frames 40, 50 move when the rocking chair 14 is in use or is folded out of use. Connection points 66, 67 may be located otherwise, as well, so as to regulate the effects of the tethering member 61 and of the upper and lower tethering stops 62, 63, cooperating with the rear leg frame cross-member 45, on the motion of the rocking chair 14 as the constituent structures 20, 30 and frames 40, 50 move when the rocking chair 14 is in use or is folded out of use. The tethering member 61 cooperates with the rear leg frame cross-member 45 intermediate the two connection points 66, 67 just referenced. At appropriate degrees of forward and rearward variation in the conformation of the rocking chair 14, the tethering member 61 cooperates with the rear leg frame cross-member 45 via the upper tethering stop 62 to limit rearward variation and cooperates with the rear leg frame cross-member 45 via the lower tethering stop 63 to limit forward variation when the rocking chair 14 is in use. The tethering member 61 may also comprise elastic means 64 adapted to accomodate variations in the distance between connection points 66 and 67, measured via the rear leg frame cross-member 45, as the constituent structures 20, 30 and frames 40, 50 move when the rocking chair 14 is in use or is folded out of use and adapted to afford elastic effects providing means by which the rocking chair 14 can return automatically to an intermediate operative position, or to another desired position, in the absence of weight and pressure forces acting to deflect the conformation of the rocking chair 14 away from such intermediate or other desired position as the constituent structures 20, 30 and frames 40, 50 move when the rocking chair 14 is in use or it folded out of use.

Figure 19:
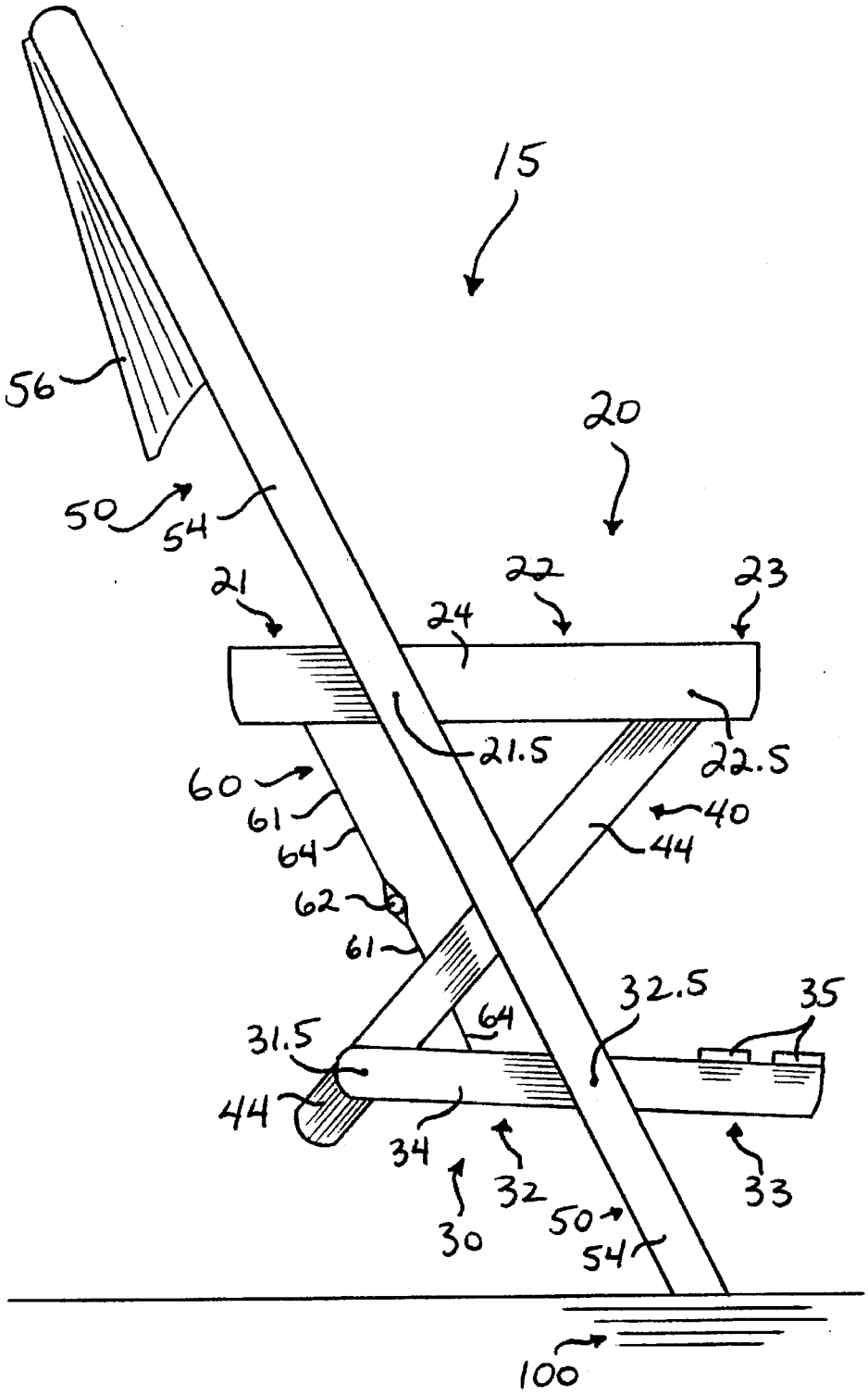
FIG. 19 is a side elevation drawing of the fixed-front-leg-frame stationary chair embodiment of the invention, having a single-footrest structure and cushioned load support characteristics.
Figure 20:
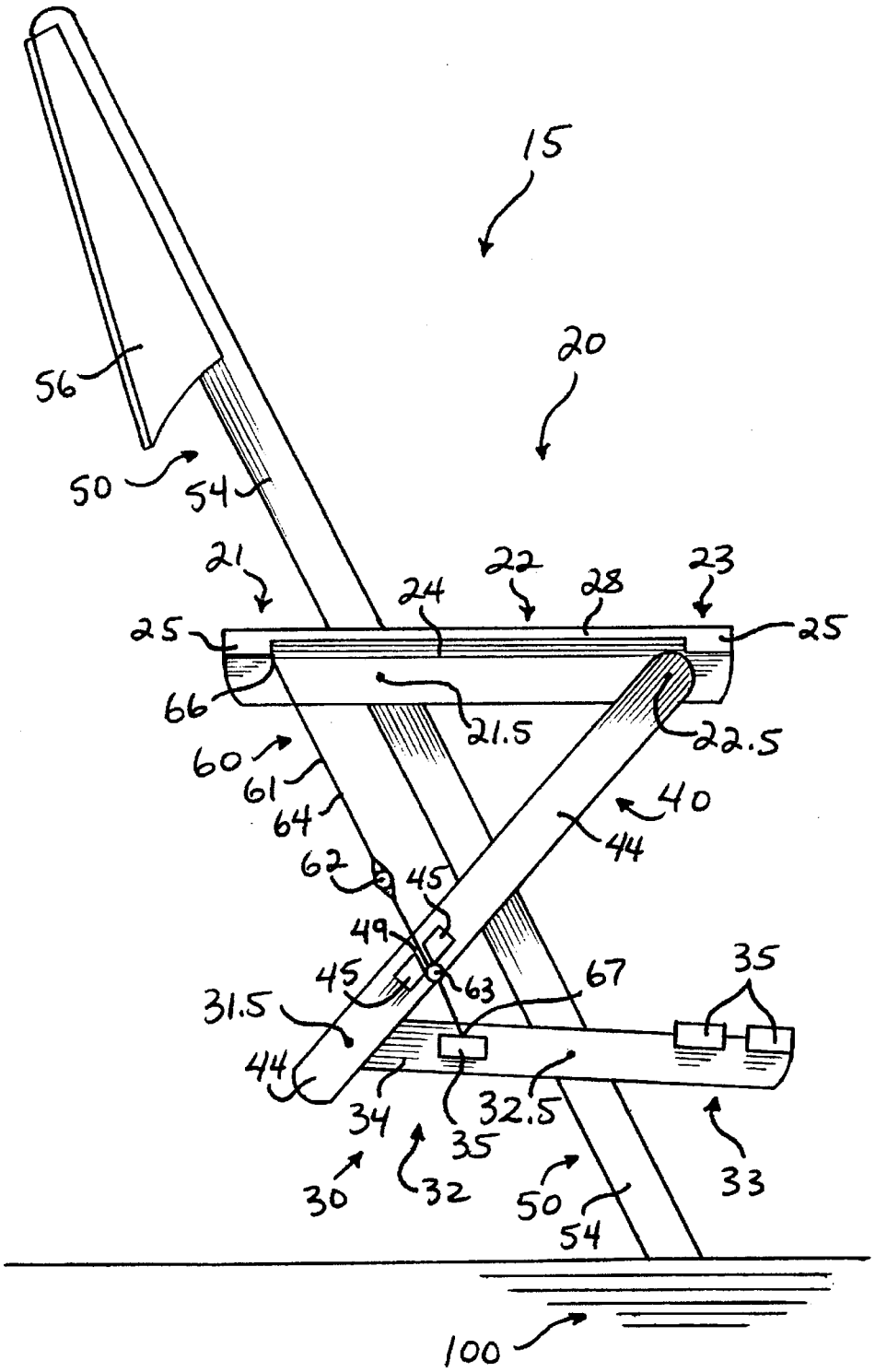
FIG. 20 is a cross-sectional side elevation drawing of the fixed-front-leg-frame stationary chair embodiment of the invention, having a single-footrest structure and cushioned load support characteristics.

FIGS. 19 and 20

The pivotally articulated fixed-front-leg-frame stationary chair 15 comprises an upper load-bearing seat structure 20, a lower load-bearing footrest structure 30, a rear leg frame 40, a front leg frame 50, whose upper cross-member 56 form a backrest element 56 being disposed above and generally rearward of the upper load-bearing seat structure 20 when the chair 15 is in use, and motion-governing, or tethering, means 60 adapted to govern the relative pivotal motions of and the angular, spatial, and load-bearing relationships between the structures 20, 30 and rear leg frames 40 listed above when the chair 15 is in use. This stationary chair embodiment 15 of the invention is shown here in an intermediate operative position in which the upper load-bearing seat structure 20 is disposed in a generally horizontal disposition. However, the pivotal articulation of the chair 15 and the co-responsive load-distributing, balancing, load-reapportioning, and counterbalancing relationships between the upper and lower load-bearing structures 20, 30 and between the load-sharing portions 21, 22, 23, 32, 33 thereof allow the upper load-bearing seat structure 20 and the lower load-bearing footrest structure 30 to move through a variety of reciprocal inclining positions, through a variety of angular, spatial, and pivotal interrelationships therebetween, and through a variety of angular, spatial, and pivotal interrelationships with the backrest element 56 of the front leg frame 50.

The front leg frame 50 comprises spaced side elements 54 and at least one cross-member 56. This frame 50 extends upwardly and rearwardly from its lower end, which is joined in static union with a supportive grounding surface 100. One or more cross-members 56 extend between and join the side elements 54 in the upper portion of the frame 50 to form a backrest element 56 above and generally rearward of the upper load-bearing seat structure 20 when the chair 15 is in use.

The rear leg frame 40 comprises spaced side elements 44 and at least one cross-member 45. The rear leg frame side elements 44 are spaced more closely together than are the front leg frame side elements 54, thereby causing the rear leg frame 40 to be narrower than the front leg frame 50. The rear leg frame 40 extends upwardly and forwardly from a position substantially rearward of the lower end of the front leg frame 50. The rear leg frame thereby intersects the front leg frame 50, the rear leg frame side elements 44 being disposed between the front leg frame side elements 54. One or more rear leg frame cross-members 45 extend between and join the rear leg frame side elements 44 to form an integral frame. At least one such cross-member 45 is adapted to cooperate with the tethering member 61 via the tethering stops 62, 63.

The upper load-bearing seat structure 20 comprises spaced side elements 24, at least one cross-member 25, and one or more upper load-bearing surface elements 28. The upper load-bearing seat structure side elements 24 are spaced more closely together than are the front leg frame side elements 54 and are spaced further apart than are the rear leg frame side elements 44. One or more upper load-bearing seat structure cross-members 25 extend between and join the upper load-bearing seat structure side elements 24, and the upper load-bearing seat surface elements 28 join with the upper load-bearing seat structure side elements 24 and cross-members 25 to form an integral structure 20. The upper load-bearing seat surface elements 28 are proportioned to have width and length generally equal to or lesser than the width and length of the object formed by the union of the upper load-bearing seat structure side elements 24 and cross-members 25. The upper load-bearing seat structure 20 is disposed in generally horizontal orientation when this embodiment 15 of the invention is in use. This structure 20 is joined by aligned pivotal connecting means to the rear leg frame 40 above the intersection of the front and rear leg frames 50, 40 at a first pair of pivot points 22.5 located rearward of the forward end of the upper load-bearing seat structure 20. This structure 20 is joined by aligned pivotal connecting means to the front leg frame 50 above the intersection of the front and rear leg frames 50, 40 at a second pair of pivot points 21.5 rearward of the first pair of pivot points 22.5 described above. The space between the upper load-bearing seat structure side elements 24 is proportioned such that the outer lateral surfaces of these side elements 24 are generally adjacent the inner lateral surfaces of the front leg frame side elements 54 at the second pair of pivot points 21.5 and such that the inner lateral surfaces of these side elements 24 are generally adjacent the outer lateral surfaces of the rear leg frame side elements 44 at the first pair of pivot points 22.5.

The first and second pairs of pivot points 21.5, 22.5 divide the upper load-bearing seat structure 20 into three load-sharing portions 21, 22, 23 thereof, these being the rear upper load-sharing portion 21 located rearward of the second pair of pivot points 21.5, the front upper load-sharing portion 23 located forward of the first pair of pivot points 22.5, and the intermediate load-sharing portion 22 located between the first and second pairs of pivot points 21.5, 22.5.

Relative placement of the first and second pairs of pivot points 21.5, 22.5 determines the load-distributing, balancing, load-reapportioning, and counterbalancing relationships between the front, intermediate, and rear load-sharing portions 23, 22, 21 of the upper load-bearing seat structure 20, and also determines the spatial, angular, pivotal, load-distributing, balancing, load-reapportioning, and counterbalancing relationships between the load-sharing portions 21, 22, 23 of this structure 20 and the load-sharing portions 32, 33 of the lower load-bearing footrest structure 30. Placement of the second pair of pivot points 21.5 determines the angular and pivotal relationships between the upper load-bearing seat structure 20 and the backrest element 56 of the front leg frame 50.

The lower load-bearing footrest structure 30 comprises spaced side elements 34 and at least one cross-member 35. The lower load-bearing footrest structure side elements 34 are spaced more closely together than are the front leg frame side elements 54 and are spaced further apart than are the rear leg frame side elements 44. The lower load-bearing footrest structure 30 is disposed in generally horizontal orientation when this embodiment 15 of the invention is in use. This structure 30 is joined by aligned pivotal connecting means to the front leg frame 50 below the intersection of the front and rear leg frames 50, 40 at a third pair of pivot points 32.5 located rearward of the forward end of the lower load-bearing footrest structure 30. This structure 30 is joined by aligned pivotal connecting means to the rear leg frame 40 below the intersection of the front and rear leg frames 50, 40 generally near the lower ends of the rear leg frame side elements 44 at a fourth pair of pivot points 31.5 located rearward of the third pair of pivot points 32.5 described above. The space between the lower load-bearing footrest structure side elements 34 is proportioned such that the inner lateral surfaces of these side elements 34 are generally adjacent the outer lateral surfaces of the rear leg frame side elements 44 at the fourth pair of pivot points 31.5 and such that the outer lateral surfaces of these side elements 34 are generally adjacent the inner lateral surfaces of the front leg frame side elements 54 at the third pair of pivot points 32.5.

The third and fourth pairs of pivot points 31.5, 32.5 divide the lower load-bearing footrest structure 30 into three load-sharing portions 31, 32, 33 thereof, these being the front lower load-sharing portion 33 located forward of the third pair of pivot points 32.5, the intermediate lower load-sharing portion 32 located between the third and fourth pairs of pivot points 31.5, 32.5, and the rear lower load-sharing portion 31 located rearward of the fourth pair of pivot points 31.5.

Relative placement of these third and fourth pairs of pivot points 31.5, 32.5 determines the load-distributing, balancing, load-reapportioning, and counterbalancing relationships between the front, intermediate, and rear load-sharing portions 31, 32, 33 of this structure 30, and also determines the spatial, angular, pivotal, load-distributing, balancing, load-reapportioning, and counterbalancing relationships between the load-sharing portions 31, 32, 33 of this structure 30 and the load-sharing portions 21, 22, 23 of the upper load-bearing seat structure 20.

Relative placement of the four pairs of aligned pivot points 21.5, 22.5, 31.5, 32.5 described above, the dimensions of the front, intermediate, and rear load-sharing portions 21, 22, 23 of the upper load-bearing seat structure 20, the dimensions of the front, intermediate, and rear load-sharing portions 31, 32, 33 of the lower load-bearing footrest structure 30, and the relationships between these dimensions and the relative placement of the four pairs of pivot points 21.5, 22.5, 31.5, 32.5 are proportioned such that the structures 20, 30 and frames 40, 50 and the four pairs of pivot points 21.5, 22.5, 31.5, 32.5 of the stationary chair 15 lie together substantially in a common plane when the chair 15 is folded out of use.

The motion-governing, or tethering, means 60 comprise a tethering member 61, a detachable upper tethering stop 62, and a detachable lower tethering stop 63. The tethering member 61 extends between and joins the upper load-bearing seat structure 20, at connection point 66, with the lower load-bearing footrest structure 30, at connection point 67. The tethering member 61 is adapted to cooperate with tethering stops 62, 63 when the stationary chair 15 is in use. Connection points 66, 67 may be located so as to minimize variation in the distance between these connection points 66, 67, measured via the rear leg frame cross-member 45, as the constituent structures 20, 30 and rear leg frame 40 move when the stationary chair 15 is in use or is folded out of use. Connection points 66, 67 may be located otherwise, as well, so as to regulate the effects of the tethering member 61 and of the upper and lower tethering stops 62, 63, cooperating with the rear leg frame cross-member 45, on the motion of the stationary chair 15 as the constituent structures 20, 30 and rear leg frame 40 move when the stationary chair 15 is in use or is folded out of use. The tethering member 61 cooperates with the rear leg frame cross-member 45 intermediate the two connection points 66, 67 just referenced. The tethering member 61 cooperates with the rear leg frame cross member 45 via the upper tethering stop 62 to limit downward motion of the rear load-sharing portion 21 of the upper load-bearing seat structure 20 and to limit downward motion of the front load-sharing portion 33 of the lower load-bearing footrest structure 30 when the stationary chair 15 is in use. The tethering member 61 cooperates with the rear leg frame cross-member 45 via the lower tethering stop 63 to limit downward motion of the intermediate and front load-sharing portions 22, 23 of the upper load-bearing seat structure 20 and to limit upward motion of the front load-sharing portion 33 of the lower load-bearing footrest structure 30 when the stationary chair 15 is in use. The tethering member 61 may also comprise elastic means 64 adapted to accomodate variations in the distance between connection points 66 and 67, measured via the rear leg frame cross-member 45, as the constituent structures 20, 30 and rear leg frame 40 move when the stationary chair 15 is in use or is folded out of use and adapted to afford elastic effects providing means by which the stationary chair 15 can return automatically to an intermediate operative position, or to another desired position, in the absence of weight and pressure forces acting to deflect the conformation of the stationary chair 15 away from such intermediate or other desired position as the constituent structures 20, 30 and rear leg frame 40 move when the stationary chair 15 is in use or is folded out of use. In this stationary chair embodiment 15 of the invention, these tethering means 60 also provide an elastic cushion in the suspension and operation of the constituent structures 20, 30 and rear leg frame 40 of the stationary chair 15.

Figure 21:
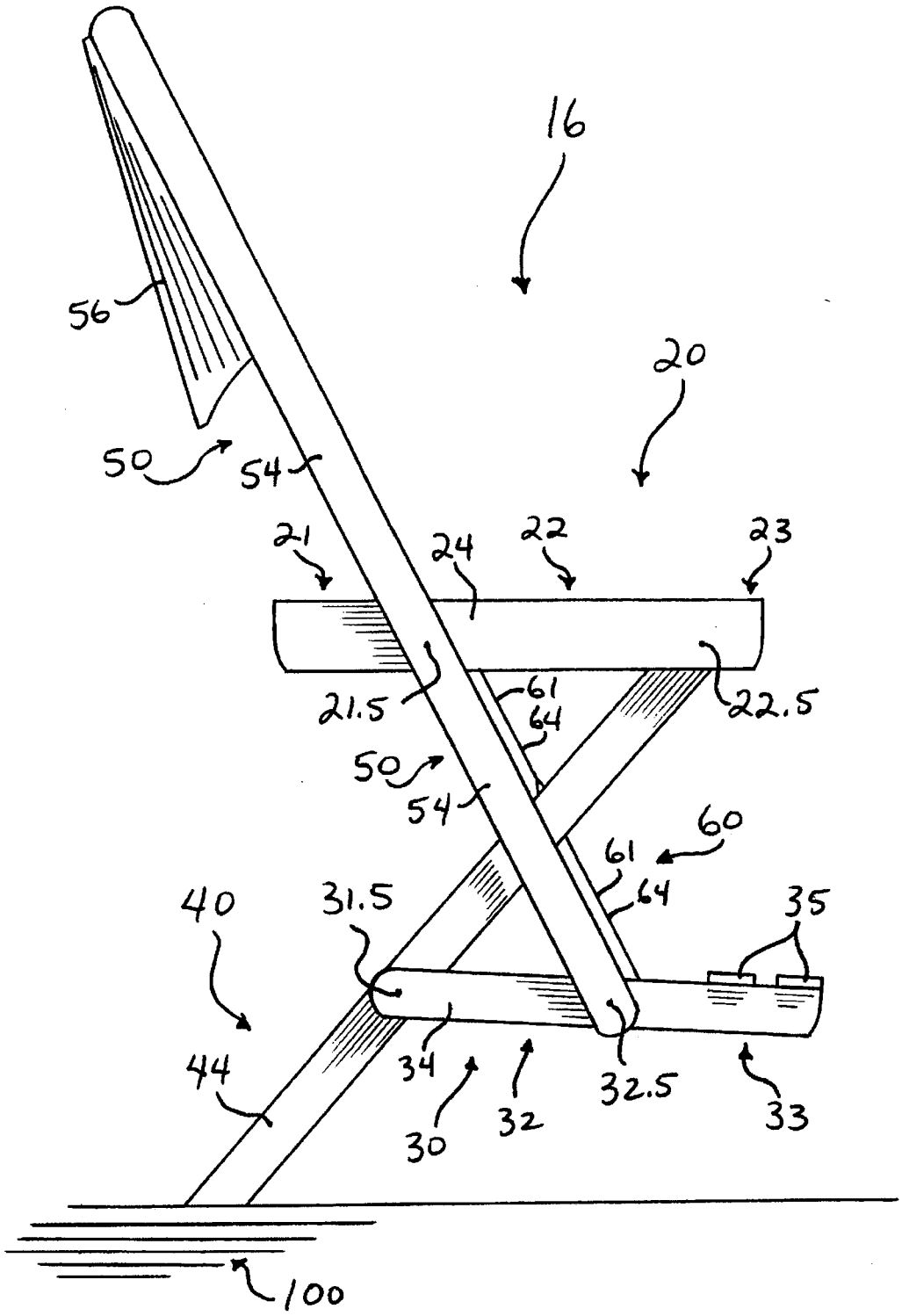
FIG. 21 is a side elevation drawing of the fixed-rear-leg-frame stationary chair embodiment of the invention, having a single-footrest structure and cushioned load support characteristics.
Figure 22:
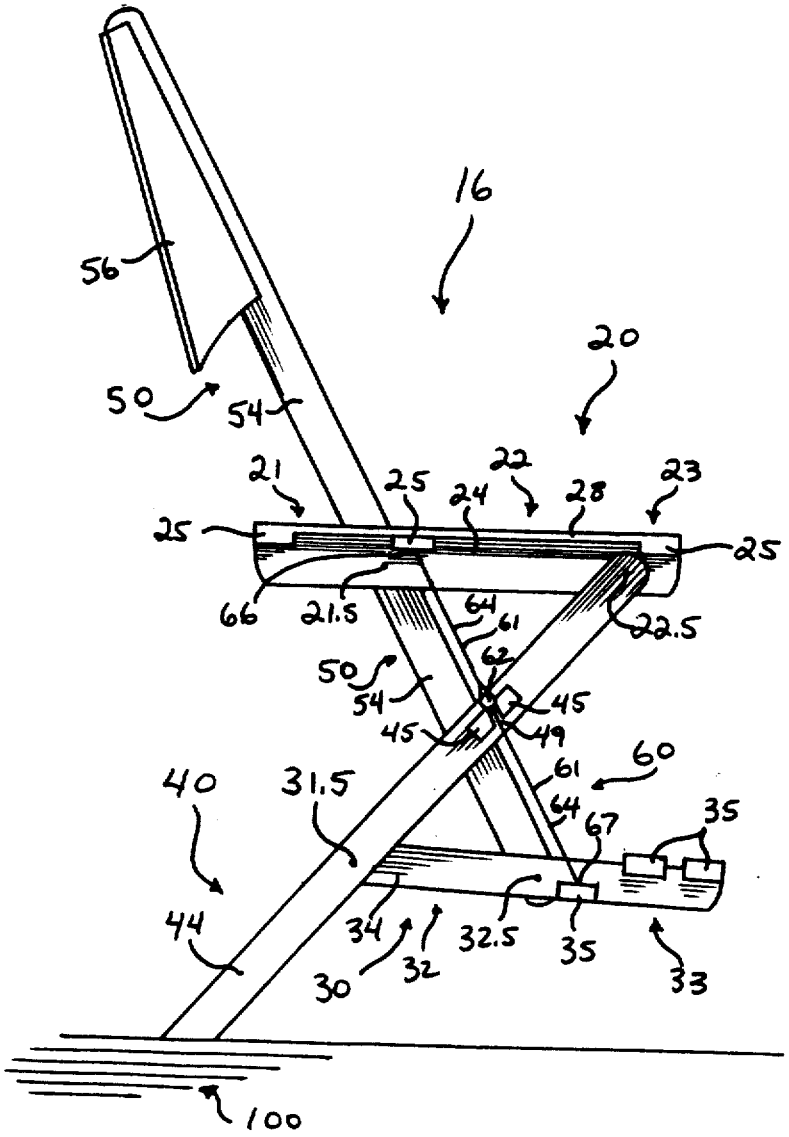
FIG. 22 is a cross-sectional side elevation drawing of the fixed-rear-leg-frame stationary chair embodiment of the invention, having a single-footrest structure and cushioned load support characteristics.

FIGS. 21 and 22

The pivotally articulated fixed-rear-leg-frame stationary chair 16 comprises an upper load-bearing seat structure 20, a lower load-bearing footrest structure 30, a rear leg frame 40, a front leg frame 50, whose upper cross-member 56 form a backrest element 56 being disposed above and generally rearward of the upper load-bearing seat structure 20 when the chair 16 is in use, and motion-governing, or tethering, means 60 adapted to govern the relative pivotal motions of and the angular, spatial, and load-bearing relationships between and to appropriately suspend the structures 20, 30 and front leg frame 50 listed above when the chair 16 is in use. This stationary chair embodiment 16 of the invention is shown here in an intermediate operative position in which the upper load-bearing seat structure 20 is disposed in a generally horizontal disposition. However, the pivotal articulation of the chair 16 and the co-responsive load-distributing, balancing, load-reapportioning, and counterbalancing relationships between the upper and lower load-bearing structures 20, 30 and between the load-sharing portions 21, 22, 23, 32, 33 thereof allow the upper load-bearing seat structure 20 and the lower load-bearing footrest structure 30 to move through a variety of reciprocal inclining positions, through a variety of angular, spatial, and pivotal interrelationships therebetween, and through a variety of angular, spatial, and pivotal interrelationships with the backrest element 56 of the front leg frame 50.

The front leg frame 50 comprises spaced side elements 54 and at least one cross-member 56. The front leg frame 50 extends upwardly and rearwardly from a forward position below the upper load-bearing seat structure 20. One or more cross-members 56 extend between and join the side elements 54 in the upper portion of the frame 50 to form a backrest element 56 above and generally rearward of the upper load-bearing seat structure 20 when the chair 16 is in use.

The rear leg frame 40 comprises spaced side elements 44 and at least one cross-member 45. The rear leg frame side elements 44 are spaced more closely together than are the front leg frame side elements 54, thereby causing the rear leg frame 40 to be narrower than the front leg frame 50. The rear leg frame 40 extends upwardly and forwardly from its lower end, which is joined in static union with a supportive grounding surface 100 at a rearward position. The rear leg frame thereby intersects the front leg frame 50, the rear leg frame side elements 44 being disposed between the front leg frame side elements 54. One or more rear leg frame cross-members 45 extend between and join the rear leg frame side elements 64 to form an integral frame 40. At least one such cross-member 45 is adapted to cooperate with the tethering member 61 via the tethering stops 62, 63.

The upper load-bearing seat structure 20 comprises spaced side elements 24, at least one cross-member 25, and one or more upper load-bearing surface elements 28. The upper load-bearing seat structure side elements 24 are spaced more closely together than are the front leg frame side elements 54 and are spaced further apart than are the rear leg frame side elements 44. One or more upper load-bearing seat structure cross-members 25 extend between and join the upper load-bearing seat structure side elements 24, and the upper load-bearing seat surface elements 28 join with the upper load-bearing seat structure side elements 24 and cross-members 25 to form an integral structure 20. The upper load-bearing seat surface elements 28 are proportioned to have width and length generally equal to or lesser than the width and length of the object formed by the union of the upper load-bearing seat structure side elements 24 and cross-members 25. The upper load-bearing seat structure 20 is disposed in generally horizontal orientation when this embodiment 15 of the invention is in use. This structure 20 is joined by aligned pivotal connecting means to the rear leg frame 40 above the intersection of the front and rear leg frames 50, 40 at a first pair of aligned pivot points 22.5 located rearward of the forward end of the upper load-bearing seat structure 20. This structure 20 is joined by aligned pivotal connecting means to the front leg frame 50 above the intersection of the front and rear leg frames 50, 40 at a second pair of aligned pivot points 21.5 rearward of the first pair of pivot points 22.5 described above. The space between the upper load-bearing seat structure side elements 24 is proportioned such that the outer lateral surfaces of these side elements 24 are generally adjacent the inner lateral surfaces of the front leg frame side elements 54 at the second pair of pivot points 21.5 and such that the inner lateral surfaces of these side elements 24 are generally adjacent the outer lateral surfaces of the rear leg frame side elements 44 at the first pair of pivot points 22.5.

The first and second pairs of pivot points 21.5, 22.5 divide the upper load-bearing seat structure 20 into three load-sharing portions 21, 22, 23 thereof, these being the rear upper load-sharing portion 21 located rearward of the second pair of pivot points 21.5, the front upper load-sharing portion 23 located forward of the first pair of pivot points 22.5, and the intermediate load-sharing portion 22 located between the first and second pairs of pivot points 21.5, 22.5.

Relative placement of the first and second pairs of pivot points 21.5, 22.5 determines the spatial, angular, pivotal, and load-sharing relationships between the upper and lower load-bearing structures 20, 30 and between these structures 20, 30 and the backrest element 56 of the front leg frame 50.

The lower load-bearing footrest structure 30 comprises spaced side elements 34 and at least one cross-member 35. The lower load-bearing footrest structure side elements 34 are spaced more closely together than are the front leg frame side elements 54 and are spaced further apart than are the rear leg frame side elements 44. The lower load-bearing footrest structure 30 is disposed in generally horizontal orientation when this embodiment 16 of the invention is in use. This structure 30 is joined by aligned pivotal connecting means to the front leg frame 50 below the intersection of the front and rear leg frames 50, 40 generally near the lower ends of the front leg frame side elements 54 at a third pair of pivot points 32.5 located rearward of the forward end of the lower load-bearing footrest structure 30. This structure 30 is joined by aligned pivotal connecting means to the rear leg frame 40 below the intersection of the front and rear leg frames 50, 40 at a fourth pair of pivot points 31.5 located rearward of the third pair of pivot points 32.5 described above. The space between the lower load-bearing footrest structure side elements 34 is proportioned such that the inner lateral surfaces of these side elements 34 are generally adjacent the outer lateral surfaces of the rear leg frame side elements 44 at the fourth pair of pivot points 31.5 and such that the outer lateral surfaces of these side elements 34 are generally adjacent the inner lateral surfaces of the front leg frame side elements 54 at the third pair of pivot points 32.5.

The third and fourth pairs of pivot points 31.5, 32.5 divide the lower load-bearing footrest structure 30 into three load-sharing portions 31, 32, 33 thereof, these being the front lower load-sharing portion 33 located forward of the third pair of pivot points 32.5, the intermediate lower load-sharing portion 32 located between the third and fourth pairs of pivot points 31.5, 32.5, and the rear lower load-sharing portion 31 located rearward of the fourth pair of pivot points 31.5.

Relative placement of the third and fourth pairs of pivot points 31.5, 32.5 determines the spatial, angular, pivotal, and load-sharing relationships between the upper and lower load-bearing structures 20, 30 and between these structures 20, 30 and the backrest element 56 of the front leg frame 50.

Relative placements of the four pairs of pivot points 21.5, 22.5, 31.5, 32.5 described above are proportioned such that the structures 20, 30 and frames 60, 70 of the stationary chair 16 fold downward, the forward edge of the lower load-bearing footrest structure 30 approaching the supportive grounding surface 100, leaving the front leg frame 50 disposed in a generally vertical disposition and diminishing the lateral space occupied by the upper and lower load-bearing structures 20, 30 when the chair 16 is folded out of use.

The motion-governing, or tethering, means 60 comprise a tethering member 61, and a detachable upper tethering stop 62. The tethering member 61 extends between and joins the upper load-bearing seat structure 20 at a connection point 66 with the lower load-bearing footrest structure 40 at a connection point 67. The tethering member 61 is adapted to cooperate with a tethering stops 62 when the stationary chair 16 is in use. Connection points 66, 67 may be located so as to minimize variation in the distance between these connection points 66, 67, measured via the rear leg frame cross-member 45, as the constituent structures 20, 30 and front leg frame 50 move when the stationary chair 16 is in use or is folded out of use. Connection points 66, 67 may be located otherwise, as well, so as to regulate the effects of the tethering member 61 and of the upper tethering stop 62, cooperating with the rear leg frame cross-member 45, on the motion of the stationary chair 16 as the constituent structures 20, 30 and front leg frame 50 move when the stationary chair 16 is in use or is folded out of use. The tethering member 61 cooperates with the rear leg frame cross-member 45 intermediate the two connection points 66, 67 just referenced. The tethering member 61 cooperates with the rear leg frame cross-member 45 via the tethering stop 62 such that the constituent structures 20, 30 and the front leg frame 50 are suspended at a convenient operative position when the stationary chair 16 is in use. The tethering member 61 may also comprises elastic means 64 adapted to accommodate variations in the distance between connection points 66 and 67, measured via the rear leg frame cross-member 45, as the constituent structures 20, 30 and front leg frames 50 move when the chair 16 is in use or is folded out of use and adapted to afford elastic effects providing means by which the stationary chair 16 can return automatically to an intermediate operative position, or to another desired position, in the absence of weight and pressure forces acting to deflect the conformation of the stationary chair 16 away from such intermediate or other desired position as the constituent structures 20, 30, and front leg frames 50 move when the stationary chair 16 is in use or is folded out of use and also adapted to provide an elastic cushion in the suspension and operation of the constituent structures 20, 30 and front leg frame 50 of the stationary chair 16 when in use.

Figure 23:
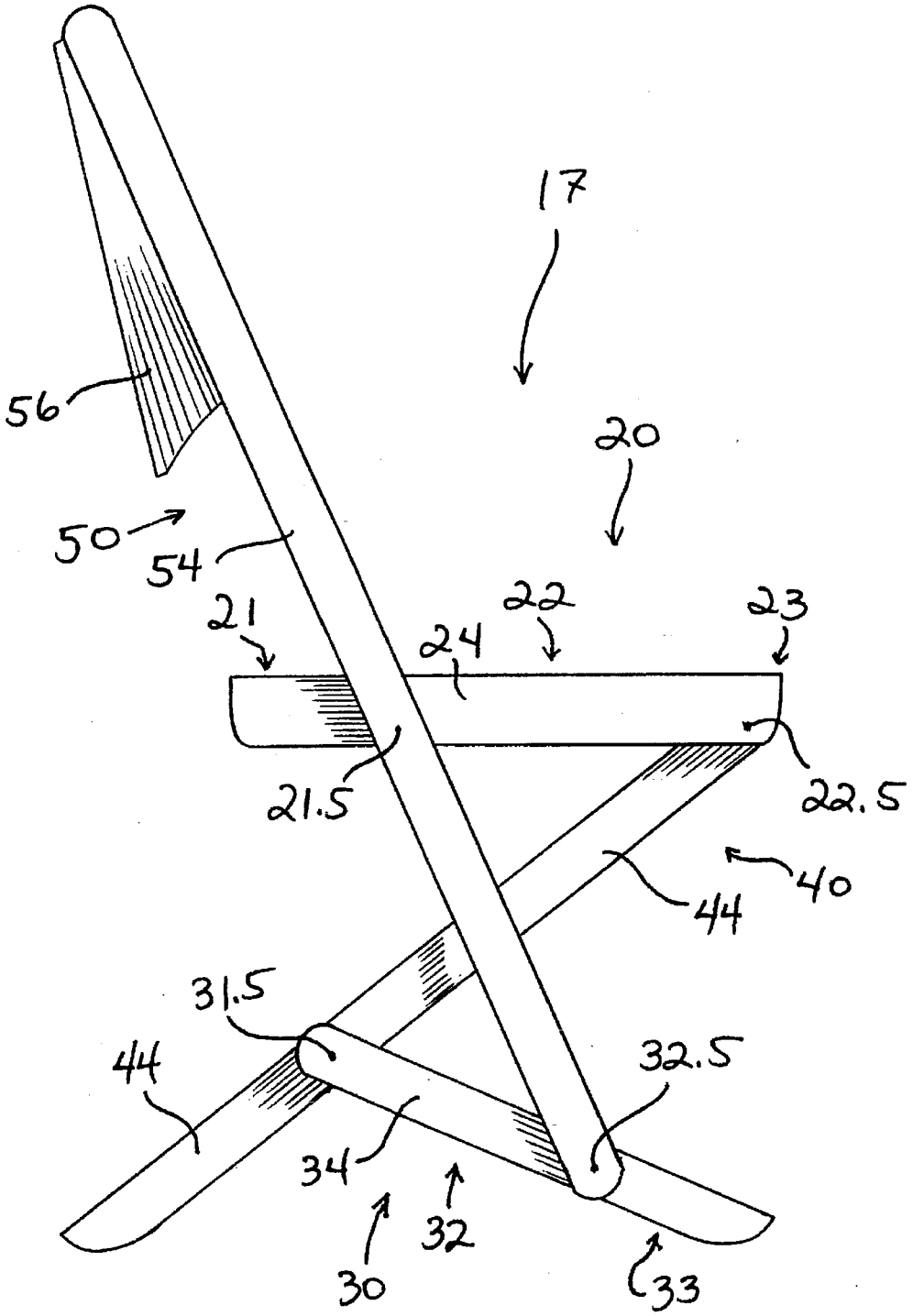
FIG. 23 is a side elevation drawing of a variant chair embodiment of the invention, having an abridged front leg frame and having the forward end of the lower load-bearing structure engaging the supportive grounding surface, shown here in an intermediate operative position.
Figure 23:
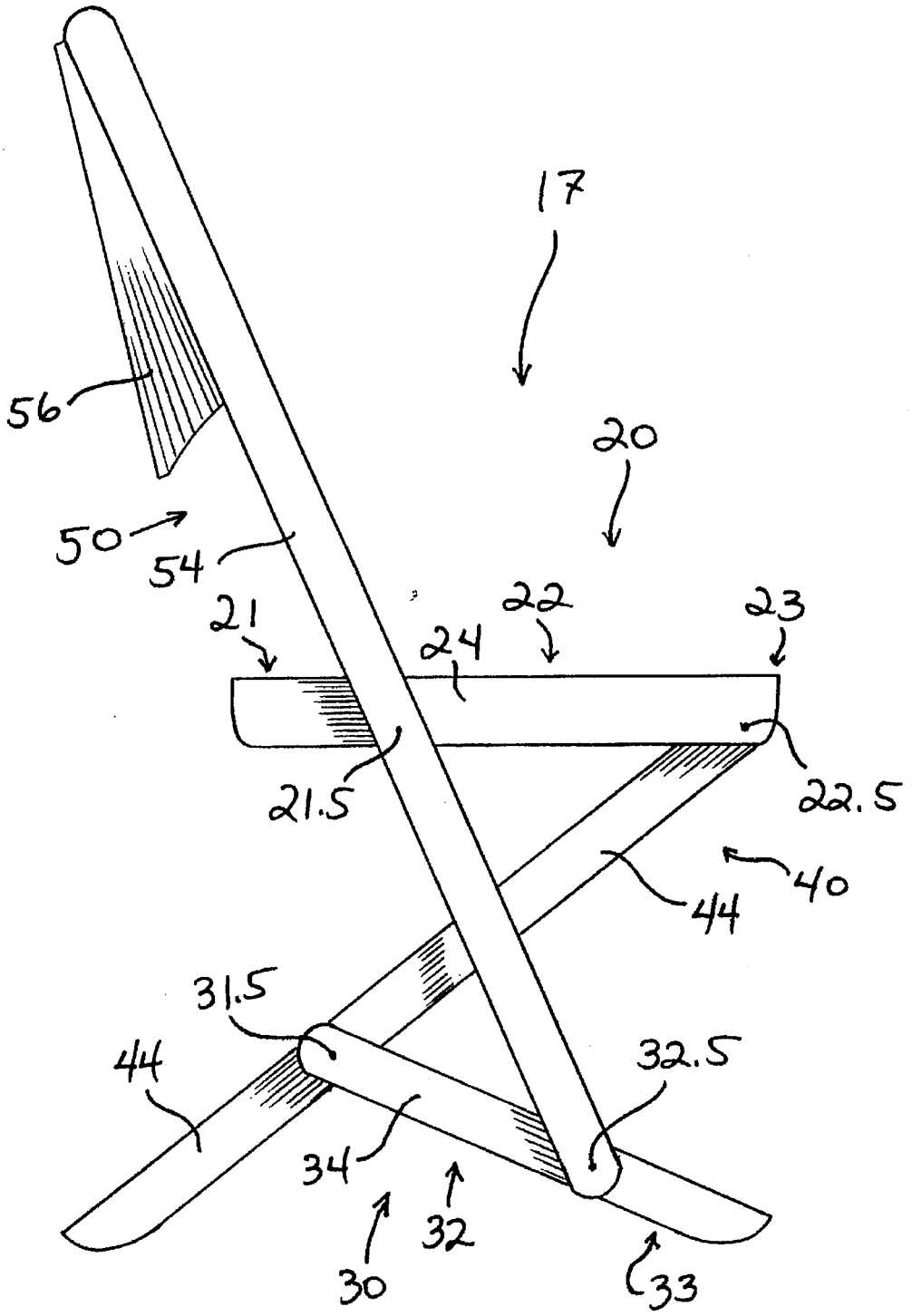
Figure 24:
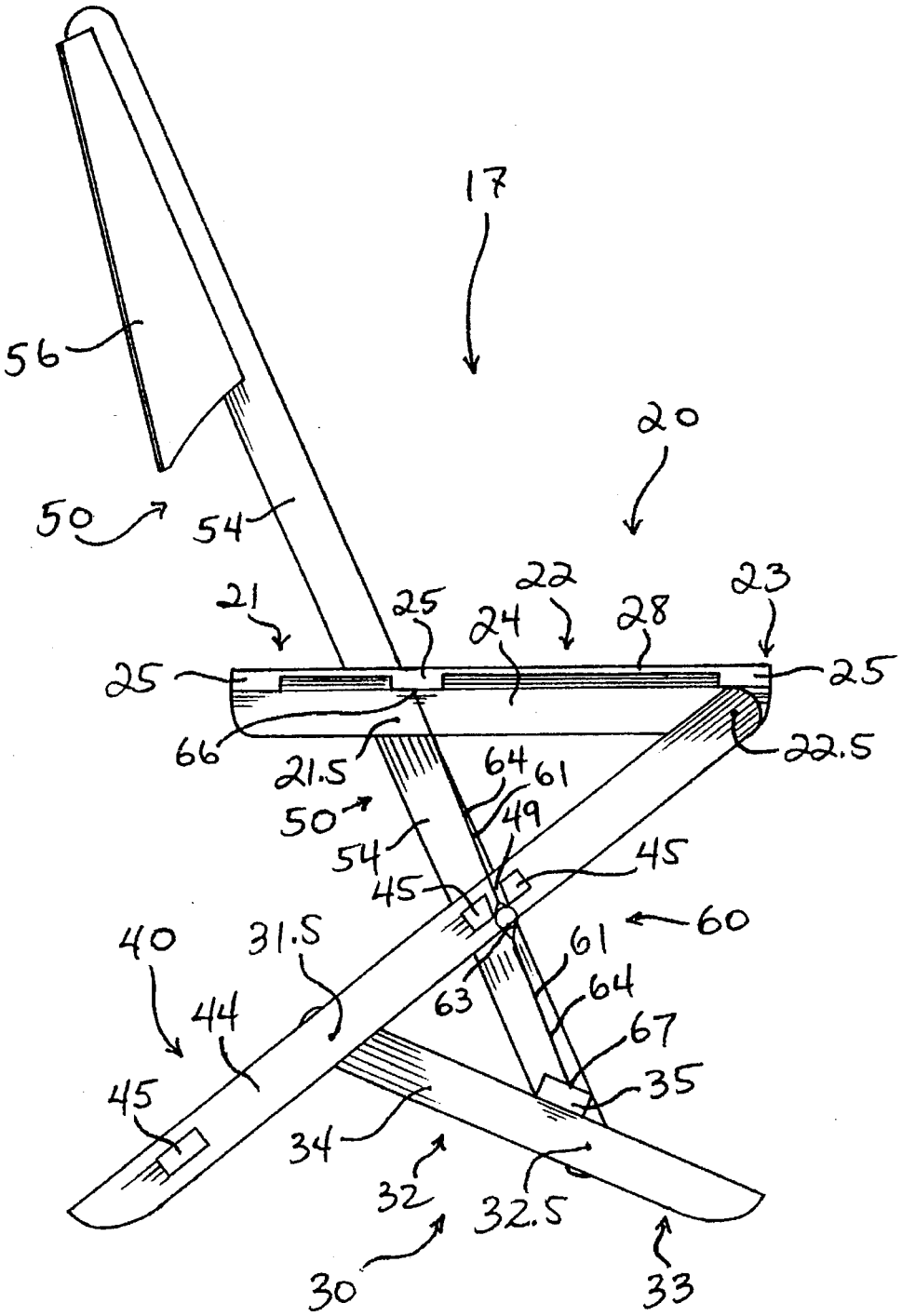
FIG. 24 is a cross-sectional side elevation drawing of a variant chair embodiment of the invention, having an abridged front leg frame and having the forward end of the lower load-bearing structure engaging the supportive grounding surface, shown here in an intermediate operative position.

FIGS. 23, and 24

The pivotally articulated foldable free-standing variant chair 17, comprises an upper load-bearing seat structure 20, a lower load-bearing structure 30, a rear leg frame 40, a front leg frame 50, whose upper cross-member 56 forms a backrest element 56 being disposed above and generally rearward of the upper load-bearing seat structure 20 when the variant chair 17 is in use, and motion-governing, or tethering, means 60 adapted to govern the relative pivotal motions of and the angular, spatial, and load-bearing relationships between the structures 20, 30 and frames 40, 50 listed above when the chair 17 is in use. The variant chair embodiment 17 of the invention is shown here in an intermediate operative position in which the upper load-bearing seat structure 20 is disposed in a generally horizontal disposition. However, the pivotal articulation of the chair 17 and the co-responsive load-distributing, balancing, load-reapportioning, and counterbalancing relationships between the upper and lower load-bearing structures 20, 30 and between the load-bearing seat structure 21, 22, 23, 32, 33 thereof allow the upper load-bearing seat structure 20 to move through a variety of reciprocal forwardly and rearwardly inclining positions, through a variety of angular, spatial, and pivotal relationships with the lower load-bearing structure 30 and with the front and rear leg frames 40, 50 and through a variety of angular, spatial, and pivotal interrelationships with the backrest element 56 of the front leg frame 50.

The front leg frame 50 comprises spaced side elements 54 and at least one cross-member 56. This frame 50 extends upwardly and rearwardly from its lower end. One or more cross-members 56 extend between and join the side elements 54 in the upper portion of the front leg frame 50 to form a backrest element 56 above and generally rearward of the upper load-bearing seat structure 20 when the chair 10 is in use.

The rear leg frame 40 comprises spaced side elements 44 and at least one cross-member 45. The rear leg frame side elements 44 are spaced more closely together than are the front leg frame side elements 54, thereby causing the rear leg frame 40 to be narrower than the front leg frame 50. The lower end of the rear leg frame 40 is disposed rearward of the lower end of the front leg frame 50 and extends upwardly and forwardly from its lower end to intersect the plane defined by the front leg frame 50 below the upper load-bearing seat structure 20, the rear leg frame side elements 44 being disposed between the front leg frame side elements 54. One or more rear leg frame cross-members 45 extend between and join the rear leg frame side elements 44 to form an integral frame 40. At least one of such cross-members 45 is adapted to cooperate with the tethering member 61 via the tethering stop 63.

The upper load-bearing seat structure 20 comprises spaced side elements 24, at least one cross-member 25, and one or more upper load-bearing seat surface elements 28. The upper load-bearing seat structure side elements 24 are spaced more closely together than are the front leg frame side elements 54 and are spaced farther apart than are the rear leg frame side elements 44. One or more upper load-bearing seat structure cross-members 25 extend between and join the upper load-bearing seat structure side elements 24, and the upper load-bearing seat structure surface elements 28 unite with the upper load-bearing seat structure side elements 24 and cross-members 25 to form an integral structure 20. The upper load-bearing seat structure surface elements 28 are proportioned to have width and length generally equal to or lesser than the width and length of the object formed by the union of the upper load-bearing seat structure side elements 24 and cross-members 25. The upper load-bearing seat structure 20 is disposed in generally horizontal orientation when this variant chair embodiment 17 of the invention is in use. This structure 20 is joined by aligned pivotal connecting means to the rear leg frame 40 above the intersection of the front and rear leg frames 50, 40 at a first pair of pivot points 22.5 located rearward of the forward end of the upper load-bearing seat structures 20. This structure 20 is joined by aligned pivotal connecting means to the front leg frame 50 above the intersection of the front and rear leg frames 50, 40 at a second pair of pivot points 21.5 rearward of the first pair of pivot points 22.5 described above. The space between the upper load-bearing seat structure side elements 24 is proportioned such that the outer lateral surfaces of these side elements 24 are generally adjacent the inner lateral surfaces of the front leg frame side elements 54 at the second pair of pivot points 21.5 and such that the inner later surfaces of these side elements 24 are generally adjacent the outer later surfaces of the rear leg frame side elements 44 at the first pair of pivot points 22.5.

The first and second pairs of pivot points 21.5, 22.5 divide the upper load-bearing seat structure 20 into three load-sharing portions 21, 22, 23 thereof, these being the rear upper load-sharing portion 21 located rearward of the second pair of pivot points 21.5, the front upper load-sharing portion 23 located forward of the first pair of pivot points 22.5, and the intermediate load-sharing portion 22 located between the first and second pairs of pivot points 21.5, 22.5.

Relative placement of the first and second pairs of pivot points 21.5, 22.5 determines the load-distributing, balancing, load-reapportioning, and counterbalancing relationships between the front, intermediate, and rear load-snaring portions 23, 22, 21 of the upper load-bearing seat structure 20, and also determines the spatial, angular, pivotal, load-distributing, balancing, load-reapportioning, and counterbalancing relationships between the load-sharing portions 21, 22, 23 of this structure 20 and the load-sharing portions 32, 33 of the lower load-bearing structure 30 and between the upper and lower load-bearing structures 20, 30 and the front and rear leg frames 40, 50. Placement of the second pair of pivot points 21.5 determines the spatial, angular, pivotal, and load-sharing relationships between the upper load-bearing seat structure 20 and the backrest element 56 of the from leg frame 50.

The lower load-bearing structure 30 comprises spaced side elements 34 and at least one cross-member 35. The lower load-bearing structure side elements 34 are spaced more closely together than are the front leg frame side elements 54 and are spaced farther apart than are the rear leg frame side elements 44. The lower load-bearing structure 30 is inclined downwardly toward the forward end of that structure 30 when this variant chair embodiment 17 of the invention is in use. This structure 30 is joined by aligned pivotal connecting means to the front leg frame 50 below the intersection of the front and rear leg frames 50, 40 at a third pair of pivot points 32.5 located rearward of the forward end of the lower load-bearing footrest structure 30. This structure 30 is joined by aligned pivotal connecting means to the rear leg frame 40 below the intersection of the front and rear leg frames 50, 40 at a fourth pair of pivot points 31.5 located rearward of the third pair of pivot points 32.5 described above. The space between the lower load-bearing footrest structure side elements 34 is proportioned such that the inner lateral surfaces of these side elements 34 are generally adjacent the outer surfaces of the rear leg frame side elements 44 at the fourth pair of pivot points 31.5 and such that the outer lateral surfaces of these side elements 34 are generally adjacent the inner lateral surfaces of the front leg frame side elements 54 at the third pair of pivot points 32.5.

The third and fourth pairs of pivot points 31.5, 32.5 divided the lower load-bearing structure 30 into three load-sharing portions 31, 32, 33 thereof, these being the front lower load-sharing portion 33 located forward of the third pair of pivot points 32.5, the intermediate lower load-sharing portion 32 located between the third and fourth pairs of pivot points 31.5, 32.5, and the rear lower load-sharing portion 31 located rearward of the fourth pair of pivot points 31.5.

Relative placement of these third and fourth pairs of pivot points 31.5, 32.5 determines the load-distributing, balancing, load-reapportioning, and counterbalancing relationships between the front, intermediate, and rear load-sharing portions 31, 32, 33 of the lower load-bearing structure 30, and also determines the spatial, angular, pivotal, load-distributing, balancing, load-reapportioning, and counterbalancing relationships between the load-sharing portions 31, 32, 33 of this structure 30, and the load-sharing portions 21, 22, 23 of the upper load-bearing seat structure 20 and between the upper and lower load-bearing structures 20, 30 and the backrest element 56.

Relative placement of the four pairs of pivot points 21.5, 22.5, 31.5, 32.5 described above, the dimensions of the front, intermediate, and rear load-sharing portions 21, 22, 23 of the upper load-bearing seat structure 20, the dimensions of the front, intermediate, and rear load-sharing portions 31, 32, 33 of the lower load-bearing structure 30, and the relationships between these dimensions and the relative placement of the four pairs of pivot points 21.5, 22.5, 31.5, 32.5 are proportioned such that the structures 20, 30, the frames 40, 50, and the four pair of pivot points 21.5, 22.5, 31.5, 32.5 of the chair 17 lie together substantially in a common plane when the chair 17 is folded out of use.

The motion-governing, or tethering, means 60 comprise a tethering member 61 and a detachable lower tethering stop 63. The tethering member 61 extends between and joins the upper load-bearing seat structure 20, at connection points 66, with the lower load-bearing footrest structure 30, at connection point 67. The tethering member 61 is adapted to cooperate with a stop 63 when the chair 17 is in use. Connection points 66, 67 may be located so as to minimize variation in the distance between these connection points 66, 67, measured via the rear leg frame cross-member 45, as the constituent structures 20, 30 and frames 40, 50 move when the variant chair 17 is in use or is folded out of use. Connection points 66, 67 may be located otherwise, as well, so as to regulate the effects of the tethering member 61 and of the lower tethering stop 63, cooperating with the rear leg frame cross-member 45, on the motion of the chair 17 as the constituent structures 20, 30 and frames 40, 50 move when the chair 17 is in use or is folded out of use. The tethering member 61 cooperates with the rear leg frame cross-member 45 intermediate the two connection points 66, 67 just referenced. At appropriate degrees of forward variation in the conformation of the chair 17, the tethering member 61 cooperates with the rear leg frame cross member 45 via the lower tethering stop 63 to limit forward variation when the chair 10 is in use. The tethering member 61 may also comprise elastic means 64 adapted to accommodate variations in the distance between the connection points 66 and 67, measured via the rear leg frame cross-member 45, as the constituent structures 20, 30 and frames 40, 50 move when the chair 17 is in use or is folded out of use and adapted to afford elastic effects providing means by which the chair 17 can return automatically to an intermediate operative position, or to another desired position, in the absences of weight and pressure forces acting to deflect the conformation of the chair 17 away from such intermediate or other desired position as the constituent structures 20, 30 and frames 40, 50 move when the chair 17 is in use or is folded out of use.

Figure 25:
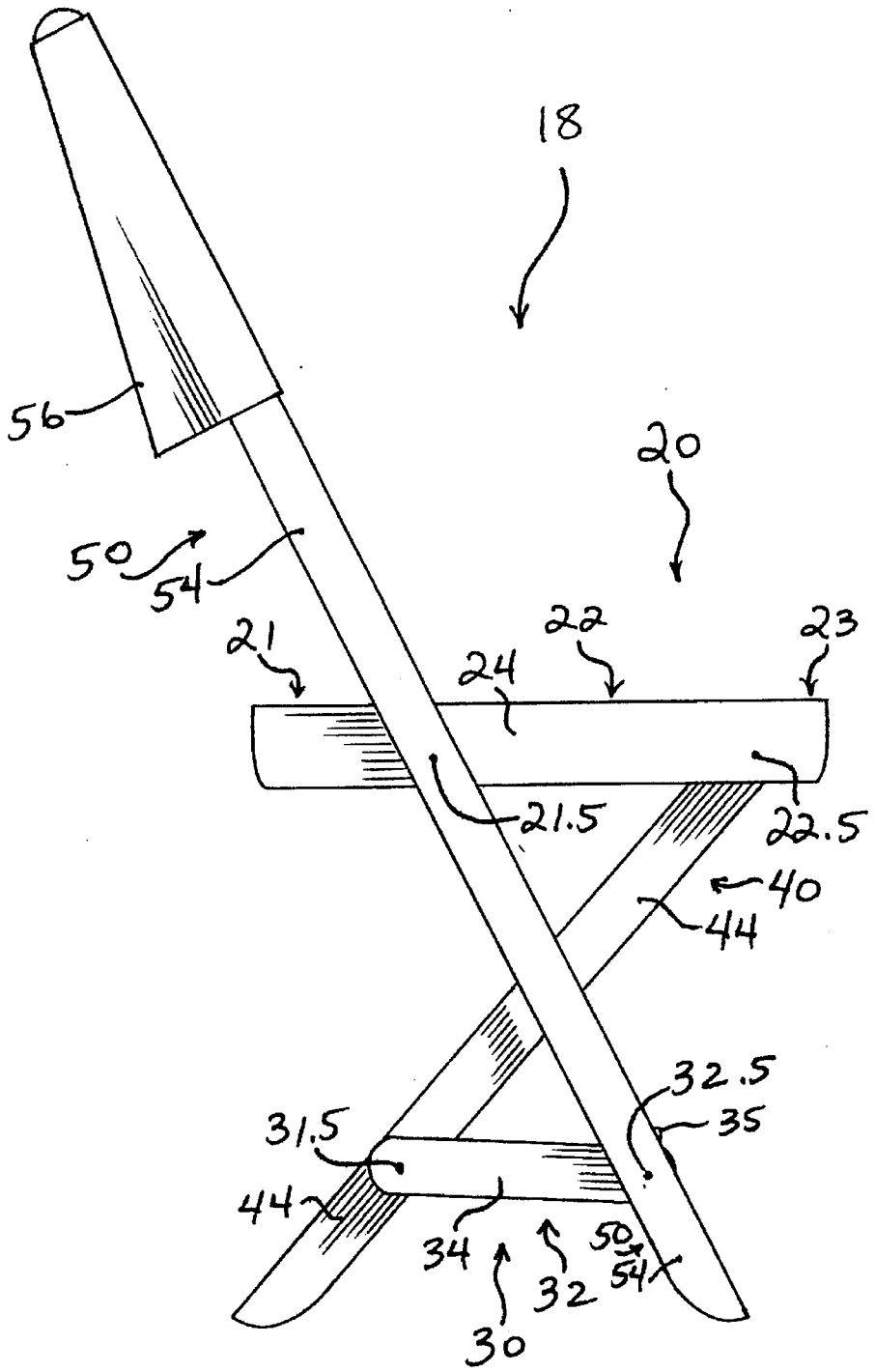
FIG. 25 is a side elevation drawing of a variant chair embodiment of the invention, having an abridged lower load-bearing structure, shown here in an intermediate operative position.
Figure 26:
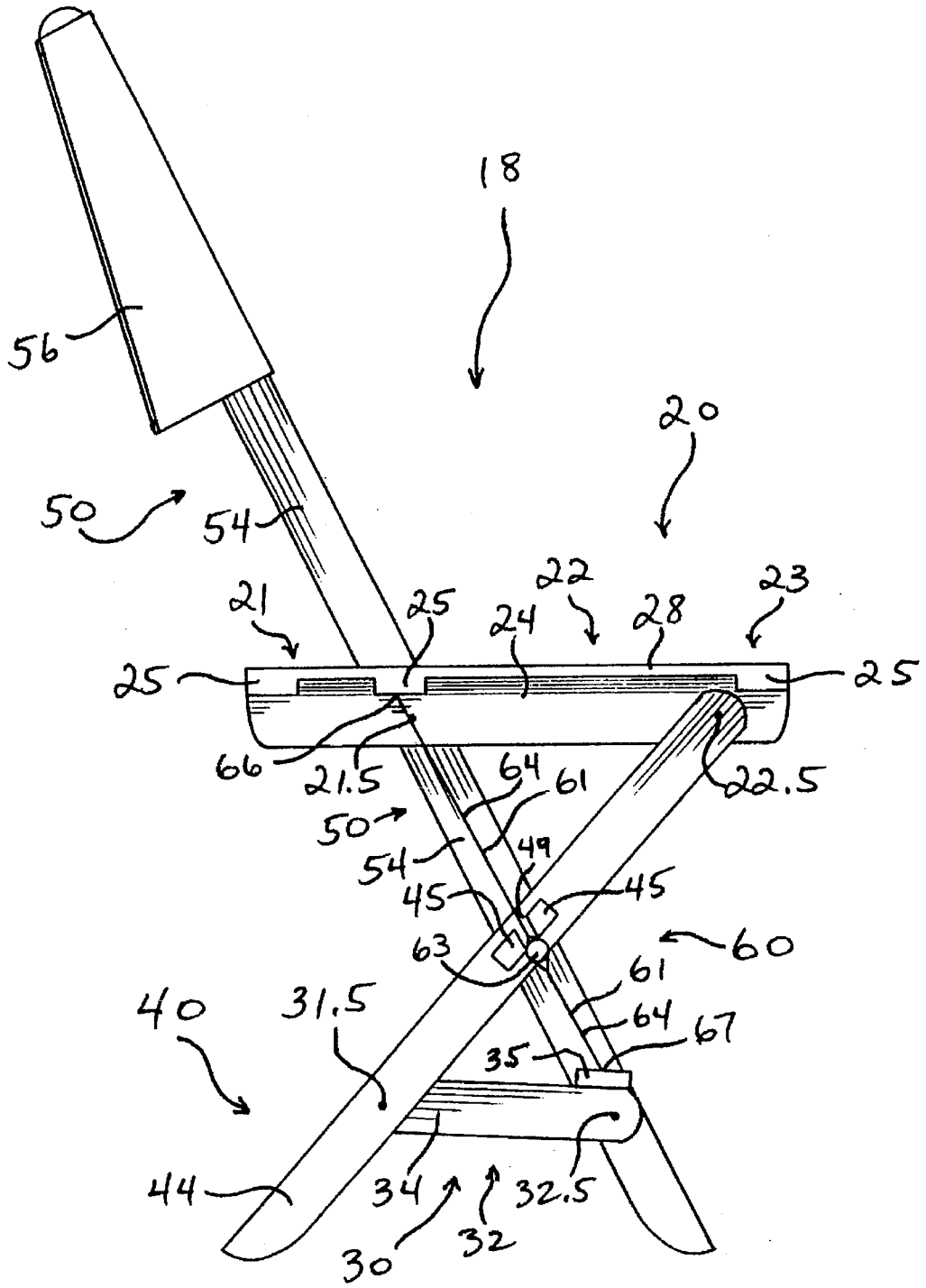
FIG. 26 is a cross-sectional side elevation drawing of a variant chair embodiment of the invention, having an abridged lower load-bearing structure, shown here in an intermediate operative position.

FIGS. 25, and 26

The pivotally articulated foldable free-standing variant chair 18, comprises an upper load-bearing seat structure 20, a lower load-bearing structure 30, a rear leg frame 40, a front leg frame 50, whose upper cross-member 56 forms a backrest element 56 being disposed above and generally rearward of the upper load-bearing seat structure 20 when the variant chair 18 is in use, and motion-governing, or tethering, means 60 adapted to govern the relative pivotal motions of and the angular, spatial, and load-bearing relationships between the structures 20, 30 and frames 40, 50 listed above when the chair 18 is in use. The variant chair 18 embodiment of the invention is shown here in an intermediate operative position in which the upper load-bearing seat structure 20 is disposed in a generally horizontal disposition. However, the pivotal articulation of the chair 18 and the co-responsive load-distributing, balancing, load-reapportioning, and counterbalancing relationships between the load-sharing portions 21, 22, 23 of the upper load-bearing seat structure 20 allow that structure 20 and the load-sharing portions thereof 21, 22, 23 to move through a variety of forwardly and rearwardly inclining positions, and through a variety of angular, spatial, and pivotal interrelationships with the front and rear leg frames 40, 50 and with the backrest element 56.

The front leg frame 50 comprises spaced side elements 54 and at least one cross-member 56 and extends upwardly and rearwardly from its lower end. One or more cross-members 56 extend between and join the side elements 54 in the upper portion of the front leg frame 50 to form a backrest element 56 above and generally rearward of the upper load-bearing seat structure 20 when the chair 10 is in use.

The rear leg frame 40 comprises spaced side elements 44 and at least one cross-member 45. The rear leg frame side elements 44 are spaced more closely together than are the front leg frame side elements 54, thereby causing the rear leg frame 60 to be narrower than the front leg frame 50. The lower end of the rear leg frame 40 is disposed rearward of the lower end of the front leg frame 50 and extends upwardly and forwardly from its lower end to intersect the plane defined by the front leg frame 50 below the upper load-bearing seat structure 20, the rear leg frame side elements 44 being disposed between the front leg frame side elements 54. One or more upper rear leg frame upper cross-members 45 extend between and join the rear leg frame side elements 44 to form an integral frame 40. At least one of such cross-members 45 is adapted to cooperate with the tethering member 61 via the tethering stop 63.

The upper load-bearing seat structure 20 comprises spaced side elements 24, at least one cross-member 25, and one or more upper load-bearing seat surface elements 28. The upper load-bearing seat structure side elements 24 are spaced more closely together than are the front leg frame side elements 54 and are spaced farther apart than are the rear leg frame side elements 44. One or more upper load-bearing seat structure cross-members 25 extend between and join the upper load-bearing seat structure side elements 24, and the upper load-bearing seat structure surface elements 28 unite with the upper load-bearing seat structure side elements 24 and cross-members 25 to form an integral structure 20. The upper load-bearing seat structure surface elements 28 are proportioned to have width and length generally equal to or lesser than the width and length of the object formed by the union of the upper load-bearing seat structure side elements 24 and cross-members 25. The upper load-bearing seat structure 20 is disposed in generally horizontal orientation when this variant chair embodiment 18 of the invention is in use. This structure 20 is joined by aligned pivotal connecting means to the rear leg frame 40 above the intersection of the front and rear leg frames 50, 40 at a first pair of pivot points 22.5 located rearward of the forward end of the upper load-bearing seat structure 20. This structure 20 is joined by aligned pivotal connecting means to the front leg frame 50 above the intersection of the front and rear leg frames 50, 40 at a second pair of pivot points 21.5 rearward of the first pair of pivot points 22.5 described above. The space between the upper load-bearing seat structure side elements 24 is proportioned such that the outer lateral surfaces of these side elements 24 are generally adjacent the inner lateral surfaces of the front leg frame side elements 54 at the second pair of pivot points 21.5 and such that the inner later surfaces of these side elements 24 are generally adjacent the outer lateral surfaces of the rear leg frame side elements 44 at the first pair of pivot points 22.5.

The first and second pairs of pivot points 21.5, 22.5 divide the upper load-bearing seat structure 20 into three load-sharing portions 21, 22, 23 thereof, these being the rear upper load-sharing portion 21 located rearward of the second pair of pivot points 21.5, the front upper load-sharing portion 23 located forward of the first pair of pivot points 22.5, and the intermediate load-sharing portion 22 located between the first and second pairs of pivot points 21.5, 22.5.

Relative placement of the first and second pairs of pivot points 21.5, 22.5 determines the load-distributing, balancing, load-reapportioning, and counterbalancing relationships between the front, intermediate, and rear load-sharing portions 23, 22, 21 of the upper load-bearing seat structure 20, and also determines the spatial, angular, pivotal, load-distributing, balancing, load-reapportioning, and counterbalancing relationships between the load-sharing portions 21, 22, 23 of this structure 20 and between these load-sharing portions and the front and rear leg frames 40, 50. Placement of the second pair of pivot points 21.5 also determines the spatial, angular, pivotal, and load-sharing relationships between the upper load-bearing seat structure 20 and the backrest element 56 of the front leg frame 50.

The lower load-bearing structure 30 comprises spaced side elements 34 and at least one cross-member 35. The lower load-bearing structure side elements 34 are spaced more closely together than are the front leg frame side elements 54 and are spaced farther apart than are the rear leg frame side elements 44. The lower load-bearing structure 30 is disposed in generally horizontal orientation when this variant chair embodiment 18 of the invention is in use. This structure 30 is joined by aligned pivotal connecting means to the front leg frame 50 below the intersection of the front and rear leg frames 50, 40 at a third pair of pivot points 32.5 located rearward of the forward end of the lower load-bearing structure 30. This structure 30 is joined by aligned pivotal connecting means to the rear leg frame 40 below the intersection of the front and rear leg frames 50, 40 at a fourth pair of pivot points 31.5 located rearward of the third pair of pivot points 32.5 described above. The space between the lower load-bearing footrest structure side elements 34 is proportioned such that the inner lateral surfaces of these side elements 34 are generally adjacent the outer surfaces of the rear leg frame side elements 44 at the fourth pair of pivot points 31.5 and such that the outer lateral surfaces of these side elements 34 are generally adjacent the inner lateral surfaces of the front leg frame side elements 54 at the third pair of pivot points 32.5.

The third and fourth pairs of pivot points 31.5, 32.5, divide the lower load-bearing structure 30 into three load-sharing portions 31, 32, 33 thereof, these being the front load-sharing portion 33 located forward of the third pair of pivot points 32.5, the intermediate load-sharing portion 32 located between the third and fourth pairs of pivot points 31.5, 32.5, and the rear lower load-sharing portion 31 located rearward of the fourth pair of pivot points 31.5.

Relative placement of these third and fourth pairs of pivot points 31.5, 32.5 determines the spatial, angular, pivotal, load-distributing, and balancing relationships between the structures 20, 30 and frames 40, 50 and between these structures 20, 30 and frames 40, 50 and the backrest element 56.

Relative placement of the four pairs of pivot points 21.5, 22.5, 31.5, 32.5 described above, the dimensions of the front, intermediate, and rear load-sharing portions 21, 22, 23 of the upper load-bearing seat structure 20, the dimensions of the front, intermediate, and rear load-sharing portions 31, 32, 33, of the lower load-bearing structure 30, and the relationships between these dimensions and the relative placement of the four pairs of pivot points 21.5, 22.5, 31.5, 32.5 are proportioned such that the structures 20, 30, the frames 40, 50, and the four pair of pivot points 21.5, 22.5, 31.5, 32.5 of the chair 18 lie together substantially in a common plane when the chair 18 is folded out of use.

The motion-governing, or tethering, means 60 comprise a tethering member 61 and a detachable lower tethering stop 63. The tethering member 61 extends between and joins the upper load-bearing seat structure 20, at connection point 66, with the lower load-bearing footrest structure 30, at connection point 67. The tethering member 61 is adapted to cooperate with a stop 63 when the chair 18 is in use. Connection points 66, 67 may be located so as to minimize variation in the distance between these connection points 66, 67, measured via the rear leg frame cross-member 45, as the constituent structure 20, 30 and frames 40, 50 move when the variant chair 18 is in use or is folded out of use. Connection points 66, 67 may be located otherwise as well, so as to regulate the effects of the tethering member 61 and of the lower tethering stop 63, cooperating with the rear leg frame cross-member 45, on the motion of the chair 18 as the constituent structures 20, 30 and frames 40, 50 move when the chair 18 is in use or is folded out of use. The tethering member 61 cooperates with the rear leg frame cross-member 45 intermediate the two connection points 66, 67 just referenced. At appropriate degrees of forward variation in the conformation of the chair 18, the tethering member 61 cooperates with the rear leg frame cross member 45 via the lower tethering stop 63 to limit forward variation when the chair 18 is in use. The tethering member 61 may also comprise elastic means 64 adapted to accommodate variations in the distance between connection points 66 and 67, measured via the rear leg frame cross-member 45, as the constituent structures 20, 30 and frames 40, 50 move when the chair 18 is in use or is folded out of use and adapted to afford elastic effects providing means by which the chair 18 can return automatically to an intermediate operative position, or to another desired position, in the absences of weight and pressure forces acting to deflect the conformation of the chair 18 away from such intermediate or other desired position as the constituent structures 20, 30 and frames 40, 50 move when the chair 18 is in use or is folded out of use.

FIGS. 22, 24, and 26

FIGS. 22, 24, and 26 show variant embodiments 16, 17, and 18 of the invention in which the tethering member 61 cooperates with the rear leg frame cross-member 45 via a single tethering stop 62 or 63 to regulate the relative pivotal motion of the invention when in operation. In order to simplify construction and operation of these variant embodiments 16, 17, and 18 of the invention, the tethering member 61 may be made to cooperate directly with the rear leg frame cross-member 45, that cross-member 45 then serving as the single tethering stop 62 or 63, so that the portion of the tethering member 61 under tension at the limited extent of pivotal motion of the invention is detachably connected with the rear leg frame cross-member 45, while the portion of the tethering member 61 not under tension at the limited extent of pivotal motion of the invention is absent. That is, in such case, viewing the variant embodiment 16 of the invention shown in FIG. 22, the central upper load-bearing structure cross-member 25, the tethering stop 62, and the portion of the tethering member 61 above the rear leg frame cross-member 45 are absent, and the upper end of the portion of the tethering member 61 below the rear leg frame cross-member 45 is detachably connected with that cross-member 45, that cross-member 45 thereby serving as a tethering stop 45. Also in such case, viewing the variant embodiments 17, 18 of the invention shown in FIGS. 24 and 26, in each instance, the tethering stop 62 and the portion of the tethering member 61 below the rear leg frame cross-member 45 are absent, and the lower end of the portion of the tethering member 61 above the rear leg frame cross-member 45 is detachably connected with that cross-member 45, that cross-member 45 thereby serving as a tethering stop 45.

DESCRIPTION OF THE PRESENTLY PREFERRED EMBODIMENT

Operation

FIGS. 1, 12, 13, 14, 15

Figure 14:
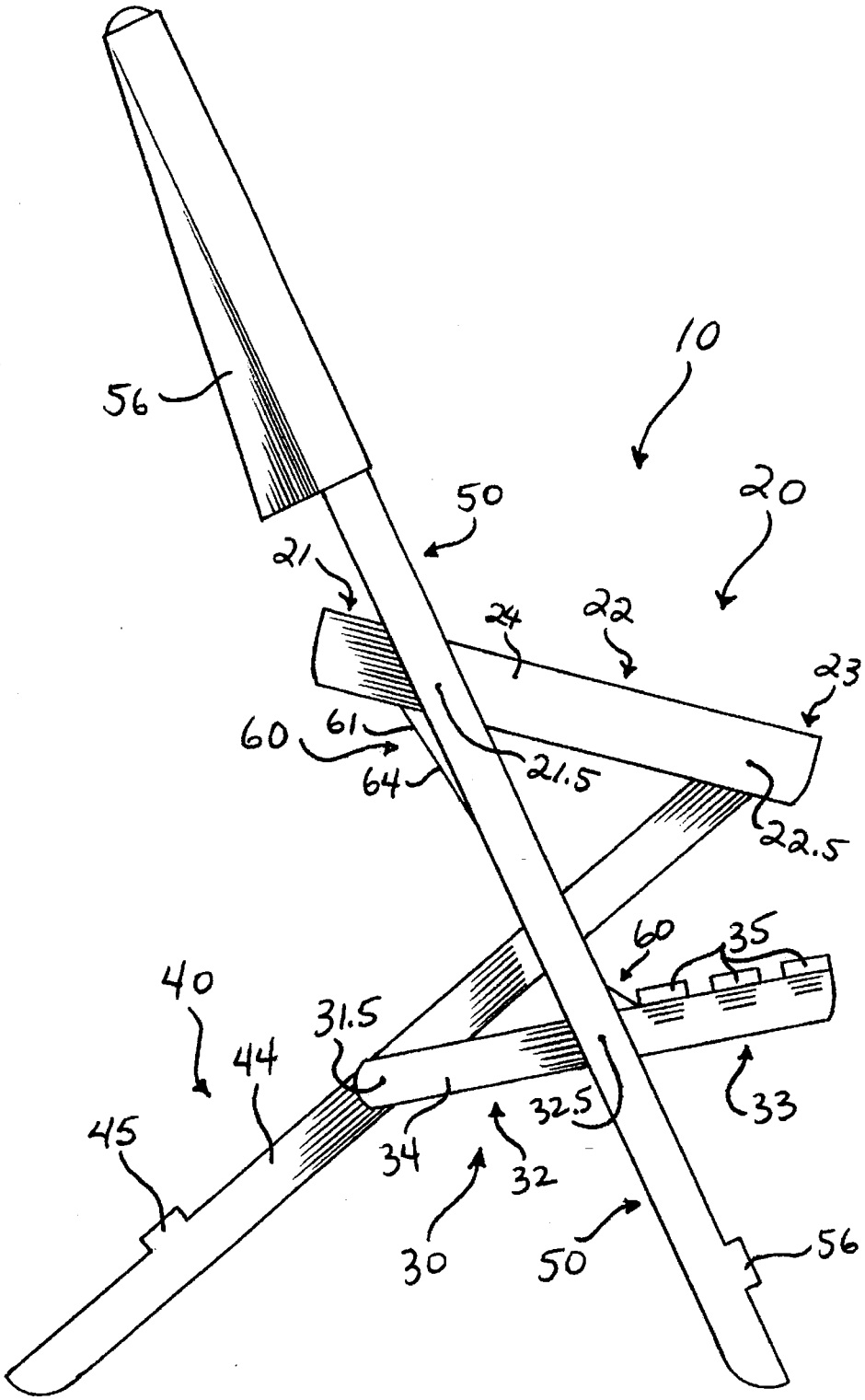
FIG. 14 is a side elevation drawing of the free-standing chair embodiment of the invention, having a single-footrest structure, shown here in a forwardly inclined operative position such that the seat structure is inclined forwardly with respect to its substantially horizontal intermediate operative position.

FIG. 14 shows the free-standing chair embodiment 10 of the invention with the upper load-bearing seat structure 20 in a generally forwardly and downwardly inclination relative to the generally horizontal disposition of that structure 20 in the intermediate operative position of the chair 10, as shown in FIGS. 12 and 13. As shown in FIG. 14, the internal pivotal movements of the constituent structures 20, 30 and frames 40, 50 of the chair 10 are limited at the depicted stage of forwardly, downwardly inclination of the seat structure 20 by the cooperation of the tethering member 61, via the lower tethering stop 63, with the rear leg frame upper cross-member 45, by which means further forwardly, downwardly movement of the seat structure 20 is substantially prevented, although elastic means 64 in the tethering member 61 afford some degree of further, though substantially limited, forward movement. Again with reference to FIGS. 12 and 13, a user of this free-standing chair embodiment 10 of the invention would effect such movement of the upper load-bearing seat structure 20 from the generally horizontal disposition of that structure 20 in the intermediate operative position, as shown in FIGS. 12 and 13, to the forwardly and downwardly inclined position, as shown in FIG. 14, by reducing the weight-and-pressure load applied to the front load-sharing portion 33 of the lower load-bearing footrest structure 30, that is for example, by lifting one foot off of the lower load-bearing footrest structure cross-members 35 and decreasing the weight and pressure applied on those cross-members 35 by the other foot, and by increasing the weight-and-pressure load applied to the front and intermediate load-snaring portion 23, 22 of the upper load-bearing seat structure 20, that is for example, by allowing the weight and pressure of the foot and leg removed from the lower load-bearing footrest structure cross-members 35 to bear fully on the front load-sharing portion 23 of the upper load-bearing seat structure 20 and by shifting some of the weight of the user's torso and of the other leg and foot to bear upon the intermediate load-sharing portion 22 of the upper load-bearing seat structure 20. In this way the front and intermediate load-sharing portions 23, 22 of the upper load-bearing seat structure 20 are moved forwardly and downwardly and the front load-sharing portion 33 of the lower load-bearing footrest structure 30 is moved upwardly until the desired relative angular and spatial dispositions of these structures 20, 30, and the desired relationships between these structures 20, 30 and the backrest element 56 is achieved, or until cooperation of the tethering member 61, via the lower tethering stop 63, with the rear leg frame cross-member 45 substantially limits further movement in this direction. In this position, the user of the chair has shifted a portion of his/her weight further forward on the upper load-bearing structures 20, that is, away from the rear load-sharing portion 21 of the upper load-bearing seat structure 20 and onto the intermediate and front load-sharing portions 22, 23 of that structure 20, and has relaxed weights and pressures from the front load-sharing portion 33 of the lower load-bearing footrest structure 30, to assume the posture, for example, of an artist while closely examining a drawing placed on the working surface of the drafting table 12 shown in FIGS. 4, 5, 6, and 7. By manipulating variable weights and pressures on the load-sharing portions 32, 33 of the lower load-bearing footrest structure 30, through one or both feet bearing on the footrest cross-members 35, and by balancing and counterbalancing these weights and pressures on the footrest structure 30 with shifts in the weights and pressures applied to the load-sharing portions 21, 22, 23 of the upper load-bearing seat structure 20, the user can spontaneously adjust the relative angular and spatial relationships of the structures 20, 30, the frames 40, 50, and the backrest element 56 of the chair 10, and in fact can spontaneously and subtly adjust the shape of the chair 10, to accomodate an implicitly variable array of sitting postures while all parts of the body are fully, continuously, and securely supported by the seat and footrest structures 20, 30 and by the backrest element 56 of the chair 10.

In addition, with both feet removed from the footrest structure 30, the user easily exits the chair 10, even if the height of the seat surface elements 28 exceeds the length of the user's legs, as is often the case with stools and chairs used at service counters and elevated working surfaces, such as drafting tables.

Likewise, in such a circumstance, the user can easily enter the chair 10 by sitting first on the forwardly and downwardly inclined upper load-bearing seat structure 20 while applying a modest weight-and-pressure load to the front load-sharing portion 33 of the lower load-bearing footrest structure 30, thereby moving the front and intermediate load-sharing portions 23, 22 of the upper load-bearing seat structure 20 upward while moving the front load-sharing portion 33 of the lower load-bearing footrest structure 30 downward. As this is done, the user shifts the weight-and-pressure load bearing on the upper load-bearing seat structure 20 rearwardly, placing a larger fraction of the gross load bearing on that structure 20 onto the rear load-sharing portion 21 of that structure 20 and onto the backrest element 56 of the front leg frame 50, while moderating the weight-and-pressure load applied by the feet and legs to the front load-sharing portion 33 of the lower load-bearing footrest structure 30 to be just that needed to counterbalance the fractional weight-and-pressure load bearing on the front and intermediate load-sharing portions 23, 22 of the upper load-bearing seat structure 20. In this same way, the angular and spatial relationships between the structures 20, 30, the frames 40, 50, and the backrest element 56, such as the vertical distance between the front load-sharing portions 23, 33 of the upper and lower load-bearing structures 20, 30, and the angular relationship between the backrest element 56 and the upper load-bearing seat structure 20, are spontaneously and implicitly altered and adjusted to suit the proportions, postures, and actions of the user of the chair 10.

It may be seen that the load-bearing structures 20, 30 and the the load-sharing portions 21, 22, 23, 32, 33 thereof, implicitly interact and spontaneously co-respond with the leg frames 40, 50 and the backrest element 56 of the chair 10 to fully support all parts of the user's body through dynamic spatial, angular, and dimensional relationships peculiar to the specific posture, proportions, and movements of each user. Thereby, these load-bearing structures 20, 30 and integrating leg frames 40, 50, and their constituent parts, when proportioned and pivotally linked to form the chair embodiment 10 of this invention, become a uniquely flexible, responsive, and comfortable mechanism that implicitly assumes the shape and dynamic character of its user.

Figure 15:
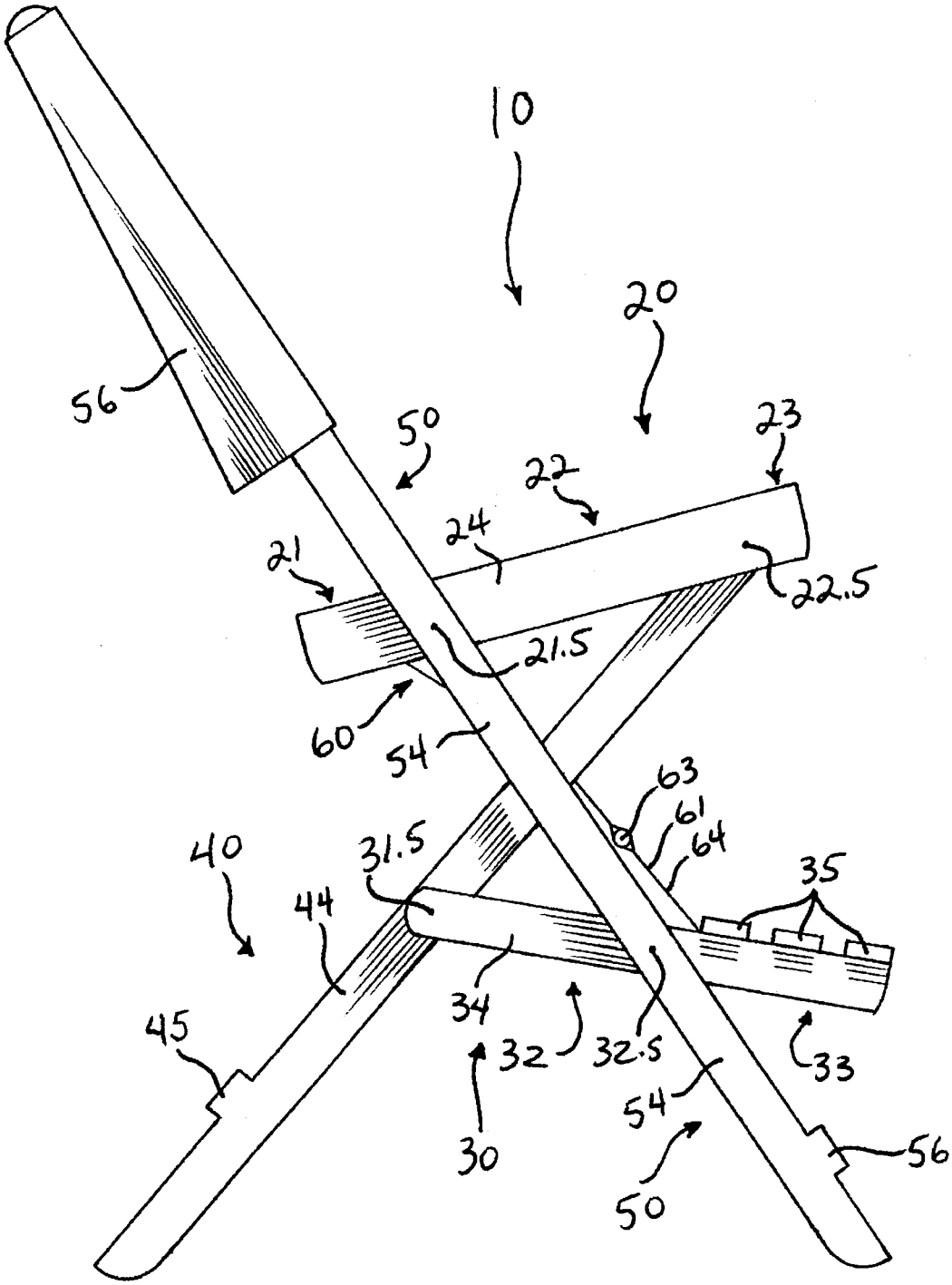
FIG. 15 is a side elevation drawing of the free-standing chair embodiment of the invention, having a single-footrest structure, shown here in a normal operative position in which a users would be fully supported in a restful posture.

FIG. 15 shows the normal conformation of the free-standing chair embodiment 10 of the invention when occupied by a user of average height and normal proportions when the user is at rest after entering the chair 10, as described above, with the back resting comfortably against and applying part of the weight of the head, shoulders, and torso against the backrest element 56. The torso, hips, and to some extent the thighs convey a considerable part of the weight of the body onto the rear load-sharing portion 21 of the upper load-bearing seat structure 20, and the legs apply their weight and pressure to the front and intermediate load-sharing portions 23, 22 of the upper load-bearing seat structure 20. The lower legs and feet convey a highly variable weight-and-pressure load to the front load-sharing portion 33 of the lower load-bearing footrest structure 30. In this light, it should be emphasized that the user's thighs effectively extend the pivotal leverage of the front load-sharing portion 23 of the upper load-bearing seat structure 20 by a dimension equal to the distance between the first pair of pivot points 22.5 and the user's knee. It can be seen that this distance, and the degree of leverage extension, can be highly variable. In this way, the user can significantly enhance the influence of the lower legs and feet in manipulating the weight-and-pressure distributing, balancing, and counterbalancing relationships between the load-sharing portions 21, 22, 23, 32, 33 of the upper and lower load-bearing structures 20, 30.

It can be seen with reference to FIG. 15 that the spatial, angular, and proportional relationships between the load-bearing structures 20, 30, the load-sharing portions 21, 22, 23, 32, 33 thereof, and the integrating frames 40, 50 are well suited to the highly variable shapes, proportions, and postures of the human body and are well adapted to the spontaneous accommodation of highly dynamic variations in these shapes, proportions, and postures.

In this way, the chair 10 is uniquely adapted to provide uniquely comfortable support for the body both in quiet restfulness and in dynamic action, such as use of the chair 10 at the drafting table 12.

Figure 16:
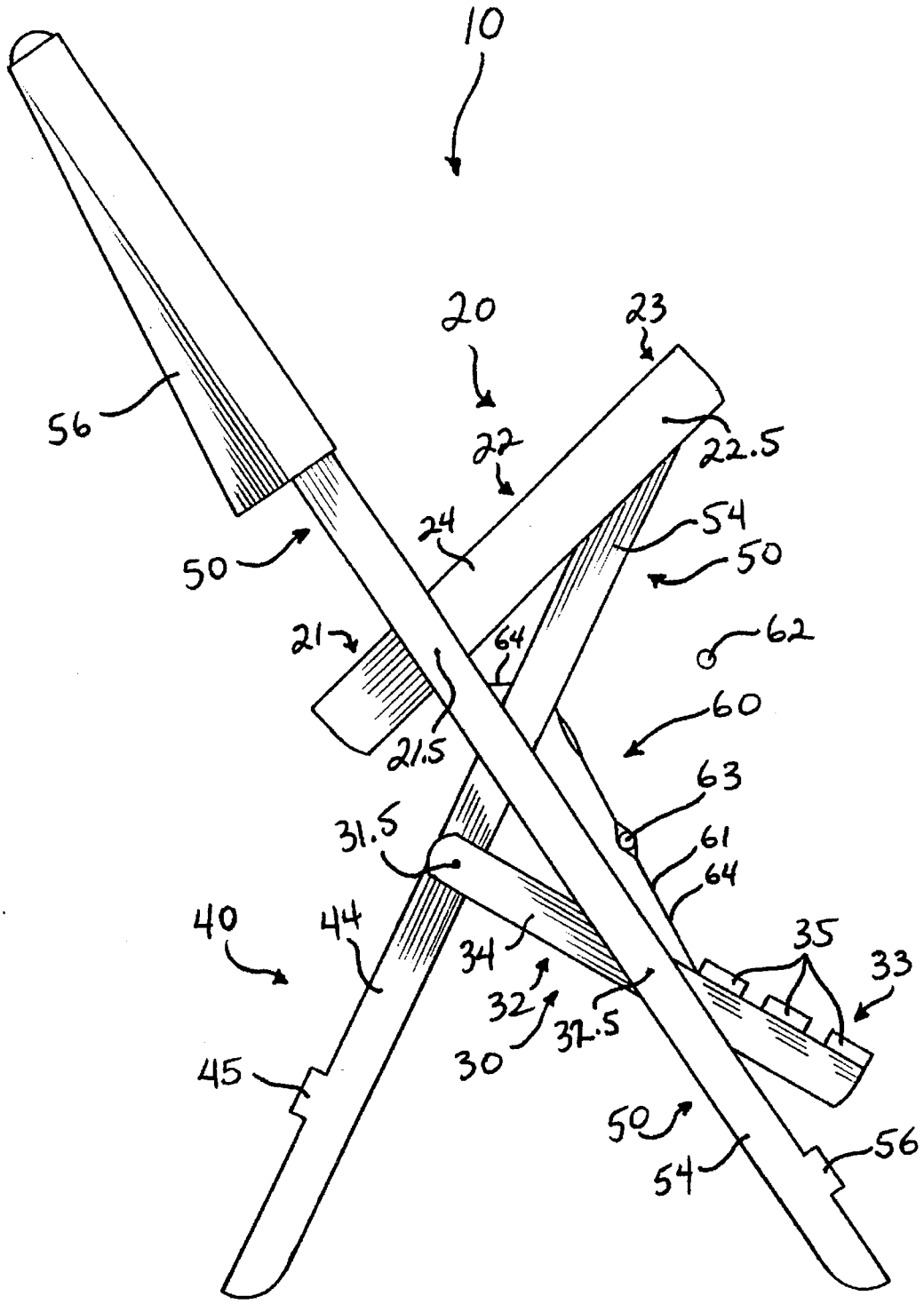
FIG. 16 is a side elevation drawing of the free-standing chair embodiment of the invention, having a single-footrest structure, shown here in an intermediate folded position.
Figure 17:
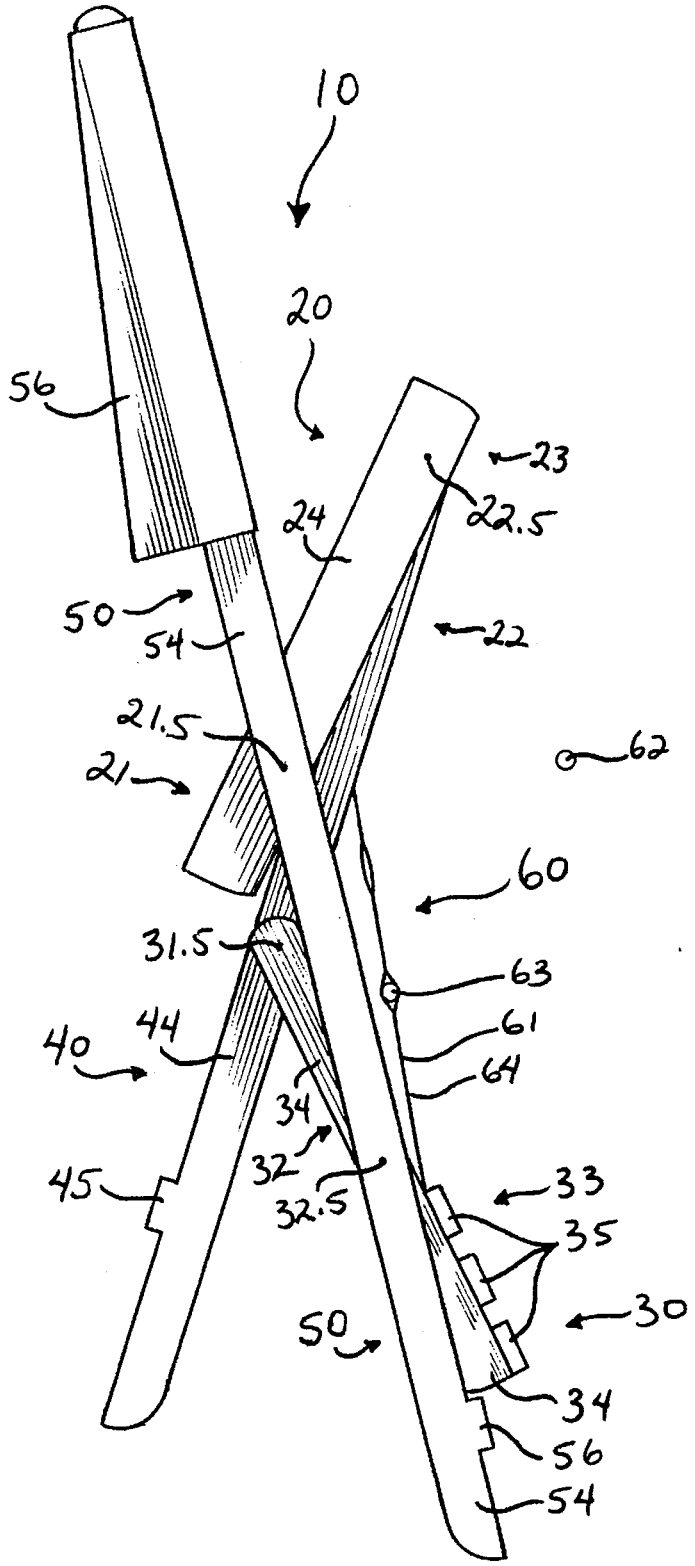
FIG. 17 is a side elevation drawing of the free-standing chair embodiment of the invention, having a single-footrest structure, shown here in an advanced folded position.
Figure 18:
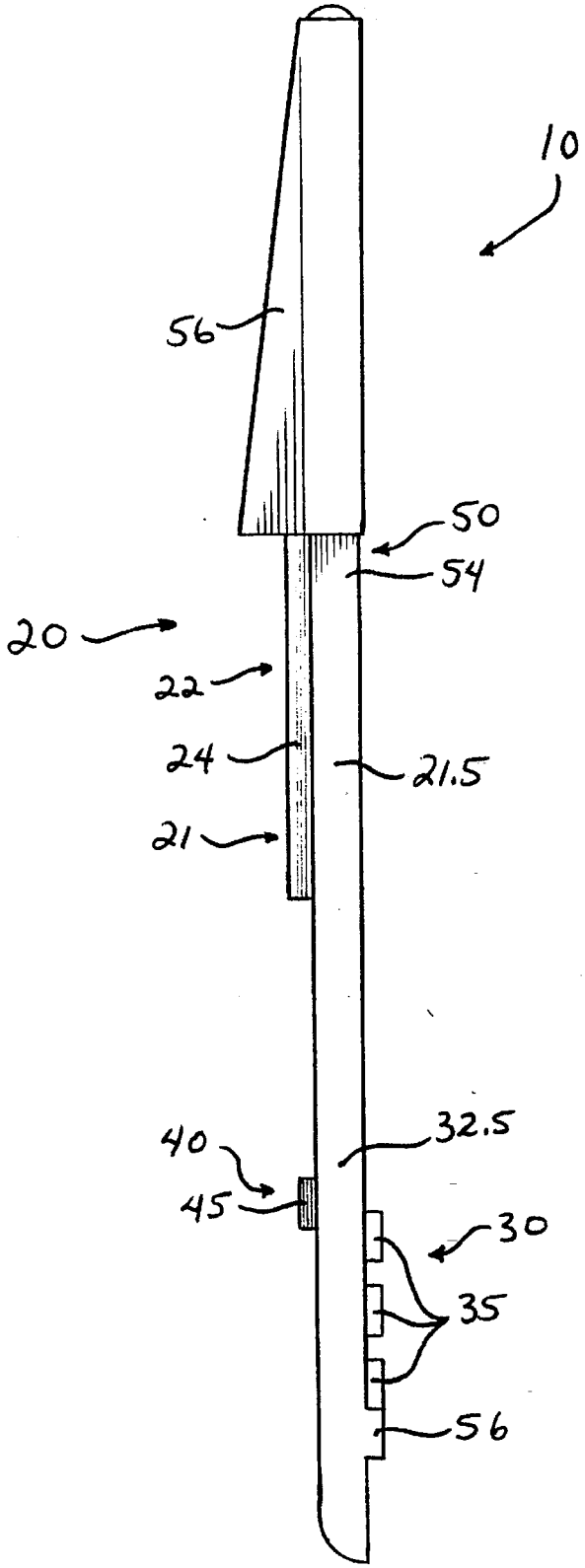
FIG. 18 is a side elevation drawing of the free-standing chair embodiment of the invention, having a single-footrest structure, shown here in the fully folded position.

FIGS. 16, 17, and 18

FIGS. 16, 17, and 18 demonstrate the motions and relationships of the load-bearing structures 20, 30 and integrating leg frames 40, 50 of the free-standing chair embodiment 10 of the invention as the chair 10 is folded out of use. It can be seen with reference to FIGS. 16 and 17 that in folding the chair 10, the upper tethering stop 62 is disengaged so that the cooperation of the tethering member 61, via the tethering stop 62, with the rear leg frame cross-member 45 at 49 is by-passed as the front and intermediate load-sharing portions 23, 22 of the upper load-bearing seat structure 20 are moved upwardly and rearwardly toward the backrest element 56 of the front leg frame 50. In order to effect this movement in the chair 10 and its load-bearing structures 20, 30 and integrating leg frames 40, 50, the user simply holds the front load-sharing portion 23 of the upper load-bearing seat structure 20 in one hand and hold front leg frame 50 above the second pair of pivot points 21.5 in the other hand while drawing these parts of the chair 10 toward each other so that the angle between the forward surface of the backrest element 56 and the upper surface of the upper load-bearing seat structure 20 at the second pair of pivot points 21.5 is diminished as this movement is continued. Use of one foot to press downwardly and rearwardly on the front load-sharing portion 33 of the lower load-bearing footrest structure 30 assists in the folding operation just described. FIG. 17 shows an advanced stage of this folding operation. FIG. 18 shows the chair embodiment 10 of the invention in the fully folded disposition.

DESCRIPTION OF VARIANT EMBODIMENTS

Operation

FIGS. 4, 5, 6, and 7

Figure 6:
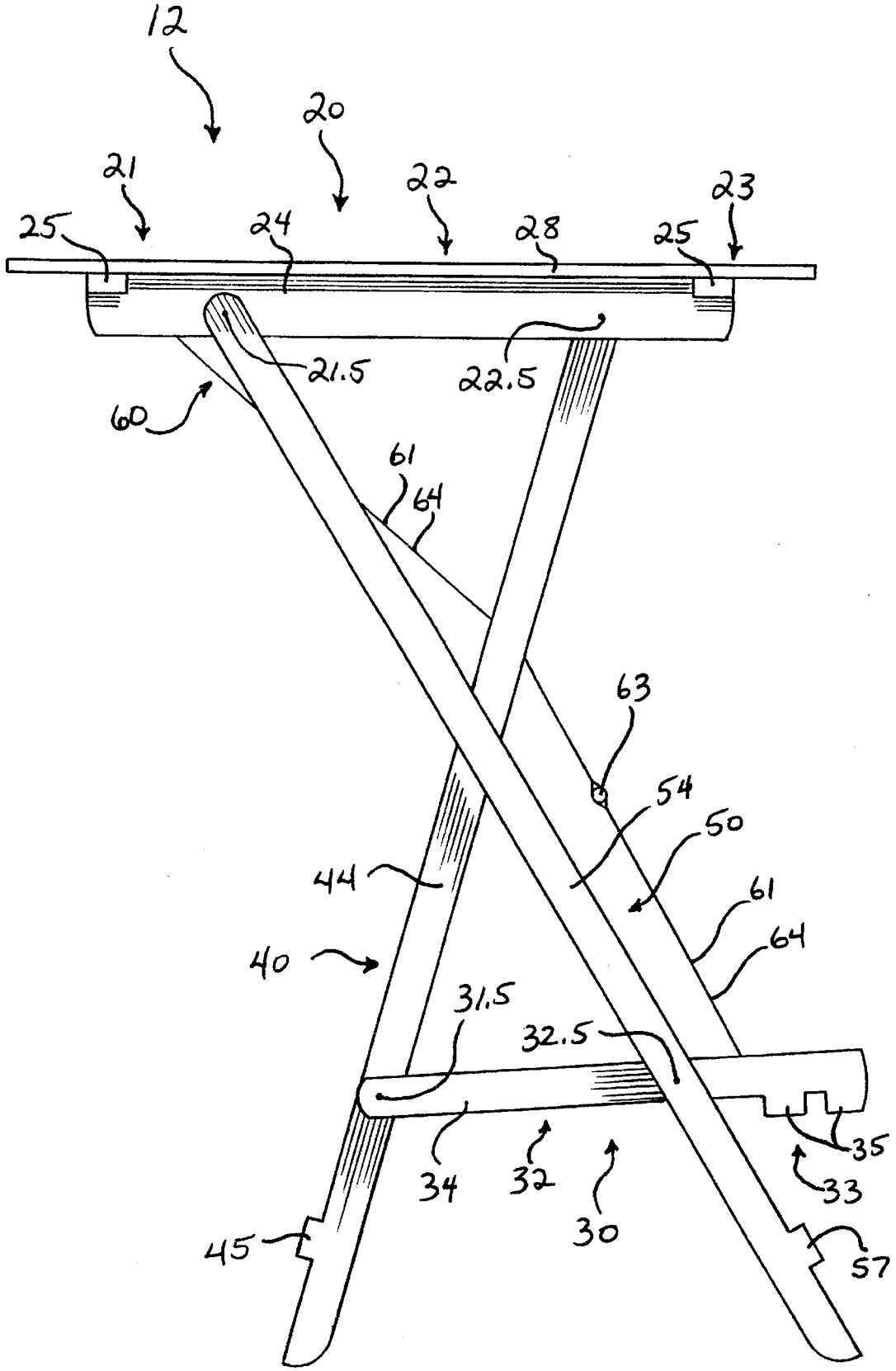
FIG. 6 is a side elevation drawing of the drafting table embodiment of the invention in which the table-top structure is shown in its upwardly and rearwardly limited disposition.

FIG. 6 shows the drafting table embodiment 12 of the invention with the upper load-bearing table-top structure 20 in its generally horizontal, rearwardly limited disposition, the tethering member 61 cooperates with the rear leg frame cross-member 45, via the upper tethering stop 62, by which means further rearward movement of the table-top structure 20 is substantially prevented, although elastic means 64 in the tethering member 61 afford some degree of further, though substantially limited, rearward movement. With reference to FIGS. 4 and 5, a user of this drafting table embodiment 12 of the invention would effect the movement of the table-top structure 20 from its forwardly inclined disposition to the generally horizontal position, as shown in FIG. 6, by increasing the weight-and-pressure load applied to the front load-sharing portion 33 of the lower load-bearing footrest structure 30, that is, by pressing downward with one or both feet on the footrest cross-members 35, by diminishing the weight-and-pressure load applied to the front load-sharing portion 23 of the upper load-bearing table-top structure 20, that is, by lift the hands and arms off of the front of the table-top 20, and by applying an additional weight-and-pressure load to the rear load-sharing portion 21 of the upper load-bearing table-top structure 20. In this way, the front load-sharing portion 33 of the lower load-bearing footrest structure 30 is moved downwardly and the upper load-bearing table-top structure 20 is moved upwardly and rearwardly until the desired inclination of the upper load-bearing table-top structure 20 is reached or until that structure 20 approaches a generally horizontal disposition and the tethering member 61 cooperates with the rear leg frame cross-member 45, via the upper tethering stop 62, to substantially limit further movement in this direction.

Figure 7:
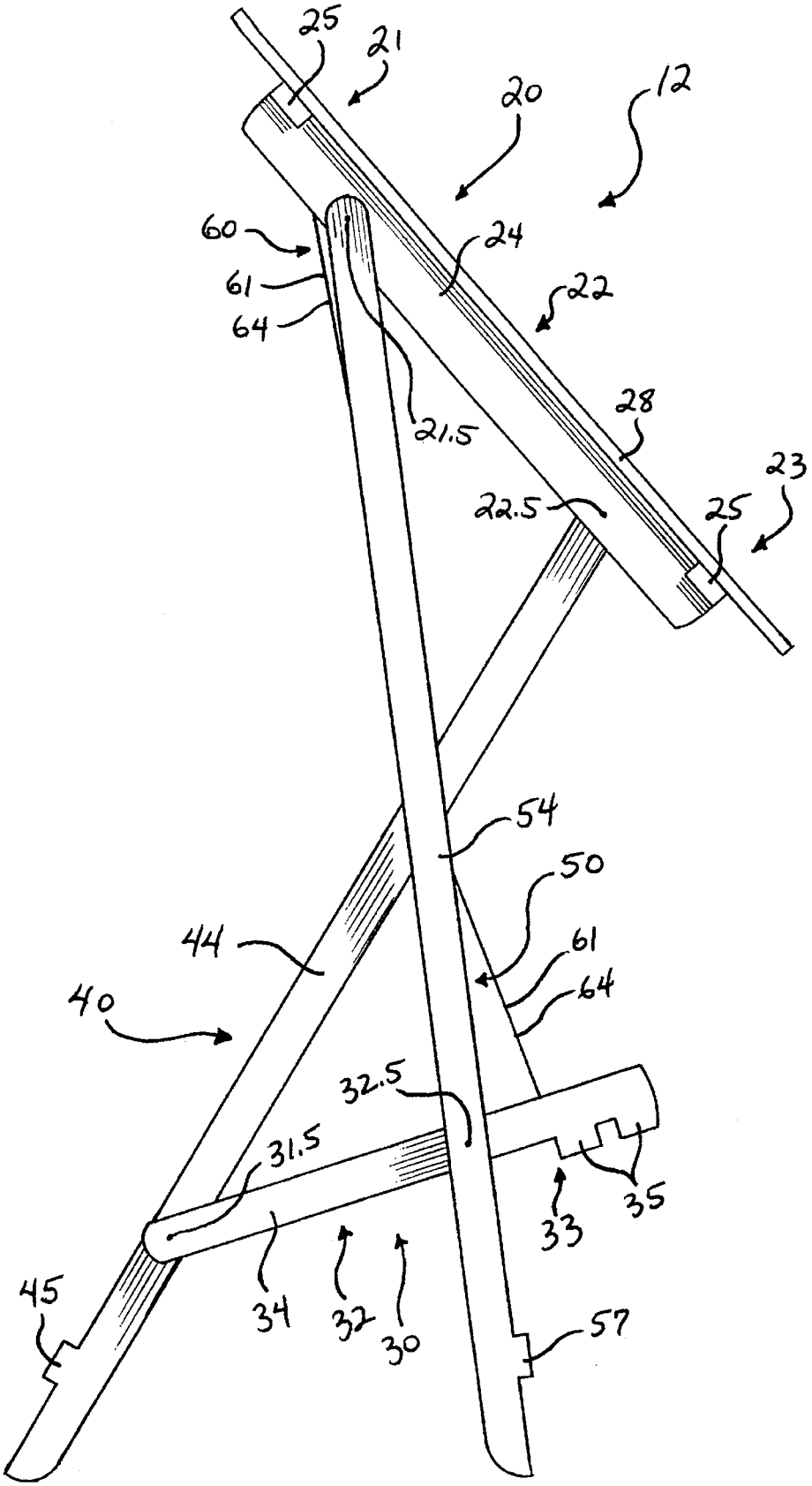
FIG. 7 is a side elevation drawing of the drafting table embodiment of the invention in which the table-top structure is shown in its downwardly and forwardly limited disposition.

FIG. 7 shows the drafting table embodiment 12 of the invention with the upper load-bearing table-top structure 20 generally in its most forwardly inclined working position, the tethering member 61 cooperating with the rear leg frame cross-members 45, via the lower tethering stop 63, by which means further forward movement and inclination of the table top structure 20 is substantially prevented, although again elastic means 64 in the tethering member 61 afford some degree of further, though substantially limited, forward movement and further inclination of the table-top structure 20. With reference to FIGS. 4, 5, and 6 a user of this drafting table embodiment 12 of the invention would effect movement of the upper load-bearing table-top structure 20 from its rearward, generally horizontal disposition, as shown in FIG. 6, through the intermediate forwardly inclined working position, as shown in FIGS. 4 and 5, and onward to the forwardly inclined working position, as shown in FIG. 7, with the tethering member 61 cooperating, via the lower tethering stop 63, with the rear leg frame cross-members 45, by decreasing the weight-and-pressure load applied to the front load-sharing portion 33 of the lower load-bearing footrest structure 30, that is, by lifting some of the weight and pressure of the legs and feet from the footrest cross-members 33, by increasing the weight-and-pressure load applied to the front load-sharing portion 23 of the upper load-bearing table-top structure 20, that is, by pressing downward with the hands and arms on the front of the table-top structure 20, and, if desired, by pulling upwardly and forwardly on the rear load-sharing portion 21 of that upper load-bearing table-top structure 20.

Additional stability in extreme forward and rearward dispositions of this embodiment 12 of the invention may be afforded either by attaching the lower end of the one or both leg frames 40, 50 to the supportive grounding surface with mobile connecting means or by altering the relative distances between the four pairs of pivot points 21.5, 22.5, 31.5, 32.5 so as to increase the distance between the lower ends of the front and rear leg frames 50, 40 when the drafting table 12 is in use.

This drafting table embodiment 12 of the invention, as shown in FIGS. 4, 5, 6, and 7, is folded into a substantially flat disposition when not in use by first disengaging the lower tethering stop 63, thereby allowing cooperation of the tethering member 61 with the rear leg frame cross-member 45 to be by-passed. The front load-sharing portion 23 of the upper load-bearing table-top structure 20 is then moved downwardly and rearwardly until the forward edges of the upper and lower load-bearing structures 20, 30 swing toward each other between the first and third pairs of pivot points 22.5, 32.5 and converge adjacent the forward surfaces of the front and rear leg frames 40, 50. At this stage, the table 12 can be raised and pivoted rearwardly on the lower end of the rear leg frame 40. The drafting table embodiment 12 of the invention is fully folded when the upper surfaces of the lower load-bearing footrest structure cross-members 35 engage the forward surfaces of the rear leg frame side elements 44, when the forward surfaces of the front and rear leg frame side elements 54, 44 engage the lower surfaces of the upper load-bearing table-top structure cross-members 25, and when all pairs of pivot point 21.5, 22.5, 31.5, 32.5 occupy substantially a common plane. At this point, the drafting table 12 is fully fold for storage and transport.

FIGS. 23, 24, 25, and 26

FIGS. 23 and 24 show the free-standing variant chair embodiment 17 of the invention. FIGS. 25 and 26 show the free-standing variant chair embodiment 18 of the invention.

Both embodiments 17, 18 are shown in an intermediate operative position.

The operation of these variant chair embodiments 17, 18 is substantially similar to that of the presently preferred chair embodiment 10 of the invention, with the exception that the feet of the user of the variant chair embodiments 17, 18 may rest on the supportive grounding surface throughout the full range of pivotal motions and angular dispositions assumed by the variant chair embodiments 17, 18 when in use. In this way, the user of the variant chair embodiments 17, 18 of the invention may alter the conformation of the chairs 17, 18 and may adjust the angular and spatial interrelationships among the structures 20, 30 and frames 40, 50 of the chairs 17, 18 by shifting weight-and-pressure loads and fractional elements thereof among the load-sharing portions 21, 22, 23 of the upper load-bearing seat structure 20, the backrest element 56 of the front leg frame 50, and the supportive grounding surface. That is, in order to move the upper load-bearing seat structure 20 to a rearwardly inclined disposition, relative to the intermediate operative, or substantially horizontal, position displayed in FIGS. 23, 24, 25, and 26, thereby shifting the conformation of the integrated standing structure of the chairs 17, 18 to a more erect and upright sitting posture, a user of the chairs 17, 18 may increase weight-and-pressure forces applied to the rear load-sharing portion 21 of the upper load-bearing seat structure 20 while reducing weight-and-pressure forces applied to the front and intermediate load-sharing portions 23, 22 of the upper load-bearing seat structure 20, while reducing weight-and-pressure forces applied to the backrest element 56 of the front leg frame 50, and while increasing weight-and-pressure forces applied to the supportive grounding surface. In order to move the upper load-bearing seat structure 20 to a forwardly and downwardly inclined disposition, relative to the intermediate operative position displayed in FIGS. 23, 24, 25, and 26, thereby shifting the conformation of the integrated standing structure of the chairs 17, 18 to a more reclined sitting posture, a user of the chairs 17, 18 may increase weight-and-pressure forces applied to the front and intermediate load-sharing portions 23, 22 of the upper load-bearing seat structure 20 and increase weight-and-pressure forces applied to the backrest element 56 of the front leg frame 50 while decreasing weight-and-pressure forces applied to the rear load-sharing portion 21 of the upper load-bearing seat structure 20 and decreasing weight-and-pressure forces applied to the supportive grounding surface.

FIGS. 22, 24, and 26

FIGS. 22, 24, and 26 show variant embodiments 16, 17, 18 of the invention in which the tethering member 61 cooperates with the rear leg frame cross-member 45 via a single tethering stop 62 or 63 to regulate the relative pivotal motion of the invention when in operation. In order to simplify construction and operation of these variant embodiments 16, 17, 18 of the invention, the tethering member 61 may be made to cooperate directly with the rear leg frame cross-member 45, that cross-member 45 then serving as the single tethering stop 62 or 63, so that the portion of the tethering member 61 under tension at the limited extent of pivotal motion of the invention is detachably connected with the rear leg frame cross-member 45, while the portion of the tethering member 61 not under tension at the limited extend of pivotal motion of the invention is absent. That is, in such case, viewing the variant embodiment 16 of the invention shown in FIG. 22, the central upper load-bearing structure cross-member 25, the tethering stop 62, and the portion of the tethering member 61 above the rear leg frame cross-member 45 are absent, and the upper end of the portion of the tethering member 61 below the rear leg frame cross-member 45 is detachably connected with that cross-member 45, that cross-member 45 thereby serving as a tethering stop 45. Also in such case, viewing the variant embodiments 17, 18 of the invention shown in FIGS. 24 and 26, in each instance, the tethering stop 62 and the portion of the tethering member 61 below the rear leg frame cross-member 45 are absent, and the lower end of the portion of the tethering member 61 above the rear leg frame cross-member 45 is detachably connected with that cross-member 45, that cross-member 45 thereby serving as a tethering stop 45.

I claim:

1. A foldable article of furniture in the form of a chair, table, or other such load-support device, comprising an upper load-bearing structure and a lower load-bearing structure, each having a plurality of load-sharing portions thereof defined by the pivotally articulated integration of said upper and lower load-bearing structures with intersecting front and rear leg frames so as to move through a desired range of operating positions in response to changing load conditions when in use, so as to apportion and redistribute loads between said upper and lower load-bearing structures, said load-sharing portions thereof, and said integrating front and rear leg frames, so as to balance and counterbalance dynamic fractional loads among said structures, said portions thereof, and said leg frames and in so doing to conform implicitly and spontaneously to the specific and dynamic postures, proportions, purposes, and actions of a user and thereby to provide comprehensively adaptable support for all dynamic fractional and gross loads bearing on said load-bearing structures and said integrating leg frames; said article being characterized by:

said front leg frame comprising spaced side elements and at least one cross-member, said front leg frame defining a first imaginary plane inclined with respect to the horizontal when the article is in use;

said rear leg frame comprising spaced side elements and at least one cross-member, said rear leg frame defining a second imaginary plane oppositely inclined with respect to the horizontal and intersecting said first imaginary plane between said front leg frame side elements when said article is in use;

said upper load-bearing structure comprising spaced side elements, at least one cross-member, and at least one surface element, said upper load-bearing structure being pivotally connected to said rear leg frame above said intersection of said first and second imaginary planes by aligned pivotal connecting means at a first pair of pivot points rearward of the forward end of said upper load-bearing structure, so as to define a boundary between an intermediate upper load-sharing portion and a front upper load-sharing portion of said upper load-bearing structure, and being pivotally connected to said front leg frame above said intersection of said first and second imaginary planes by aligned pivotal connecting means at a second pair of pivot points rearward of said first pair of pivot points, so as to define a boundary between a rear upper load-sharing portion and said intermediate upper load-sharing portion of said upper load-bearing structure, the outer lateral surfaces of said upper load-bearing structure side elements being generally adjacent the inner lateral surfaces of said front leg frame side elements at said second pair of pivot points and the inner lateral surfaces of said upper load-bearing structure side elements being generally adjacent the outer lateral surfaces of said rear leg frame side elements at said first pair of pivot points;

said lower load-bearing structure comprising spaced side elements and at least one cross-member, said lower load-bearing structure being pivotally connected to said front leg frame below said intersection of said first and second imaginary planes by aligned pivotal connecting means at a third pair of pivot points rearward of the forward end of said lower load-bearing structure, so as to define a boundary between an intermediate lower load-sharing portion and a front lower load-sharing portion of said lower load-bearing structure, and being pivotally connected to said rear leg frame below said intersection of said first and second imaginary planes by aligned pivotal connecting means at a fourth pair of pivot points rearward of said third pair of pivotal points, so as to define a boundary between a rear lower load-sharing portion and said intermediate lower load-sharing portion of said lower load-bearing structure, the outer lateral surfaces of said lower load-bearing structure side elements being generally adjacent the inner lateral surfaces of said front leg frame side elements at said third pair of pivot points and the inner lateral surfaces of said lower load-bearing structure side elements being generally adjacent the outer lateral surfaces of said rear leg frame side elements at said fourth pair of pivot points;

the relative distances between said first, second, third, and fourth pairs of pivot points and the relative dimensions of said upper and lower load-bearing structures and of said integrating front and rear leg frames being proportioned to afford optimum versatility, adaptability, and utility in said article when said article is in use and when appropriate to allow said article to be folded to a substantially flat disposition when not in use; and motion governing means, by which at least one of said upper and lower load-bearing structures cooperates with at least one of said integrating front and rear leg frames, so as to govern the relative pivotal movements of said upper and lower load-bearing structures and of said front and rear leg frames of said article through said desired range of operating positions when said article is in use;

whereby said article is an integrated assemblage of reciprocally interactive load-bearing structures, of co-responsive, load-distributing, balancing, implicity load-reapportioning, and mutually counterbalancing load-sharing portions thereof, and of cooperating supportive leg frames.

2. A foldable article as defined in claim 1;

wherein the length of said upper load-bearing structure surface elements equals or exceeds the length of said upper load-bearing structure side elements, wherein the breadth of said upper load-bearing structure surface elements equals or exceeds the space between the outer lateral surfaces of said upper load-bearing structure side elements, wherein at least one said lower load-bearing structure cross-member is disposed forward of said third pair of pivot points, and wherein at least one said lower load-bearing structure cross-member is disposed rearward of said fourth pair of pivot points, said article thereby forming a pivotally articulated foldable table comprising mutually co-responsive, balancing, load-distributing, counterbalancing, and load-reapportioning dual footrest and table-top load-bearing structures.

3. A foldable article as defined in claim 1;

wherein the length of said upper load-bearing structure surface elements equals or exceeds the length of said upper load-bearing structure side elements, wherein the breadth of said upper load-bearing structure surface elements equals or exceeds the space between the outer lateral surfaces of said upper load-bearing structure side elements, and wherein said fourth pair of pivot points is generally near the rear end of said lower load-bearing structure, said article thereby forming a pivotally articulated foldable table, comprising mutually co-responsive balancing, load-distributing, counterbalancing, and load-reapportioning footrest and table-top load-bearing structures.

4. A foldable article as defined in claim 1;

wherein the length of said upper load-bearing structure surface elements equals or exceeds the length of said upper load-bearing structure side elements, wherein the breadth of said upper load-bearing structure surface elements equals or exceeds the space between the outer lateral surfaces of said upper load-bearing structure side elements, wherein said front leg frame side elements are substantially longer than said rear leg frame side elements, wherein the greater length of said front leg frame side elements is disposed substantially between said second and third pairs of pivot points, and wherein said fourth pair of pivot points is generally near the rear end of said lower load-bearing structure; said article thereby forming a pivotally articulated foldable table, comprising mutually co-responsive balancing, load-distributing, counterbalancing, and load-reapportioning footrest and inclined table-top load-bearing structures.

5. A foldable article as defined in claim 1;

wherein the length of said upper load-bearing structure surface elements generally equals the length of said upper load-bearing structure side elements, wherein the breadth of said upper load-bearing structure surface elements generally equals the space between the outer lateral surfaces of said front leg frame side elements, wherein at least one said lower load-bearing structure cross-member is disposed forward of said third pair of pivot points, and wherein at least one said lower load-bearing structure cross-member is disposed rearward of said fourth pair of pivot points, said article thereby forming a pivotally articulated foldable stool, comprising mutually co-responsive balancing, load-distributing, counterbalancing, and load-reapportioning dual footrest and seat load-bearing structures.

6. A foldable article as defined in claim 1;

wherein the length of said upper load-bearing structure surface elements generally equals the length of said upper load-bearing structure side elements, wherein the breadth of said upper load-bearing structure surface elements generally equals the space between the outer lateral surfaces of said front leg frame side elements, and wherein said fourth pair of pivot points is generally near the rear end of said lower load-bearing structure, said article thereby forming a pivotally articulated foldable stool, comprising mutually co-responsive balancing, load-distributing, counterbalancing, and load-reapportioning footrest and seat load-bearing structures.

7. A foldable article as defined in claim 1;

wherein the length of said upper load-bearing structure surface elements generally equals the length of said upper load-bearing structure side elements, wherein the breadth of said upper load-bearing structure surface elements generally equals the space between the outer lateral surfaces of said upper load-bearing structure side elements, wherein a portion of the said front leg frame is disposed above said second pair of pivot points, wherein at least one said front leg frame cross-member is disposed between said front leg frame side elements above said second pair of pivot points, thereby forming a backrest element, wherein said fourth pair of pivot points is generally near the lower end of said rear leg frame, wherein said third pair of pivot points is generally near the lower end of said front leg frame, and wherein said lower load-bearing structure side elements are curved to resemble shallow inverted longitudinal arcs having concave surfaces oriented upwardly and having convex surfaces oriented downwardly such that the lower convex surfaces of said lower load-bearing structure side elements engage the supportive grounding surface, the lower load-bearing structure thereby forming a rockered footrest base structure when the article is in use, said article thereby forming a pivotally articulated foldable rocking chair comprising mutually co-responsive balancing, load-distributing, counterbalancing, and load-reapportioning rockered footrest base and seat load-bearing structures and cooperating backrest element.

8. A foldable article as defined in claim 1;

wherein the length of said upper load-bearing structure surface elements generally equals the length of said upper load-bearing structure side elements, wherein the breadth of said upper load-bearing structure surface elements generally equals the space between the outer lateral surfaces of said upper-bearing structure side elements, wherein a portion of said front leg frame is disposed above said second pair of pivot points, wherein at least one said front leg frame cross-member is disposed between said front leg frame side elements above said second pair of pivot points, thereby forming a backrest element, and wherein said fourth pair of pivot points is generally near the rear end of said lower load-bearing structure, said article thereby forming a pivotally articulated foldable free-standing chair, comprising mutually co-responsive balancing, load-distributing, counterbalancing, and load-reapportioning footrest and seat load-bearing structures and cooperating backrest element.

9. A foldable article as defined in claim 1;

wherein the length of said upper load-bearing structure surface elements generally equals the length of said upper load-bearing structure side elements, wherein the breadth of said upper load-bearing structure surface elements generally equals the space between the outer lateral surfaces of said upper load-bearing structure side elements, wherein a portion of said front leg frame is disposed above said second pair of pivot points, wherein at least one said front leg frame cross-member is disposed between said front leg frame side elements above said second pair of pivot points, thereby forming a backrest element, wherein said front leg frame is connected in static union with a supportive grounding surface, wherein said fourth pair of pivot points is generally near the rear end of said lower load-bearing structure, wherein said fourth pair of pivot points is generally near the lower end of said rear leg frame, and wherein said motion-governing means are adapted to suspend the lower end of said rear leg frame in space, independent of a supportive grounding surface, when the article is in use, said article thereby forming a fixed-front-leg-frame stationary chair, comprising mutually co-responsive balancing, load-distributing, counterbalancing, and load-reapportioning footrest and seat load-bearing structures, cooperating backrest element, and cushioned load support characteristics.

10. A foldable article as defined in claim 1;

wherein the length of said upper load-bearing structure surface elements generally equals the length of said upper load-bearing structure side elements, wherein the breadth of said upper load-bearing structure surface elements generally equals the space between the outer lateral surfaces of said upper load-bearing structure side elements, wherein a portion of said front leg frame is disposed above said second pair of pivot points, wherein at least one said front leg frame cross-member is disposed between said front leg frame side elements above said second pair of pivot points, thereby forming a backrest element, wherein said rear leg frame is connected in static union with a supportive grounding surface, wherein said fourth pair of pivot points is generally near the rear end of said lower load-bearing structure, wherein said third pair of pivot points is generally near the lower end of said front leg frame, and wherein said motion-governing means are adapted to suspend the lower end of said front leg frame in space, independent of a supportive grounding surface, when the article is in use, said article thereby forming a fixed-rear-leg-frame stationary chair comprising co-acting footrest and seat load-bearing structures, cooperating backrest element, and cushioned load support characteristics.

11. A foldable article as defined in claim 1;

wherein the length of said upper load-bearing structure surface elements generally equals the length of said upper load-bearing structure side elements, wherein the breadth of said upper load-bearing structure surface elements generally equals the space between the outer lateral surfaces of said upper load-bearing structure side elements, wherein a portion of said front leg frame is disposed above said second pair of pivot points, wherein at least one of said front leg frame cross-members is disposed between said front leg frame side elements above said second pair of pivot points, thereby forming a backrest element, wherein said fourth pair of pivot points is generally near the rear end of said lower load-bearing structure, wherein said third pair of pivot points is generally near the lower end of said front leg frame, and wherein said lower load-bearing structure declines toward the front end of said lower load-bearing structure, said front end of said lower load-bearing structure engaging a supportive grounding surface, said article thereby forming a free-standing chair, comprising a balancing, load-distributing, counterbalancing, and load-reapportioning upper load-bearing seat structure and cooperating backrest element.

12. A foldable article as defined in claim 1;

wherein the length of said upper load-bearing structure surface elements generally equals the length of said upper load-bearing structure side elements, wherein the breadth of said upper load-bearing structure surface elements generally equals the space between the outer lateral surfaces of said upper load-bearing structure side elements, wherein a portion of said front leg frame is disposed above said second pair of pivot points, wherein at least one of said front leg frame cross-members is disposed between said front leg frame side elements above said second pair of pivot points, thereby forming a backrest element, wherein said fourth pair of pivot points is generally near the rear end of said lower load-bearing structure, and wherein said third pair of pivot points is generally near the front end of said lower load-bearing structure, said article thereby forming a free-standing chair, comprising a balancing, load-distributing, counterbalancing, and load-reapportioning upper load-bearing seat structure and cooperating backrest element.

* * * * *

UNITED STATES PATENT AND TRADEMARK OFFICE

CERTIFICATE OF CORRECTION

PATENT NO. : 5,626,385

DATED : May 6, 1997

INVENTOR(S) : Shinn

It is certified that error appears in the above-identified patent and that said Letters Patent is hereby corrected as shown below:

In the drawings, sheet 22 of 26 consisting of fig. 23 should be deleted and replaced with the sheet of drawing, consisting of fig. 22, as shown on the attached page.

Signed and Sealed this

Sixth Day of January, 1998

*Attest:*

*Attesting Officer*

Bruce Lehman

BRUCE LEHMAN

*Commissioner of Patents and Trademarks*